US005998080A

United States Patent [19]

Ohno et al.

[11] Patent Number: 5,998,080

[45] Date of Patent: Dec. 7, 1999

[54] ELECTROSTATIC IMAGE-DEVELOPING TONER AND IMAGE-FORMING METHOD

[75] Inventors: Manabu Ohno, Numazu; Tsutomu Kukimoto, Yokohma; Satoshi Yoshida, Edogawa-ku; Yasukazu Ayaki, Numazu; Satoshi Handa, Shizuoka-ken; Akira Hashimoto; Keiji Komoto, both of Numazu; Tsuyoshi Takiguchi, Shizuoka-ken, all of Japan

[73] Assignee: Canon Kabushiki Kaisha, Tokyo, Japan

[21] Appl. No.: 09/143,392

[22] Filed: Aug. 28, 1998

[30] Foreign Application Priority Data

| | | | |
|---|---|---|---|
| Aug. 29, 1997 | [JP] | Japan | 9-233965 |
| Aug. 10, 1998 | [JP] | Japan | 10-225482 |

[51] Int. Cl.[6] ..... G03G 9/097; G03G 13/20

[52] U.S. Cl. ..... 430/110; 430/124

[58] Field of Search ..... 430/110, 124

[56] References Cited

U.S. PATENT DOCUMENTS

| | | | |
|---|---|---|---|
| 2,297,691 | 10/1942 | Carlson | 430/31 |
| 4,514,487 | 4/1985 | Kasuya et al. | 430/137 |
| 5,229,243 | 7/1993 | Sasaki et al. | 430/109 |
| 5,368,972 | 11/1994 | Yamashita et al. | 430/110 |
| 5,429,901 | 7/1995 | Muto et al. | 430/110 |
| 5,605,778 | 2/1997 | Onuma et al. | 430/110 |
| 5,712,072 | 1/1998 | Inaba et al. | 430/110 |
| 5,741,617 | 4/1998 | Inaba et al. | 430/110 |

FOREIGN PATENT DOCUMENTS

| | | |
|---|---|---|
| 0072176 | 2/1983 | European Pat. Off. . |
| 0317969 | 5/1989 | European Pat. Off. . |
| 23910 | 11/1967 | Japan . |
| 24748 | 10/1968 | Japan . |
| 3304 | 1/1977 | Japan . |
| 3305 | 1/1977 | Japan . |
| 52574 | 11/1982 | Japan . |
| 215659 | 12/1983 | Japan . |
| 217366 | 10/1985 | Japan . |
| 252361 | 12/1985 | Japan . |
| 14166 | 1/1987 | Japan . |
| 109359 | 4/1989 | Japan . |
| 185660 | 7/1989 | Japan . |
| 238672 | 9/1989 | Japan . |
| 79860 | 3/1990 | Japan . |
| 50559 | 3/1991 | Japan . |
| 184350 | 7/1992 | Japan . |
| 97/44713 | 11/1997 | WIPO . |

OTHER PUBLICATIONS

Database WPI, Section Ch., Week 8438, Derwent Publ., AN–84–233505 (1984) XP002041949 for JP 59–137957.

*Primary Examiner*—Roland Martin
*Attorney, Agent, or Firm*—Fitzpatrick, Cella, Harper & Scinto

[57] ABSTRACT

A toner for developing an electrostatic image has toner particles containing at least a binder resin, a colorant, and a wax. The wax contains an ester compound represented by specific formula, or a mixture thereof at a content ranging from 50 to 100% by weight based on the weight of the wax.

112 Claims, 13 Drawing Sheets

ELECTROSTATIC IMAGE-DEVELOPING TONER AND IMAGE-FORMING METHOD

BACKGROUND OF THE INVENTION

1. Field of the Invention

The present invention relates to a toner for developing an electrostatic image in an image-forming process such as electrophotography and electrostatic printing, and to an image-forming method employing the toner. More specifically, the present invention relates to a toner for developing an electrostatic image suitable for fixation of a developed image by heating and pressing onto a transfer medium, and to an image-forming method employing the toner.

2. Related Background Art

Many electrophotographic processes are known, for example, as disclosed by U.S. Pat. No. 2,297,691, and Japanese Patent Publication Nos. 42-23910 and 43-24748. Generally, in the electrophotographic process, an electrostatic image is formed by an appropriate method on a photosensitive member containing a photoconductive material, the electrostatic image is developed with a toner, the toner image is transferred onto a transfer medium like a paper sheet, and the transferred toner image is fixed by a suitable method such as heating, pressing, hot-pressing, and solvent-vapor treatment to obtain a copy or a print. In the electrostatic process, the untransferred toner remaining on the photosensitive member is cleaned by an appropriate method, and the above steps are repeated.

In a typical full-color or multi-color image formation system, color image formation is conducted as follows. A photosensitive drum or a photosensitive belt is electrically uniformly charged. The charged drum or belt is exposed imagewise to laser light modulated for one color image signal, for example, magenta color image signal, to form an electrostatic image on the photosensitive drum or belt. The electrostatic image on the photosensitive drum or belt is developed with a magenta-developing device to form a magenta toner image. The magenta toner image is transferred onto an intermediate transfer member. In the same manner, development and transfer of an image of a second color, a third color, and a fourth color are conducted. The superposed four-color toner image is transferred from the intermediate transfer member to a transfer medium. The four-color toner image is fixed on the recording member by a hot-pressing fixing means to form a full-color or multi-color image.

In another full-color or multi-color image formation employing four photosensitive drum and a transfer belt, color image formation is conducted as follows. A first color toner image is formed on a first photosensitive drum, a second color toner image is formed on a second photosensitive drum, a third color toner image is formed on a third photosensitive drum, and a fourth color toner image is formed on a fourth photosensitive drum. With movement of a transfer medium on a transfer belt, the first to fourth color toner images on the first to fourth photosensitive drums are successively transferred onto the transfer medium. The transferred first to fourth color toner images are fixed on the transfer medium by a hot-pressing fixing means to form a full-color or multi-color image.

In a still another full-color or multi-color image formation employing one photosensitive drum (or a photosensitive drum) and a transfer drum to hold a transfer medium, color image formation is conducted as follows. A first color toner image is formed on a photosensitive drum. The first color toner image is transferred from the photosensitive drum onto a transfer medium held on a transfer drum. In the same manner, second to fourth toner images are successively transferred onto the transfer medium on the transfer drum. The transfer medium having the first to fourth color toner images is separated from the transfer drum, and is delivered to a hot-pressing fixing means to fix the images to form a full-color or multi-color image.

In the full-color or multi-color image formation, in which plural color toner images are superposed, and in which plural color toner images are superposed, and is fixed by heat and pressure, low-temperature offset or high-temperature offset is liable to be caused as compared with mono-color image formation.

For imparting high fixability and high offset-resistance to the toner itself, methods have been disclosed in which a low-molecular wax like polyolefin wax is incorporated into the particulate toner: for example, in Japanese Patent Publication Nos. 52-3304, 52-3305, and 57-52574; Japanese Patent Application Laid-Open Nos. 58-215659, 60-217366, 60-252361, 62-14166, 1-109359, 2-79860, and 3-50559.

A toner containing a montan type wax, a mineral wax, is disclosed as a wax component giving relatively high fixability. As the montan type wax, use of a wax of the formula below:

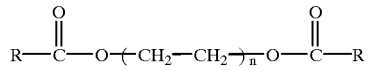

(where R is a hydrocarbon group having 28 to 32 carbons, and n is an integer) having a molecular weight of about 800 is disclosed in Japanese Patent Application Laid-Open Nos. 1-185660 and 1-238672. However, this montan type wax, which has a straight molecular structure, has high plasticizing effect to soften the toner to deteriorate the high-temperature offset resistance, although low-temperature fixation can be improved in some extent. The plasticized toner is liable to cause disadvantages in development properties, durability, and anti-blocking property.

A toner containing partially esterified polyglycerin compound is disclosed in Japanese Patent Application Laid-Open No. 4-184350. The polyglycerin is, for example, represented by the formula below:

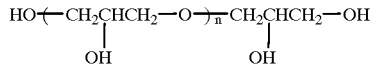

(where n is an integer of one or more). The partially esterified polyglycerin is an ester of the polyglycerin having remaining free OH groups, not containing substantially completely esterified polyglycerin having no free OH groups. The partially esterified polyglycerin compound, although it has higher affinity to paper sheets owing to the remaining OH groups, is liable to lower the triboelectric charging properties and to lower the resolution. Further, in the case where toner particles are directly formed from a polymerizable monomer composition in an aqueous medium, the remaining OH groups of the partially esterified polyglycerin contained in the monomer composition will retard the particle formation in the aqueous medium, and broaden the particle size distribution of the formed toner particles.

Formation of a toner particles by suspension polymerization is disclosed in Japanese Patent Publication 36-10231. In this suspension method, a polymerizable monomer composition is prepared by dissolving or dispersing uniformly a polymerizable monomer, and a colorant (and, as necessary, a polymerization initiator, crosslinking agent, a charge-controlling agent, a wax, and other additives); the polymerizable monomer composition is dispersed as particles in an aqueous medium containing a dispersion stabilizer by means of an appropriate stirrer; and the dispersed monomer composition is allowed to polymerize to form a toner particles.

In the suspension polymerization, liquid drops of a polymerizable monomer composition are formed in a highly polar dispersion medium like water, so that the polar groups in the polymerized monomer composition tends to locate at the surface layer portion of the particle at the interface, and the nonpolar components tend to be in interior of the particle, which gives a core/shell structure.

The particulate toner formed directly by polymerization encloses the wax component as a releasing agent in the interior. Therefore, the toner can satisfy simultaneously low-temperature fixability, and anti-blocking property and high-temperature offset resistance which are inherently incompatible, and can prevent high-temperature offset without applying a releasing agent like an oil on the fixing roller. For this purpose, even though toner particles are prepared by polymerization method, the ester wax capable of forming favorable toner particles is promising.

SUMMARY OF THE INVENTION

An object of the present invention is to provide an electrostatic image-developing toner which does not cause the above problems.

Another object of the present invention is to provide an electrostatic image-developing toner which has excellent low-temperature fixability and high-temperature offset resistance.

Still another object of the present invention is to provide an electrostatic image-developing toner which is suitable for hot-pressing fixation and has sufficient fixability even at a low fixation pressure without pressure dependence.

A further object of the present invention is to provide an electrostatic image-developing toner which soils less the carrier, the developing sleeve, the applying blade, the electrostatic image holder, the intermediate transfer member, and the like.

A still further object of the present invention is to provide an electrostatic image-developing toner which has excellent anti-blocking properties.

A still further object of the present invention Is to provide an electrostatic image-developing toner for formation of full color images, multi-color images, or mono-color images, the toner having excellent low-temperature fixability, and excellent high-temperature offset resistance, and is suitable.

A still further object of the present invention is to provide an electrostatic image-developing toner which causes less fogging and forms no blank portion of the image, and is excellent in resolution and dot-reproducibility of digital latent images.

A still further object of the present invention is to provide an electrostatic image-developing toner which is capable of forming chromatic color images having sufficient light-transmissibility.

A still further object of the present invention is to provide an electrostatic image-developing toner which is capable of forming toner images and fixed images of high quality under various conditions.

A still further object of the present invention is to provide a method for forming an image with the above toner.

The electrostatic image-developing toner of the present invention comprises toner particles containing at least a binder resin, a colorant, and a wax, wherein the wax contains an ester compound represented by Formula (A), (B), (C), or (D), or a mixture thereof at a content ranging from 50 to 100% by weight based on the weight of the wax:

(A)

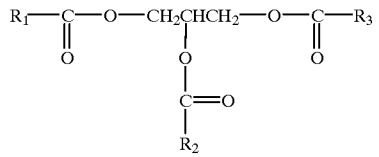

(where $R_1$, $R_2$, and $R_3$ are independently an organic group having from 9 to 39 carbons);

(B)

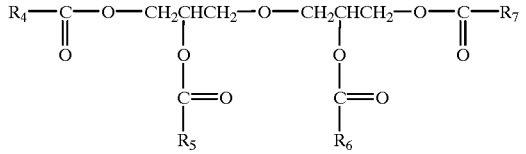

(where $R_4$, $R_5$, $R_6$, and $R_7$ are independently an organic group having from 9 to 39 carbons);

(C)

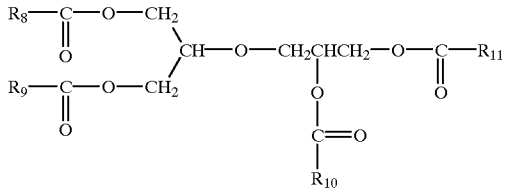

(where $R_8$, $R_9$, $R_{10}$ and $R_{11}$ are independently an organic group having from 9 to 39 carbons);

(D)

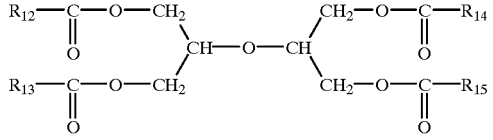

(where $R_{12}$, $R_{13}$, $R_{14}$ and $R_{15}$ are independently an organic group having from 9 to 39 carbons).

The image forming method of the present invention comprises charging electrically an electrostatic image holder by a charging means having a voltage applied thereto, forming an electrostatic image by light exposure on the charged electrostatic image holder, developing the electrostatic image with a toner in the developing means to form a toner image on the electrostatic image holder, transferring the toner image on the electrostatic image holder through an intermediate transfer member or directly onto a transfer medium, and fixing the toner image by hot-pressing fixing means; wherein the toner comprises toner particles containing at least a binder resin, a colorant, and a wax, wherein the wax contains an ester compound represented by Formula (A), (B), (C), or (D), or a mixture thereof at a content ranging from 50 to 100% by weight based on the weight of the wax:

(A)

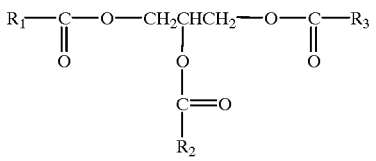

(where $R_1$, $R_2$,and $R_3$ are independently an organic group having from 9 to 39 carbons);

(B)

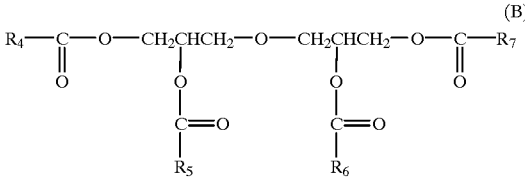

(where $R_4$, $R_5$, $R_6$, and $R_7$ are independently an organic group having from 9 to 39 carbons);

(C)

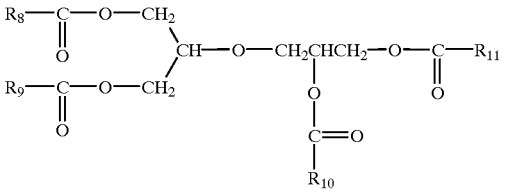

(where $R_8$, $R_9$, $R_{10}$ and $R_{11}$ are independently an organic group having from 9 to 39 carbons);

(D)

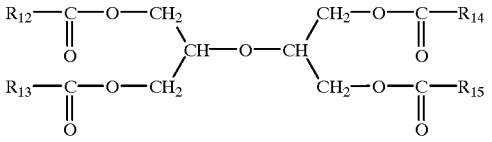

(where $R_{12}$, $R_{13}$, $R_{14}$ and $R_{15}$ are independently an organic group having from 9 to 39 carbons).

DESCRIPTION OF THE PREFERRED EMBODIMENTS

Figure 1:
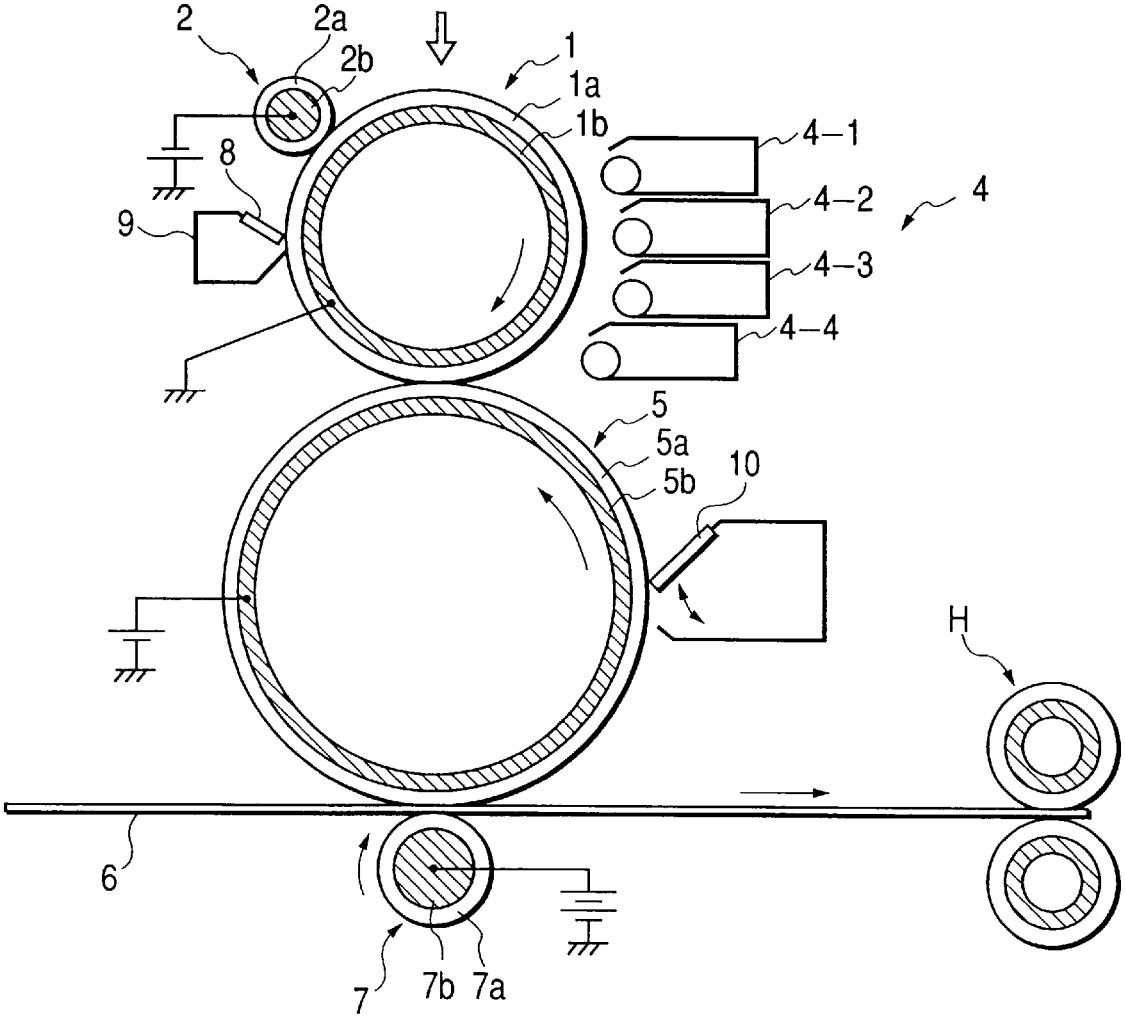
FIG. 1 illustrates schematically an image-forming apparatus for full-color, multi-color, or mono-color image formation, suitable for practicing the present invention.

The toner of the present invention contains a wax in toner particles, the wax containing an ester compound represented by Formula (A), (B), (C), or (D), or a mixture thereof at a content ranging from 50 to 100% by weight based on weight of the wax:

(A)

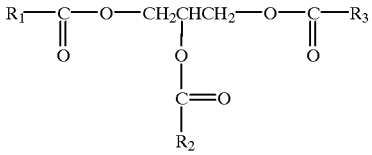

(where $R_1$, $R_2$,and $R_3$ are independently an organic group having from 9 to 39 carbons);

(B)

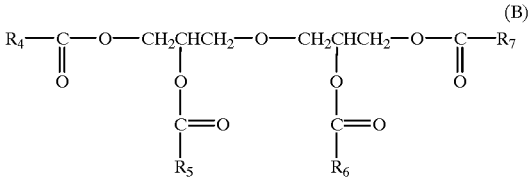

(where $R_4$, $R_5$, $R_6$, and $R_7$ are independently an organic group having from 9 to 39 carbons);

(C)

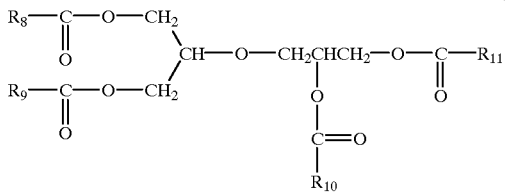

(where $R_8$, $R_9$, $R_{10}$ and $R_{11}$ are independently an organic group having from 9 to 39 carbons);

(D)

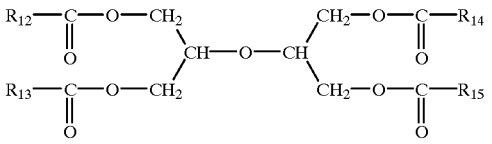

(where $R_{12}$, $R_{13}$, R14 and $R_{15}$ are independently an organic group having from 9 to 39 carbons).

Ester Compound (A) can be produced by reacting glycerin

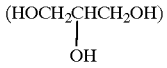

with an acid component or an acid halide component. Ester Compound (A) does not have an OH group coming from the source glycerin.

Ester Compound (B), (C), or (D) can be prepared by reacting the diglycerin represented by Formula (b), (c), or (d) below as the alcohol component:

(b)

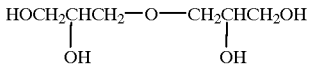

(c)

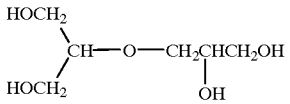

(d)

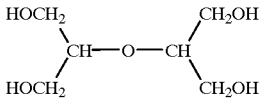

with an acid component or an acid halide component. Ester Compound (B), (C), and (D) do not have an OH group coming from the source diglycerin. Of Ester Compounds (B), (C), and (D), Ester Compound (B) is preferred in view of stability of the ester compound.

Ester Compound (A), (B), (D), or (D), or a mixture thereof is contained in the wax at a content of preferably from 60 to 100% by weight, more preferably from 70 to 100% by weight, still more preferably from 80 to 100% by weight, still more preferably from 90 to 100% by weight for improvement of low-temperature fixability, high-temperature offset resistance, environmental stability, and anti-blocking property of a toner.

The groups $R_1$ to $R_{15}$ are preferably a hydrocarbon group of from 9 to 39 carbons, more preferably an alkyl group of from 9 to 39 carbons or an alkenyl group of from 9 to 39 carbons, still more preferably a straight alkyl group of from 13 to 29 carbons (still more preferably from 15 to 25 carbons).

The groups of $R_1$ to $R_{15}$ of from 19 to 39 carbons imparts suitable strength to the toner particles, and improves greatly the developability of the toner and the matching of the toner with the image-forming apparatus. Such a branched wax component improves dispersion of other constituting component of the toner to improve both the developability and the transferability synergistically.

The carbon number can be measured by instrumental analysis like mass spectroscopy such as GC-MS and FD-MS, and $^{13}$C-NMR. If necessary, the wax is hydrolyzed before the instrumental analysis of the carbon number of the acid component by an autoclave method, an enzyme method, or a Twitchell method.

The wax has preferably a hydroxyl value (OH value) ranging from 0 to 10 mgKOH/g, preferably from 0.1 to 5.0 mgKOH/g.

The wax has preferably an acid value ranging from 0 to 10 mgKOH/g, more preferably from 0 to 5.0 mg HKOH/g.

The partially esterified compound of glycerin or diglycerin existing in the wax increases the hydroxyl value of the wax since the partial esterified compound has free OH groups. A higher content of the partially esterified glycerin or diglycerin in the wax to give a hydroxyl value higher than 10 mgKOH/g lowers environmental stability of the toner, plasticizes the toner excessively to cause soiling of the carrier or the development sleeve, and impairs anti-blocking property.

The unreacted carboxylic acid existing in the wax increases acid value of the wax. A higher content of the free carboxylic acid in the wax to give an acid value of wax of higher than 10 mgKOH/g lowers triboelectric chargeability, fluidity of the toner at high temperature and high humidity, resolution capability, and the dot image reproducibility.

The hydroxyl value of the wax is controlled to be in the range preferably from 0.1 to 5.0 mgKOH/g, and the acid value of the wax is controlled to be in the range preferably from 0 to 5.0 mgKOH/g by controlling the amount of the remaining partially esterified glycerin or diglycerin and by decreasing the amount of the remaining free carboxylic acid.

The hydroxyl value of the wax is measured as below. The wax of the measurement sample is weighed precisely in a 100-mL volumetric flask. Thereto 50 mL of xylene is added, and the wax is dissolved at 120° C. in an oil bath. Separately, 50 mL of xylene is placed in another volumetric flask, and is treated in the same manner as the blank test.

After dissolution of the wax, 5 mL of a mixed solvent of acetic anhydride/pyridine (¼) is added thereto. The mixture is heated for 3 hours or more. Then the temperature of the oil bath is controlled at 80° C. A small amount of distilled water is added thereto. The mixture is kept at that temperature for 2 hours. The flash is cooled and the wall of the flask is washed with a small amount of an organic solvent. The mixture is titrated by potentiometry with 0.5N-KOH/methanol titrant by use of a phenolphthalein indicator. The OH value is calculated according to the equation below:

$$\text{Hydroxyl value}=28.05\times fx(T_b-T_s)/S+A$$

where S is the quantity of the sample (g), $T_s$ is the titrant volume for the sample (mL), $T_b$ is the titrant for the blank (mL), f is the factor of the titrant, and A is the acid value of the sample.

The acid value (A) of the measurement sample is derived according to JIS K1557-1970. Specifically, a weighed sample is dissolved in a mixed solvent, then water is added thereto, and the solution is titrated by potentiometry with 0.1N-NaOH by use of a glass electrode to obtain the acid value.

The process for producing Ester Compound (A), (B), (C), or (D) includes synthesis by oxidation reaction, synthesis from a higher fatty acid or its derivative, and synthesis by introduction of ester groups by such as Michael addition. Particularly preferred processes for the ester compound are the dehydration-condensation reaction of a higher fatty acid with glycerin and/or diglycerin (Reaction Formula 1), and the reaction of a higher fatty acid halide with glycerin and/or diglycerin (Reaction Formula 2) in view of less limitation and ease of the reaction.

$$nR_a\text{—}COOH+R_b(OH)_n \leftrightarrows R_b(OCO\text{—}R_a)_n+nH_2O \quad (1)$$

$$nR_a\text{—}COCl+R_b(OH)_n \leftrightarrows R_b(OCO\text{-}R_a)_n+nHCl \quad (2)$$

In order to shift the above esterification equilibrium to the product, the above reaction (1) is conducted with a large excess of the alcohol component, or in an aromatic organic solvent capable of forming an azeotrope with water by use of a Dean-Stark water separator. The above ester synthesis reaction (2) from the acid halide may be conducted by addition of a base as an acceptor for the by-product acid in an aromatic organic solvent.

In any production process, the hydroxyl value of the wax is preferably adjusted in the range from 0 to 10 mgKOH/g.

Into the wax, an antioxidant may be incorporated in such an amount that the toner chargeableness is not affected.

The wax is preferably in a solid state at room temperature (25° C.), and has a main endothermic peak in the temperature range preferably from 30 to 120° C., more preferably from 50 to 100° C., still more preferably from 55 to 80° C. in the DSC endothermic curve obtained by differential thermal analysis apparatus in view of improvement in low-temperature fixability, high-temperature offset resistance, and anti-blocking property.

The DSC endothermic curve is obtained by use of a differential scanning calorimeter (DSC measurement apparatus, for example, DSC-7 manufactured by Perkin Elmer Co.) according to ASTM D3418-82. The sample is weighed precisely in an amount ranging from 2 to 10 mg. The weighed sample is placed in an aluminum pan. Another empty aluminum pan is used as the reference pan. The measurement is conducted at an ordinary temperature and an ordinary humidity at a measurement temperature range from 30 to 160° C. at a temperature elevation rate of 10° C./min.

The wax is preferably contained in an amount ranging preferably from 1 to 30 parts by weight, more preferably from 2 to 25 parts by weight based on 100 parts by weight of the binder resin in view of improvement of the low-temperature fixability and the high-temperature offset resistance. With the amount of the wax of less the 1 part by weight, the effect of addition of the wax is lower, whereas with the amount of the wax of more than 30 parts by weight, the anti-blocking property and the durability are lower in repeated use of the tone.

The wax is preferably dispersed in the binder resin in an incompatible state of spherical and/or spindle-shaped islands. The disperesed state can be confirmed by observation of the toner particle cross-section with transmission electron microscope (TEM). The wax dispersed or enclosed in the toner particles as mentioned above prevents deterioration of the toner and soiling of the image-forming apparatus, keeps the satisfactory chargeableness of the toner, and enables formation of high-quality image with high dot-reproducibility for a long term. Further, the wax in the toner particles improves the low-temperature fixability and the offset resistance because the wax in the toner particles acts efficiently in a heated and pressed state.

Figure 11A:
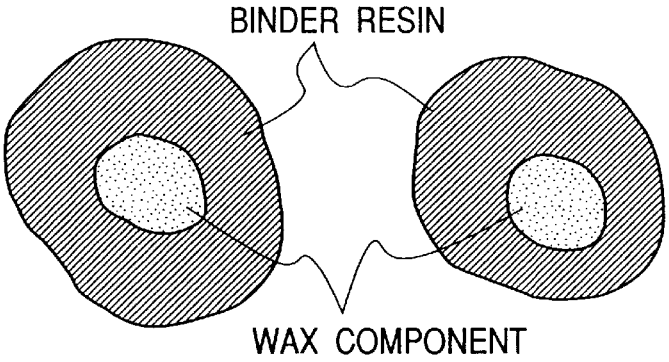
FIGS. 11A and 11B are schematic sectional views of a toner particle enclosing a wax component.
Figure 11B:
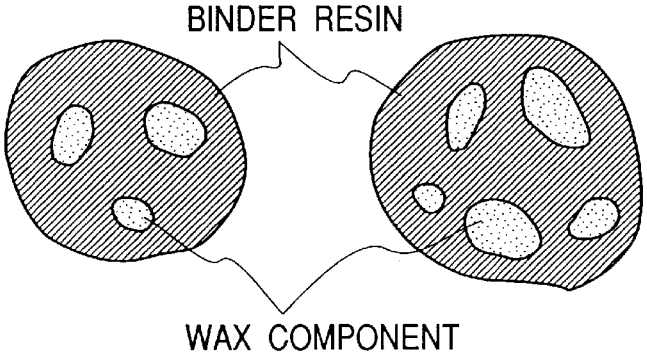
Figure 12:
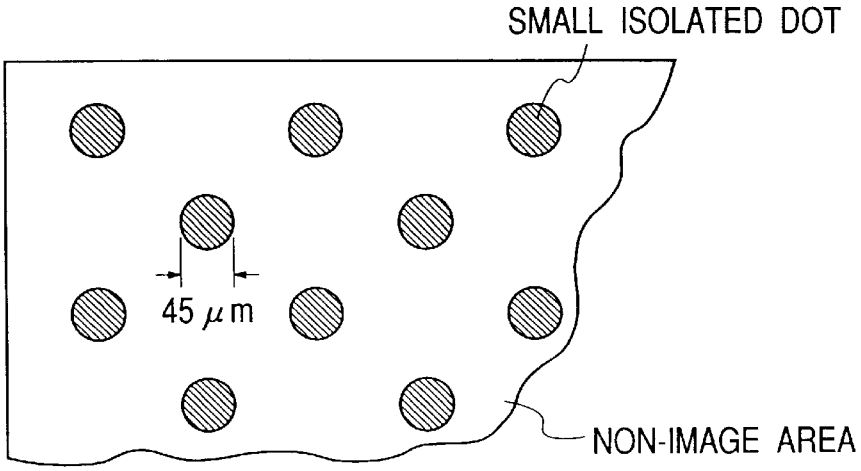
FIG. 12 is a drawing for explaining an isolated dot pattern for checking toner development characteristics.

The cross-section of the toner particles can be observed in the manner as follows. The toner particles are dispersed well in a cold-setting epoxy resin, and the toner is cured at 40° C. for 2 days. The cured product is dyed with triruthenium tetraoxide, and if necessary, combinedly with triosmium tetraoxide. From the dyed particle, a thin flake-shaped sample is cut out with a microtome having diamond teeth. The cross-section of the toner sample is observed by transmission electron microscopy (TEM). In the present invention, triruthenium tetraoxide is preferably used for contrasting the wax against the shell-constituting resin by utilizing the slight difference in crystallinity. FIGS. 11A and 11B show typical examples of the sectional view. The toner particles produced in Examples have the wax in a state of a core particles enclosed by the shell resin.

The toner in the present invention has preferably a shape factor SF-1 ranging from 100 to 160, more preferably from 100 to 140, and a shape factor SF-2 ranging preferably from 100 to 140, more preferably from 100 to 120. With the above shape factors and the (SF-2)/(SF-1) ratio of not higher than 1.0, not only toner properties but also matching of the toner with the image-forming apparatus will be excellent.

The shape factors SF-1 and SF-2 are measured by means of FE-SEM (S-800, manufactured by Hitachi, Ltd.) as follows. 100 Toner particles magnified by a factor of 500 are selected as samples at random. The image information is introduced through an interface to an image analysis apparatus (e.g., Luzex III, manufactured by Nicole Co.), and analyzed. The shape factor SF-1 is derived from the equations below:

$$SF\text{-}1\ [(MXLNG)^2/(AREA)]\times(\pi/4)\times 100$$

where MXLNG is an absolute largest length, and AREA is a projection area of a toner.

The shape factor SF-2 is derived from the equation below:

$$SF\text{-}2=[(PERI)^2/(AREA)]\times(1/4\pi)\times 100$$

where PERI is a periphery length, and AREA is a projection area of a toner.

The toner shape factor SF-1 is an index for the sphericity of the toner particles. The shape factor SF-2 is an index for the surface roughness of the toner particles.

With a lower shape factor SF-1 or SF-2 of the toner, cleaning of the toner tends to be incomplete, or an external additive on the toner surface tends to be embedded in the toner surface during repeated use of the toner, resulting in deterioration of the image quality. However, in the present invention, such disadvantages can be prevented by controlling the polarity and the chain branching of the wax to give appropriated strength to the toner particles. On the other hand, with an SF-1 higher than 160, the shape of the toner becomes more irregular to broaden distribution of triboelectric charging in the toner and to facilitate wearing-out of the toner surface, which will cause drop of the image density or fogging of the formed image. Further, when an intermediate transfer member is employed, the transfer efficiency of the toner image from an electrostatic image holding member to an intermediate transfer member will drop, and the transfer efficiency of the toner image from the intermediate transfer member to the transfer medium will drop also.

To improve the toner image transfer efficiency, the toner particle shape factor SF-2 ranges preferably from 100 to 140, and the (SF-1)/(SF-2) ratio is preferably not larger than 1.0. With the SF-2 value higher than 140 and the (SF-1)/(SF-2) ratio higher than 1.0, the surface of the toner particle is not smooth, having many projections and recesses, so that the toner image transfer efficiencies from the electrostatic image holding member to the intermediate transfer member and from it to the transfer medium tend to be lower.

In particular, the above tendency is remarkable with a full-color copying machine which develops plural toner images and transfer them. Specifically, in formation of four images of respective colors, the four color images tend to be not uniformly transferred and, when an intermediate transfer member is employed, the color tends to be nonuniform and the color balance tends to be insufficient, which makes difficult the stable output of full-color images with high image quality.

Further more, with a toner having SF-1 of more than 160, slipping between a photosensitive member and a cleaning member, between an intermediate transfer member and a cleaning member, and/or between the photosensitive member and the intermediate transfer member causes fusion-bonding or filming of the toner on the photosensitive member surface or on the intermediate transfer member surface, disadvantageously.

In the case where an intermediate transfer member is employed for application of the toner to various kinds of transfer medium, the drop of the transfer efficiency brings about drop of toner utilization efficiency undesirably since the transfer is conducted twice for each color. In a digital full-color copying machine or printer, an original full-color image is separated preliminarily into colors by use of a B (blue) filter, a G (green) filter, and an R (red) filter, and latent images are formed with dots of a size of 20 to 70 μm on the photosensitive member. Therefrom, the original image is reproduced precisely as a multi-color image by utilizing elementary color mixing action with a Y (yellow) toner, an M (magenta) toner, C (cyan) toner, and a B (black) toner. In this reproduction process, the Y toner, the M toner, the C toner, and the B toner are deposited in large amount onto the photosensitive member and the intermediate transfer member corresponding to the color information from the original or CRT. Therefore, the respective toners are required to have sufficiently high transferability. Therefore, the respective toners preferably satisfy the above conditions of SF-1 and SF-2.

For precise development of fine dots of the latent image, the toner particles have a weight-average diameter ranging preferably from 3 to 10 μm, more preferably from 4 to 9.9 μm, and the variation coefficient (A) in particle diameter number distribution is preferably not more than 35%, more preferably in the range from 5 to 34%, still more preferably from 5 to 30%. A toner having a weight-average particle diameter of less than 3 μm is less efficient in transfer to remain in a larger amount on the photosensitive member and the intermediate transfer member, and tends to cause non-uniformity of the image caused by fogging, or incomplete image transfer, being not suitable for use in the present invention. A toner having a weight-average particle diameter of more than 10 μm is liable to be fusion-bonded to the photosensitive member surface, the intermediate transfer member, and the like. The above tendencies are more remarkable with a toner particle having the variation coefficient of 35% or more in toner particle diameter number distribution.

The particle size distribution of toner particles can be measured by various methods. In the present invention, a Coulter counter is used. For example, a Coulter Counter TA-II or Coulter Multisizer (manufactured by Coulter Co.) as the measurement apparatus, and thereto an interface (manufactured by Nikkaki K.K.) and a personal computer are connected. The electrolyte solution is an aqueous NaCl solution of concentration of about 1% prepared from first reagent grade sodium chloride: for example, ISOTON II (produced by Coulter Scientific Japan Co.) is useful as the electrolyte solution. In the measurement, into 100 mL to 150 mL of the aqueous electrolyte solution, are added 0.1 to 5 mL of a surfactant (preferably an alkylbenzenesulfonate salt), and 2 to 20 mg of measurement sample. The sample suspended in the electrolyte solution is treated by a supersonic dispersing machine for further dispersion for about 1 to 3 minutes. The particle size distribution is measured by the above-mentioned Coulter Counter TA-II with an aperture, for example, of 100 μm. Thereby, particle size distribution ranging from 2 to 40 μm is measured based on particle numbers. Therefrom the values for the present invention are derived.

The variation coefficient (A) in the toner particle number distribution is calculated by the equation below:

Variation coefficient (A)=$[S/D_1]\times 100$ where S is the standard deviation of the particle diameter number distribution, and $D_1$ is the number-average particle diameter (μm).

The binder resin for the particulate toner includes styrene-(meth)acrylic copolymers, polyester resins, epoxy resins, and styrene-butadiene copolymers which are generally used. In direct production of toner particles by polymerization, the toner particles are formed directly from a monomer. The preferred monomer includes styrene type monomers such as styrene, o- (m-, or p-)methylstyrene, and m- (p-) ethylstyrene; (meth)acrylate ester monomers such as methyl (meth)acrylate, ethyl (meth)acrylate, propyl (meth)acrylate, butyl (meth)acrylate, octyl (meth)acrylate, dodecyl (meth) acrylate, stearyl (meth)acrylate, behenyl (meth)acrylate, 2-ethylhexyl (meth)acrylate, dimethylaminoethyl (meth) acrylate, and diethylaminoethyl (meth)acrylate; ene type monomers such as butadiene, and isoprene; cyclohexene; (meth)acrylonitrile; and acrylamide. These monomers may be used singly, or in combination of two or more thereof generally to obtain a polymer of theoretical glass transition temperature (Tg) of from 40 to 75° C. as described in a publication: Polymer Handbook 2nd Ed., III, page 139 to 192 (John Wiley & Sons Co.). With the binder of the theoretical glass transition temperature of lower than 40° C., the storage stability and the running stability of the toner are liable to be insufficient, whereas with the binder of the theoretical glass transition temperature of higher than 75° C., the fixation temperature of the toner is higher. With such a toner, for color toners for full-color image formation, color-mixability of the respective toners at the fixation step is lower, giving poor color reproducibility, and transparency of OHP images is lower, disadvantageously.

The molecular weight of the binder resin is measured by gel permeation chromatography (GPC). The GPC measurement of the toner particles of a core-shell structure is conducted as below. The toner is extracted preliminarily with toluene by means of a Soxhlet extractor for 20 hours. Then, the toluene is evaporated by a rotary evaporator to obtain an extract. The extract is washed with an organic solvent (e.g., chloroform) which dissolves the wax but does not dissolve the shell resin. The residue is dissolved in tetrahydrofuran (THF). The solution (THF solution) is filtered through an solvent-resistant membrane filter having a pore diameter of 0.3 μm. The filtered solution is subjected to molecular weight distribution measurement by GPC 150C.

(manufactured by Waters Co.) with connected columns of A-801, 802, 803, 804, 805, 806, and 807 produced by Showa Denko K.K. by use of a calibration curve by a standard polystyrene resin. The resin component of the particulate toner has a main peak molecular weight ranging preferably from 5,000 to 1,000,000, and the ratio (Mw/Mn) of the weight-average molecular weight (Mw) to the number-average molecular weight (Mn) ranging preferably from 2 to 100 in the present invention.

In the present invention, a polar resin is further added in order to enclose the wax in the shell. The polar resin suitable in the present invention includes styrene-(meth)acrylic acid copolymers, styrene-maleic anhydride copolymers, unsaturated polyester resins, saturated polyester resins, and epoxy resins.

The colorant employed in the present invention includes the yellow colorants, the magenta colorants, and the cyan colorants shown below. The black colorant includes carbon black, magnetic substances, and mixtures of a yellow colorant, a magenta colorant, and a cyan colorant for developing the black color.

The yellow colorant typically includes condensed azo compounds, isoindolinone compounds, anthraquinone compounds, azo-metal complexes, methine compounds, and arylamide compounds: specifically C.I. Pigment Yellows 12, 13, 14, 15, 17, 62, 74, 83, 93, 94, 95, 109, 110, 111, 128, 129, 147, 168, 180, and the like.

The magenta colorant includes condensed azo compounds, diketopyrrolopyrrole compounds, anthraquinone compounds, quinacridone compounds, basic dye lake compounds, naphthol compounds, benzimidazolone compounds, thioindigo compounds, and perylene compounds: specifically C.I. Pigment Reds 2, 3, 5, 6, 7, 23, 48:2, 48:3, 48:4, 57:1, 81:1, 144, 146, 166, 169, 177, 184, 185, 202, 206, 220, 221, and 254.

The cyan colorant includes copper phthalocyanine compounds and derivatives thereof, anthraquinone compounds, and basic dye lake compounds: specifically C.I. Pigment Blues 1, 7, 15, 15:1, 15:2, 15:3, 15:4, 60, 62, and 66.

These colorants can be used singly, in a mixture of two or more thereof, or in a solid solution. The colorants are selected in consideration of hue, color saturation, lightness, weatherability, OHP transparency, and dispersibility in toner particles. the colorants are added in an amount ranging preferably from 1 to 20 parts to 100 parts by weight of the resin components.

The magnetic substance as the black colorant is used in an amount ranging from 40 to 150 parts to 100 parts by weight of the resin differently from other colorants.

The toner may contain a charge-controlling agent. Known charge controlling agents are useful. In particular, those are preferred which is capable of charging rapidly, and keeping a constant amount of the charge stably. For the toner particles formed directly by polymerization, the charge-controlling agent are preferred which do not inhibit the polymerization and do not contain a substance soluble in the aqueous dispersion medium. Specifically, the negative type of charge-controlling agent includes metal compounds of an aromatic carboxylic acid such as metal compounds of salicylic acid, naphthoic acid, and dicarboxylic acids; metal salts and metal complexes of azo dyes; metal salts and metal complexes of azo pigments; high-molecular compounds having sulfonic groups or carboxylic groups as the side chains; boron compounds; urea compounds; silicon compounds; and carixarene. The positive type of charge-controlling agent includes quaternary ammonium salts, high-molecular compounds having quaternary ammonium salt groups as the side chains, guanidine compounds, and imidazole compounds. The charge-controlling agent is preferably used in an amount ranging from 0.5 to 10 parts by weight to 100 parts by weight of the binder resin. However, in the present invention, the addition of the charge-controlling agent is not essential. The addition of the charge-controlling agent to the toner particles may be omitted, in the two-component development, by utilizing triboelectric charging with the carrier; and in nonmagnetic one-component blade coating development, by utilizing the triboelectric charging with the blade member or the sleeve member.

The toner can be produced by various processes. In a process, a resin, a wax serving as a releasing agent, a colorant, a charge-controlling agent, and the like are dispersed uniformly by means of a press-kneader, an extruder, or a media dispersion machine; the dispersed mixture is projected mechanically or with a jet gas stream against a target to pulverize the dispersed mixture into the intended toner particles; (if necessary, the toner particles are treated for surface-smoothening or sphering); and the toner particles are classified to sharpen the particle size distribution. In another process, a molten mixture of the toner components is atomized in the air by means of a disk or a multi-fluid nozzle as disclosed in Japanese Patent Publication No. 56-13945. In still another process, a toner is formed directly by suspension polymerization as disclosed in Japanese Patent Publication No. 36-10231, Japanese Patent Application Laid-Open Nos. 59-53856 and 59-61842. In still another process, a toner is directly produced by dispersion polymerization in which the polymerization is conducted in a solvent which dissolves the monomer but does not dissolve the produced polymer. In still another process, toner is produced directly by produced by emulsion polymerization typified by soap-free polymerization in which the polymerization is conducted in the presence of a water-soluble polar polymerization-initiator.

The pulverization method for toner production cannot readily produce the toner of the shape factors SF-1 and SF-2 measured by Luzex within the desired range. The melt spray method produces a toner of broad particle size distribution although the SF-1 value can be adjusted in the range from 100 to 160. The dispersion polymerization method, which produces a polymer of sufficiently sharp particle size distribution, the applicable materials are limited, and use of the organic solvent tends to complicate the production equipment by treatment of the solvent after use, and inflammability of the solvent. The emulsion polymerization such as soap-free polymerization, which is effective for obtaining relatively uniform particle size distribution, is liable to produce a polymer having the used emulsifier or terminal of the polymerization initiator on the polymer surface to impair environmental characteristics.

In the suspension polymerization for producing the toner, the particle size distribution and the particle diameter can be controlled by changing the kind and the amount of the hardly soluble inorganic salt or the dispersant for colloid protection, by selecting mechanical conditions (agitation conditions such as the peripheral speed of the rotor, the pass times, and the shape of the stirring blade; and the shape of the vessel), or by control of the solid matter concentration in the aqueous solution. Otherwise seed polymerization is also useful in which the monomer is adsorbed by the produced polymer and the adsorbed monomer is polymerized by use of the polymerization initiator.

In polymerization for production of the toner particles, the applicable polymerization initiator includes azo type or diazo type initiators such as 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide type initiators such as benzoyl peroxide, methyl ethyl ketone peroxide, diisopropyl peroxycarbonate, cumene hydroperoxide, 2,4-dichlorobenzoyl peroxide, and lauroyl peroxide. The amount of the polymerization initiator depends on the intended polymerization degree, and generally in the range from 0.5 to 20% by weight of the polymerizable monomer. The polymerization initiator is selected depending on the polymerization process, and is used singly or in combination of two or more thereof in consideration of 10-hour half-life temperature.

For control of the polymerization degree, a known crosslinking agent, a chain transfer agent, a polymerization inhibitor may be further used in the polymerization.

In the suspension polymerization with a dispersion stabilizer for toner production, the dispersion stabilizer includes inorganic compounds such as calcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina; and organic compounds such as polyvinyl alcohol, gelatin, methylcellulose, methylhydroxypropylcellulose, ethylcellulose, sodium salt of carboxymethylcellulose, polyacrylic acid and salt thereof, and starch. Such a dispersion stabilizer is dispersed in the aqueous phase in an amount ranging preferably from 0.2 to 20 parts based on 100 parts by weight of the polymerizable monomer.

The inorganic compound as the dispersion stabilizer may be a commercial product itself. However, for a finer toner particle size, the fine particles of the inorganic compound may be formed in the dispersion medium. For example, calcium phosphate may be formed by mixing an aqueous sodium phosphate solution and an aqueous calcium chloride solution under high speed stirring.

For finer dispersion of the dispersion stabilizer, a surfactant may be combinedly used in an amount ranging from 0.001 to 0.1 part by weight. This surfactant promotes the effects of the above dispersion stabilizer. The surfactant includes sodium dodecylbenzenesulfonate, sodium tetradecylsulfate, sodium pentadecylsulfate, sodium octylsulfate, sodium oleate, sodium laurate, potassium stearate, and calcium oleate.

The direct polymerization for toner particle production can be conducted as below. In a polymerizable monomer, are dissolved or dispersed uniformly a wax, a colorant, a charge controller, a polymerization initiator, and other additives by means of a homogenizer or a supersonic dispersing device. This polymerizable monomer composition is dispersed in an aqueous medium containing a dispersion stabilizer by means of a usual stirrer, a homomixer, or a homogenizer. The stirring speed, and the stirring time are adjusted to obtain liquid drops of the monomer composition of the desired size of the toner particles. Thereafter, stirring is conducted less vigorous to maintain the particle state of the monomer composition and to prevent sedimentation of particles thereof. The polymerization temperature is generally not lower than 40° C., preferably in the range of from 50 to 90° C. The polymerization temperature may be raised at the later half period of the polymerization. At the later half of the polymerization reaction, or after the reaction, a part of the aqueous medium may be distilled off to remove the unreacted polymerizable monomer and/or a by-product for the purpose of improving the durability in the image-forming method of the present invention. After the reaction, the produced toner particles are washed, collected by filtration, and dried. In the suspension polymerization, preferably 300 to 3000 parts by weight of water is used for 100 parts by weight of the monomer composition as the dispersion medium.

Preferably to the toner of the present invention, are added externally a powdery lubricating agent such as teflon powder, zinc stearate powder, and polyvinylidene fluoride; an abrasive material such as cerium oxide, silicon carbide, and strontium titanate; a fluidity-improving agent such as silica, titanium oxide, and aluminum oxide; a caking-preventing agent; an electroconductivity-imparting agent such as carbon black, zinc oxide, and tin oxide.

In particular, the prepared fine powdery inorganic material includes fine silica powder, fine titanium oxide powder, and fine aluminum oxide powder. The fine powdery inorganic material is preferably made hydrophobic with a hydrophobicity-imparting agent such as a silane coupling agent, silicone oil, and a mixture thereof.

The external additive is used usually in an amount ranging from 0.1 to 5 parts by weight to 100 parts by weight of the toner particles.

The image-forming method with the toner of the present invention is explained below by reference to drawings.

The apparatus system shown in FIG. 1 has developing devices 4-1, 4-2, 4-3, and 4—4, holding respectively a developer containing a cyan toner, a developer containing a magenta toner, a developer containing a yellow toner, or a developer containing a black toner. The system develops a latent image formed on an electrostatic image holder 1 (such as a photosensitive drum, and photosensitive belt) by a magnetic brush development system or a nonmagnetic one-component toner development system. The respective color toner images are successively formed on the photosensitive drum 1, and are transferred onto an intermediate transfer member.

Figure 2:
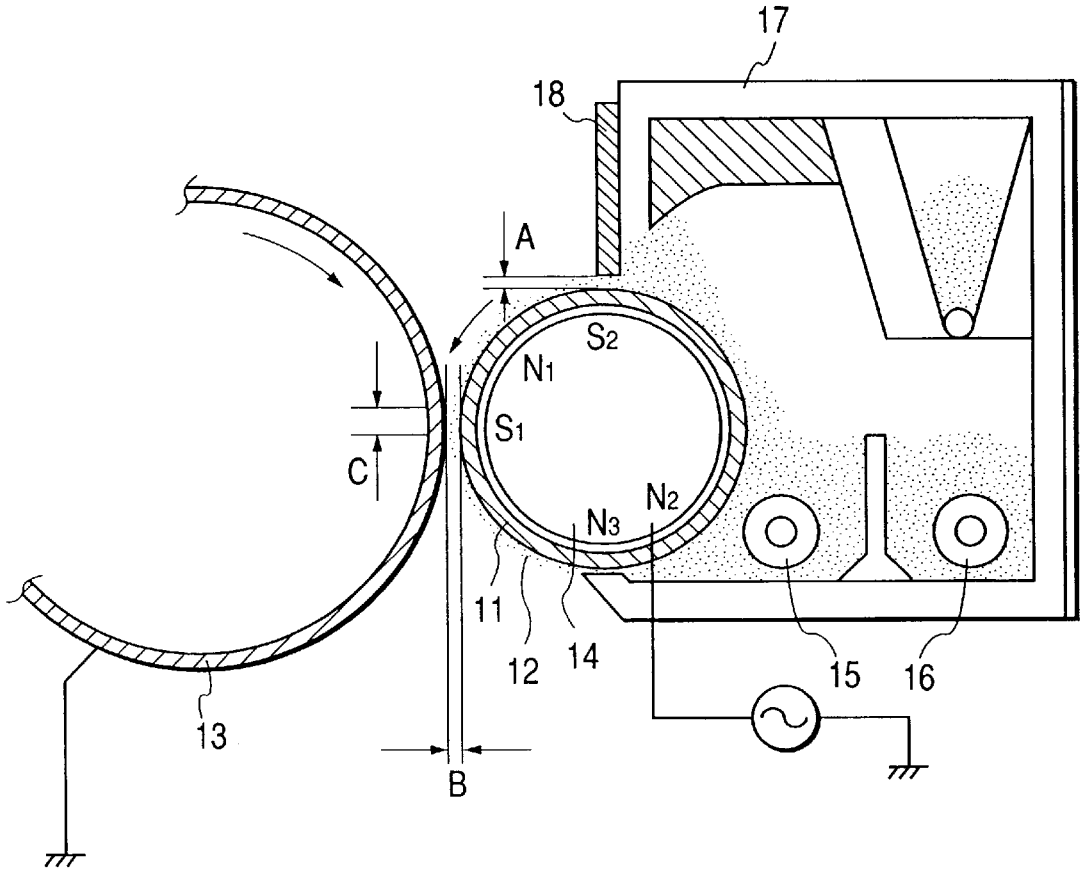
FIG. 2 is an enlarged sectional view of a main portion of the development apparatus for the two-component developing agent, employed in the examples of the present invention.

The toner of the present invention may be mixed with a magnetic carrier, and develops the image, for example, by a developing means shown in FIG. 2. Specifically, the development is preferably conducted by application of an AC electric field with a magnetic brush brought into contact with the photosensitive drum 13. The distance B between the developer holder (developing sleeve) 11 and the photosensitive drum 13 (S-D distance) is preferably in the range from 100 to 1000 $\mu$m in view of prevention of carrier adhesion, and improvement of dot reproducibility. With the distance smaller the 100 $\mu$m, the supply of the developing agent tends to be insufficient to lower the image density, whereas with the distance larger than 1000 $\mu$m, the magnetic lines from the magnet S1 spread to lower the magnetic brush density to lower the dot reproducibility or to weaken the force for confining the carrier, causing carrier adhesion.

The peak-to-peak voltage (Vpp) of the AC electric field ranges preferably from 500 to 5,000 V, and the frequency (f) thereof ranges preferably from 500 to 10,000 Hz, more preferably from 500 to 3,000 Hz. They are appropriately selected for the employed process. The waveform of the AC may be a triangular wave, a rectangular wave, a sine wave, a duty ratio-varying wave, and so forth. At the applied voltage lower than 500 V, the image density tends to be lower, and fogging toner on a non-image portion can be unrecoverable, whereas at the applied voltage higher than 5,000 V, the electrostatic image can be disturbed by the magnetic brush to lower the image quality.

By use of a two-component developing agent containing a well-charged toner, the fog-removal voltage (Vback) can be lowered, which enables lowering of the primary charging of the photosensitive drum to lengthen the life of the photosensitive drum. The voltage (Vback) depends on a development system, and is preferably not higher than 150 V, more preferably not higher than 100 V.

The contrast potential is preferably in the range from 200 to 500 V for a sufficient image density.

At the frequency lower than 500 Hz, charge injection into the carrier can occur to cause carrier adhesion or latent image disturbance, depending on the process speed, to lower the image quality, whereas at the frequency more than 10,000 Hz, the toner cannot follow the electric field, tending to lower the image quality.

In order to conduct development, with sufficient image density and high dot reproducibility without carrier adhesion, the contact width (development nip C) of the magnetic brush on the development sleeve 11 contacting with the photosensitive drum 13 ranges preferably from 3 to 8 mm. With the development nip C less than 3 mm, image density and dot reproducibility are not sufficient, whereas with the development nip C of more than 8 mm, the developing agent may be packed to stop the operation of the machine, or the carrier adhesion cannot readily be prevented. The development nip can be adjusted properly by adjusting the distance A between the development agent controlling member 18 and the development sleeve 11, or by adjusting the distance B between the development sleeve 11 and the photosensitive drum 13.

In output of a full-color image in which half tone is important, three development devices for magenta, cyan, and yellow, or more development devices are employed. For such full-color formation, by use of the toner of the present invention, in particular in combination with a digital latent image development system, latent dot images can be precisely reproduced without influence of the magnetic brush without disturbance of the latent image. In the transfer steps also, by use of the toners of the present invention, the transfer can be conducted at a high transfer efficiency to obtain high-quality images both in halftone print areas and in solid print areas.

Furthermore, not only the high quality of the printed image at the initial stage, but the quality of the printed image can be maintained during copying or printing of many sheets by use of the toner of the present invention.

The toner of the present invention is applicable also in one-component development. An example is shown regarding the apparatus for developing an electrostatic image formed on an electrostatic latent image holder, but is not limited thereto.

Figure 3:
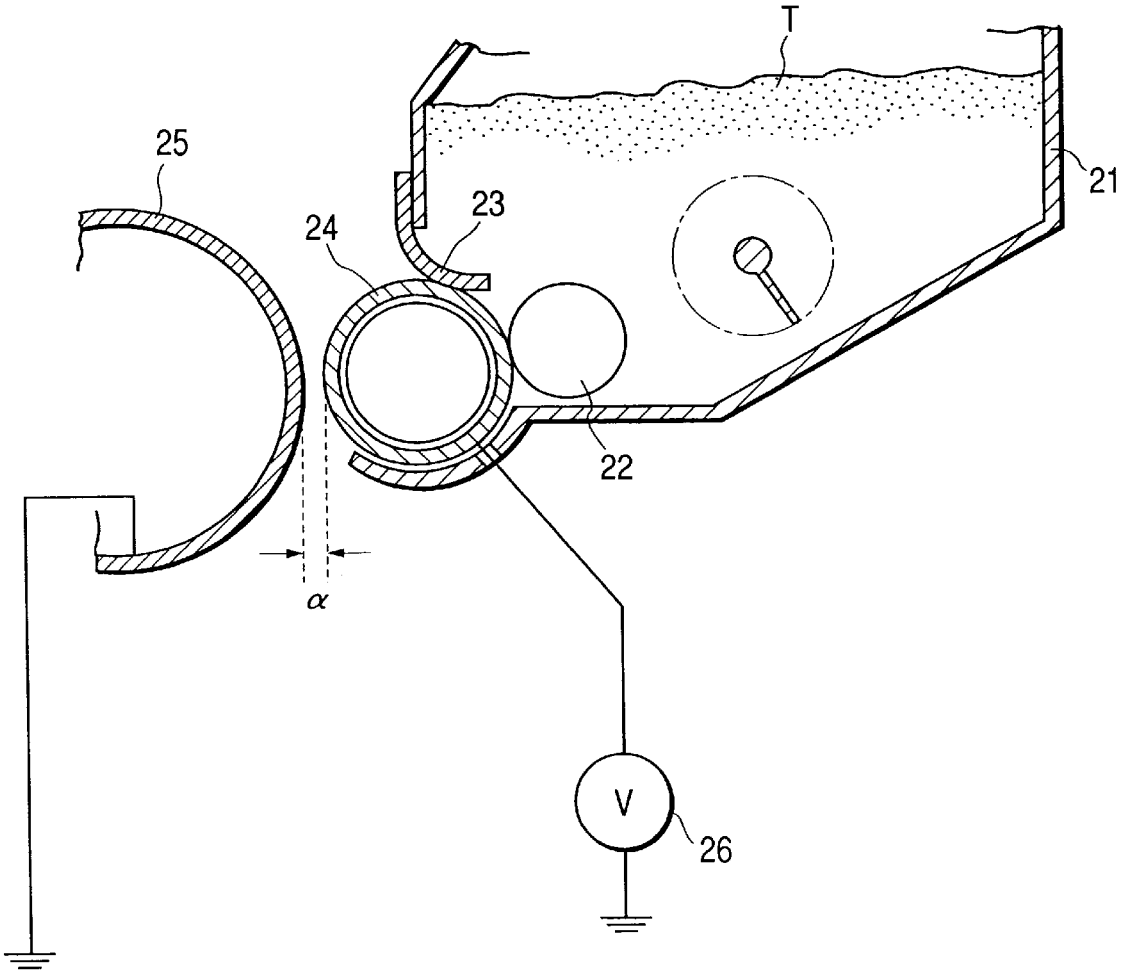
FIG. 3 is an enlarged sectional view of a main portion of the development apparatus for the one-component developing agent, employed in the examples of the present invention.

In FIG. 3, an electrostatic image is formed on an electrostatic image holder 25 (photosensitive drum or photosensitive belt) by an electrophotographic process means or an electrostatic recording means. A toner holder 24 (development sleeve) is a nonmagnetic sleeve made from aluminum or stainless steel. About half of the right side face of the development sleeve 24 is in contact with stored toner in a toner container 21. The toner near the development sleeve face is allowed to adhere to and is held on the sleeve face by a magnetic force developing means provided inside the sleeve and/or an electrostatic force.

The surface roughness Ra ($\mu$m) of the toner holder is adjusted to be not more than 1.5, preferably not more than 1.0, still more preferably not more than 0.5. By adjusting the surface roughness to be not more than 1.5, the toner particle delivery capacity of the toner holder is restricted to make thin the toner layer on the toner holder and to increase the frequency of contact of the toner holder with the toner. Thereby, the chargeableness of the toner is improved, and the image quality is improved correspondingly. With the surface roughness Ra of the toner holder of 1.5 or more, the toner layer on the toner holder cannot readily be made thin, and the chargeableness of the toner cannot improved, so that the image quality cannot be improved.

The surface roughness Ra of the toner holder corresponds to the center-line average roughness measured according to JIS Surface Roughness (JIS B 0601) by a surface roughness tester (Surfcorder SE-30H, manufactured by Kosaka Kenkyusho K.K.). Specifically, a 2.5-mm portion of the roughness curve is taken up in a center line direction as the measurement length (a). Taking the center line as X axis, and the vertical magnification direction as Y axis, and representing the roughness curve as y=f(x), the surface roughness is derived from the equation below with a unit of micron ($\mu$m):

$$Ra = \frac{1}{a}\int_0^a |f(x)|\,dx$$

The toner holder in the present invention is preferably a cylindrical or belt-shaped member made from stainless steel or aluminum. If necessary, the surface of the toner holder may be coated with another kind of metal or a resin, or with a resin composition containing fine particles of a metal, carbon black, charge-controlling agent, or the like dispersed therein.

The surface movement speed of the toner holder is set to be from 1.05 to 3.0 times that of the electrostatic image holder, in the present invention, to agitate appropriately the toner layer on the toner holder to improve more the precision of reproduction of the electrostatic image. At the surface movement speed of the toner holder less than 1.05 times that of the electrostatic image holder, the toner layer is not sufficiently agitated, resulting in a lower quality of the image, or toner supply tends to be insufficient to result in lower image density when a large area of image is formed with a large amount of the toner as formation of a solid image. On the other hand, at the surface movement speed of the toner holder more than 3.0 times that of the electrostatic image holder, excessive charging occurs to cause the problems as above, and the toner is deteriorated by the mechanical stress, or toner adhesion to the toner holder is caused or accelerated undesirably.

The toner T is stored in a hopper 21, and is fed by a feeding member 22 onto the development sleeve. The feeding member is preferably a feed roller constituted of a porous elastomer such as flexible polyurethane foam and a like foamed material. The feed roller is rotated at a surface velocity of not zero relative to the development sleeve in a normal or reverse direction, whereby toner is fed onto the development sleeve and the toner after the development (undeveloped toner) is scraped. The width of contact of the feed roller to the development sleeve ranges preferably from 2.0 to 10.0 mm, more preferably from 4.0 to 6.0 mm in consideration of the feed-scraping balance. In such a type of development, the toner is subjected to excessive stress and tends to result in toner deterioration to increase toner aggregation or to accelerate fusion-bonding of the toner to the development sleeve or the feed roller. However, the toner of the present invention, which is excellent in fluidity, releasability, and running stability, can be used in the development with the above members. As the feeding member, a brush member compose of a resin fiber such as nylon and rayon may be used. Such a feeding member is highly effective in a one-component development employing nonmagnetic one-component toner without magnetic confinement, but is also useful for one-component development employing a magnetic one-component toner.

The toner fed onto the development sleeve is formed into a uniform thin layer by a controlling member. The controlling member for the toner layer thickness is a doctor blade such as a metal blade and a magnetic blade placed with a certain gap from the development sleeve. In place of the doctor blade, a rigid roller or sleeve made from a metal, a resin, a ceramic, or a like material may be used. A magnetic force-generating means may be incorporated therein.

The controlling member for thin toner layer formation may be an elastic member like an elastic blade or an elastic roller for pressure-application of the toner. For example, in FIG. 3, the elastic blade 23 is fixed at its upper end portion to the developing agent container 21, and is brought into pressure contact at the lower tip portion with the development sleeve 24 by the elasticity of the blade in a distorted state at the inside face in a normal fixing direction or at the outside face in a reverse direction. With such a device, a stable and dense toner layer can be formed irrespectively of variation of the environment. Presumably, strong friction between the elastic member and the sleeve surface causes constant electric charging independently of the variation of the toner behavior by variation of environmental conditions. Generally with such a device, the electric charging tends to be excessive to cause fusion-bonding of the toner onto the development sleeve or the elastic blade. However, the toner of the present invention can be used suitably in such a device because of the high releasability and stable triboelectric charging of the toner of the present invention.

The elastic material of the elastic member is selected from the triboelectric series suitably for charging the toner to the desired polarity. The material includes rubber elastomers such as silicone rubbers, urethane rubbers, and NBR; synthetic rubber elastomers such as polyethylene terephthalate; metal elastic materials such as stainless steel, steel, and phosphor bronze; and composites thereof.

For the durability of the elastic member and the toner holder, the elastic member is preferably prepared by bonding or applying a resin or a rubber onto the contact portion of a metal elastic material.

Into the elastomer, an organic material or an inorganic material may be incorporated by mixing, melt-blending, or dispersing. For example, the chargeableness of the toner can be controlled by addition of a metal oxide, a powdery metal, a ceramics, a carbon allotrope, a whisker, an inorganic fiber, a dye, a pigment, or a surfactant. In particular, the elastomer which is a molded article of a rubber or a resin may contain a fine powdery metal oxide such as silica, alumina, titania, tin oxide, zirconium oxide, and zinc oxide; carbon black; or a charge-controlling agent used generally for toners.

Further, an AC electric field and/or a DC electric field may be applied to the development blade as the controlling member, or the feed roller or the brush member as the feeding member to loosen the toner at the thickness controlling portion, or to smoothen the toner feeding and scraping at the feeding portion for more uniform thin layer formation and more uniform charging, whereby image density and the image quality can be further improved.

The pressure of contact of the elastic member to the toner holder, as the linear pressure in the generatrix direction of the toner holder, is generally not less than 0.1 kg/m, preferably in the range from 0.3 to 25 kg/m, more preferably form 0.5 to 12 kg/m. With the contact at this pressure, the toner aggregation can be loosened effectively to enable instantaneous increase of the toner charging quantity. At the contact pressure of lower than 0.1 kg/m, the toner is not uniformly applied, to cause broadening of electric charge distribution to result in fogging or scattering. At the contact pressure higher than 25 kg/m, the tone is pressed excessively to cause toner deterioration or to cause toner aggregation, and a larger torque is required for driving the toner holder undesirably.

The gap $\alpha$ between the electrostatic image holder and the toner holder, in jumping development, is set within the range from 50 to 500 $\mu$m. In the jumping development, the toner layer thickness on the toner holder is preferably less than the gap a between the electrostatic image holder and the toner holder. However, in some case, the toner layer thickness may be controlled such that a part of many ears constituting the toner layer is brought into contact with the electrostatic image holder.

To the toner holder, an AC electric field may be applied by a bias voltage source 26 to facilitate the movement of toner from the toner holder to the electrostatic image holder to improve further the image quality. The Vpp of the AC electric field is not lower than 100 V, preferably ranges from 200 to 3000 V, more preferably from 300 to 2000 V. The frequency f thereof ranges from 500 to 5000 Hz, preferably from 1000 to 3000 Hz, more preferably from 1500 to 3000 Hz. The waveform thereof may be of a rectangular form, a sine wave, a sawtooth form, or a triangle form. The AC bias may be asymmetric AC bias exhibiting different voltages and application times for positive and negative application. A DC bias may be superposed to the AC.

The electrostatic image holder 1 is a photosensitive drum or a photosensitive belt having a layer of a photoconductive insulating substance such as a-Se, CdS, $ZnO_2$, OPC, and a-Si. The electrostatic image holder 1 is rotated in the direction shown by an arrow by a driving device not shown in the drawing. The electrostatic image holder 1 has preferably an amorphous silicon photosensitive layer or an organic photosensitive layer. The organic photosensitive layer may be of a single layer type which contains a charge-generating substance and a charge-transporting substance in one and the same layer, or of a function separation type which has a charge-transporting layer and a charge-generating layer separately. A preferred example is a lamination type photosensitive layer constituted of a charge-generating layer and a charge-transporting layer laminated in this order on an electroconductive substrate.

The binder resin of the organic photosensitive layer includes polycarbonate resins, polyester resins, and acrylic resins. These resins are preferred since they give high transferability and high cleanability, and are less liable to cause cleaning failure, fusion-bonding of the toner onto the photosensitive member, and filming of an external additive.

The electric charging may be conducted by a corona charger without contact with the electrostatic image holder 1, or by a roller in contact with the electrostatic image holder. The contact type charging as shown in FIG. 1 is preferred in view of effective and uniform charging, simplicity of the device, and less ozone generation.

A charging roller 2 is constituted basically of a center core metal 2*b* and an electroconductive elastic layer 2*a* formed around the core metal. The charging roller 2 is brought into press-contact with the face of the electrostatic image holder 1, and driven to rotate by the rotation of the electrostatic image holder 1. The process conditions for the charging roller are as follows: roller contact pressure ranging from 5 to 500 g/cm; AC voltage ranging from 0.5 to 5 kVpp, AC frequency ranging from 50 Hz to 5 kHz, and DC voltage ranging from ±0.2 to ±1.5 kV when DC and AC voltages are applied in superposition; or DC voltage ranging from ±0.2 to ±5 kV when DC voltage only is applied.

The charging means further includes a charging blade, and an electrconductive brush. The contact charging means do not require high-voltage application, and generate ozone less, advantageously.

The material of the charging roller or the charging blade as the contact charging means is preferably an electroconductive rubber, and a releasing film may be provided on the surface of the rubber. The material for the releasing film includes nylon resins, PVDF (polyvinylidene fluoride), and PVDC (polyvinylidene chloride).

The toner image on the electrostatic image holder is transferred onto an intermediate transfer member 5 on which voltage (e.g., ±0.1 to ±5 kV) is applied. The surface of the electrostatic image holder is cleaned by a cleaning means 9 having a cleaning blade 8.

The intermediate transfer member 5 is constituted of an electroconductive metal core 5*b* in a pipe shape, and an elastic layer 5*a* of a medium resistance formed on the peripheral face of the core metal. The core metal 5*b* may be replaced by plastic pipe having been plated with an electroconductive material. The elastic layer 5*a* of the medium resistance is a solid or foamed layer composed of an elastic material such as silicone rubbers, teflon rubbers, chloroprene rubbers, urethane rubbers, and EPDM (ethylene-propylene-diene terpolymer), and an electroconductivity-imparting material such as carbon black, zinc oxide, tin oxide, and silicon carbide dispersed in the elastic material, and having a medium electric resistance (volume resistivity) ranging from $10^5$ to $10^{11}$ Ω·cm.

The intermediate transfer member 5 is placed to have the axis parallel to that of the electrostatic image holder 1 in contact with the bottom face of the electrostatic image holder 1, and is rotated counterclockwise as shown by the arrow mark at the same peripheral speed as the electrostatic image holder 1.

A toner image of a first color formed and held on the face of the electrostatic image holder 1 passes through the transfer nip portion at the contact portion between the electrostatic transfer member 1 and the intermediate transfer member 5, and is transferred, during the passage, successively onto the outer face of the intermediate transfer member 5 by action of the electric field formed at the transfer nip by application of the transfer bias.

After the transfer of the toner image onto a transfer medium, the surface of the intermediate transfer member 5 is cleaned, as necessary, by a detachable cleaning means 10. When a toner image exists on the intermediate transfer member, the cleaning means 10 is detached from the face of the intermediate transfer means not to disturb the toner image.

A transfer means 7 is placed to have the axis parallel to that of the intermediate transfer member 5, and is brought into contact with the bottom face of the intermediate transfer member 5. The transfer means 7 may be a transfer roller, a transfer belt, or the like, and is rotated clockwise as shown by the arrow mark at the same peripheral speed as the intermediate transfer member 5. The transfer means 7 may be placed in direct contact with the intermediate transfer member 5, or a belt or a like material may be placed between the intermediate transfer member 5 and the transfer means 7 to be in contact with them.

The transfer roller is basically constituted of a center core metal 7*b*, and an electroconductive elastic layer 7*a* formed on the periphery of the core metal.

The intermediate transfer member and the transfer roller may made of a usual material. The volume resistivity of the elastic layer of the transfer roller is preferably adjusted lower than that of the elastic layer of the intermediate transfer member to reduce the voltage applied to the transfer roller to form satisfactory toner image on the transfer medium and to prevent winding of the transfer medium around the intermediate transfer member. More preferably, the volume resistivity of the elastic layer of the intermediate transfer member is 10 times or more that of the elastic layer of the transfer roller.

The electroconductive elastic layer 7*b* of the transfer roller 7 is composed, for example, of an elastomer such as polyurethane, ethylene-propylene-diene type terpolymer (EPDM), and an electroconductive material like carbon dispersed therein, having volume resistivity ranging from $10^6$ to $10^{10}$ Ω·cm. A bias is applied to the core metal 7*a* from a constant voltage source under the bias condition of ±0.2 to ±10 kV.

The toner of the present invention is transferred in high efficiency in the transfer step with a less amount of untransferred remaining toner, and is cleaned well after the transfer. Therefore, toner-filming on the electrostatic image holder is less liable to occur. Furthermore, in a running test, high quality of the image can be maintained for a long term since the toner of the present invention causes less embedding of the external additive from the surface into the interior of the toner. Therefore, the toner of the present invention is useful for an image-forming apparatus having a re-use mechanism in which an untransferred toner on the electrostatic image holder or the intermediate transfer member is removed by a cleaning member like a cleaning blade, and the recovered toner is used again.

Figure 5:
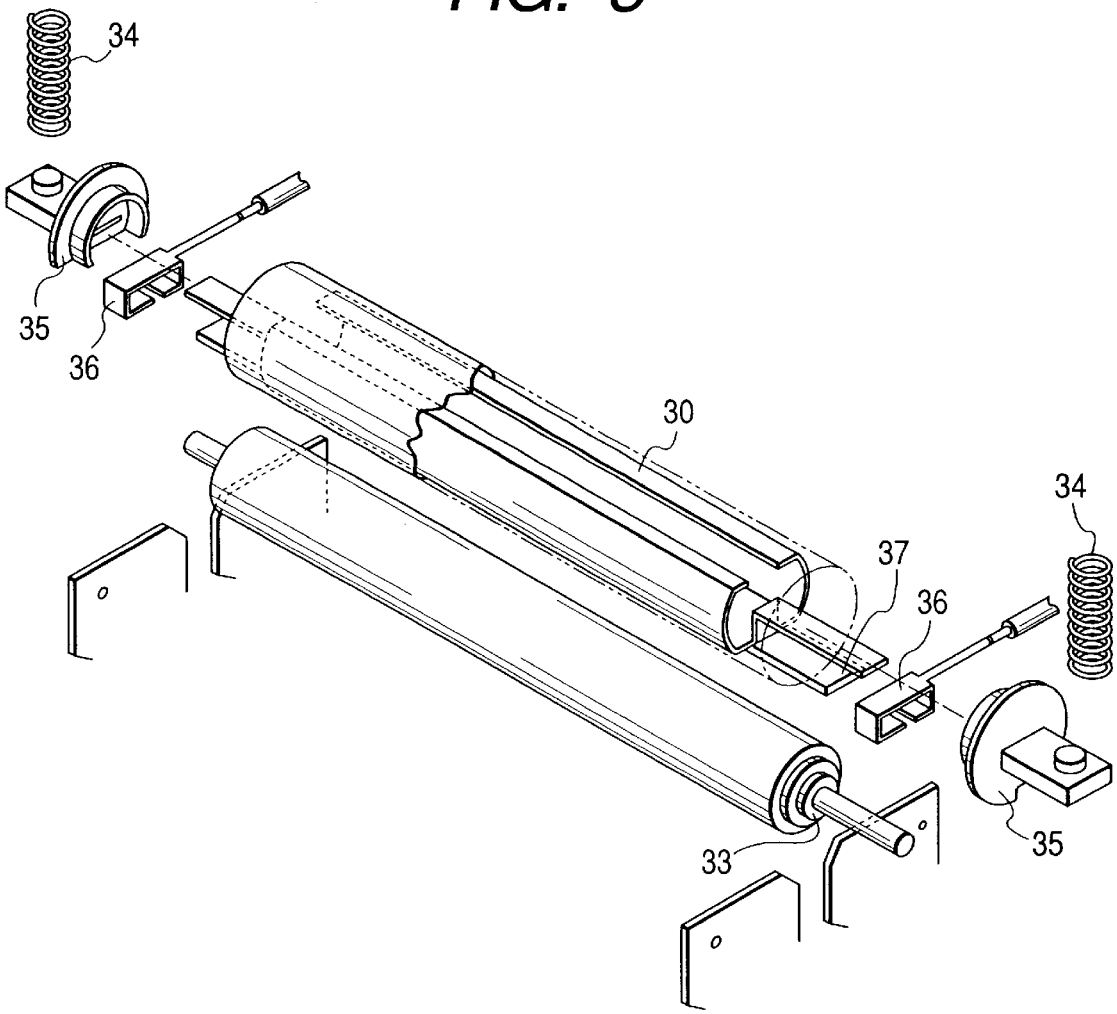
FIG. 5 is an exploded perspective view of the main portion of a fixation device.
Figure 6:
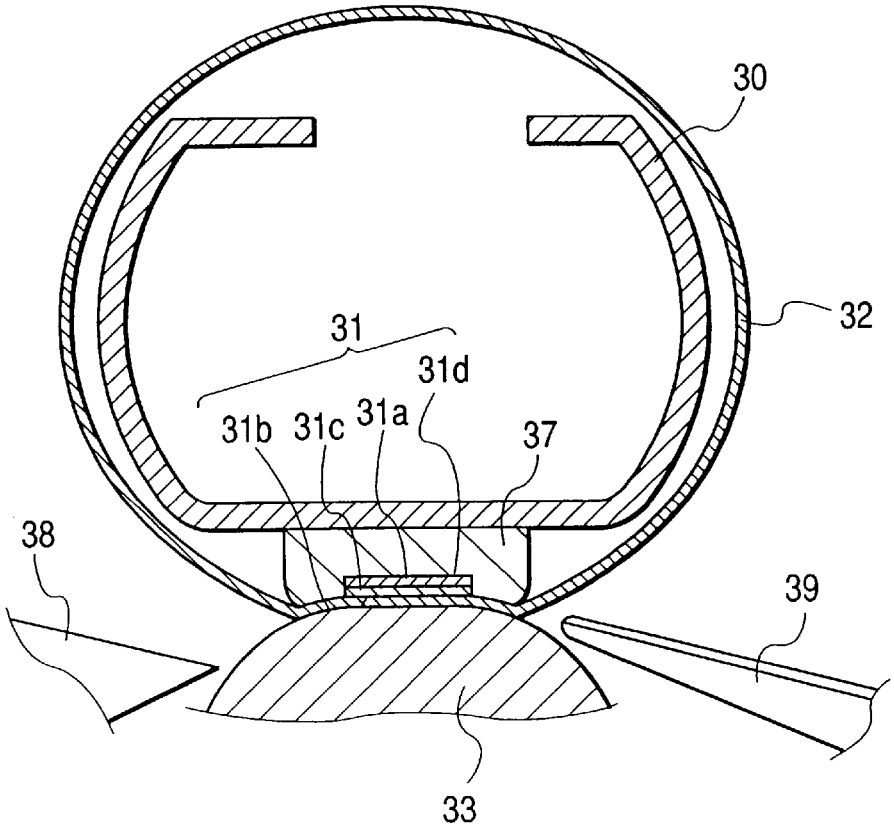
FIG. 6 is an enlarged sectional view showing a state of a film in the fixation device in a non-driven state.

The toner image on the transfer medium 6 is fixed by hot-pressing fixing means. The hot-pressing fixing means includes hot roll type members which is constituted basically of a heating roller having a built-in heater like a halogen heater, and a pressing roller brought into pressure contact with the heating roller; and heat-fixing members which conduct fixation by heating by a heater through a film (FIG. 5 and FIG. 6). The toner of the present invention matches well the above hot pressing fixing means because of the excellent fixability and excellent offset resistance of the toner.

The image forming method of the present invention may be conducted with a one-component developer method in which a toner layer on a toner holder is brought into substantial contact with an electrostatic image holder. The development of the electrostatic image is preferably conducted by reversal development.

In the development step of the image-forming method of the present invention, the toner holder is essentially in contact with the surface of the photosensitive member, and preferably the development is conducted by a reversal development method. By combination with a cleanerless process, the apparatus can be miniaturized significantly. In this process, a DC or AC bias is applied at, before, or after the development to control the potential to enable recovery of remaining toner on the electrostatic image holder (photosensitive member) with the DC component adjusted between the light area potential and the dark area potential.

An elastic roller is employed as the toner holder. In the development, the surface of the elastic roller is coated with a toner, and the coated surface is brought into contact with the surface of the photosensitive member. In this process, the untransferred toner is cleaned simultaneously with the development in a cleaner process by an electric field applied through the toner to the photosensitive member and the elastic roller. Therefore, the elastic roller surface or the vicinity of the surface has preferably a potential to form an electric field at the small gap between the photosensitive member surface and the toner holder surface. For the electric field formation, the elastic rubber of the elastic roller is adjusted to have a medium resistance to prevent electrical conduction, or a thin insulation layer is provided in the surface of the electroconductive roller. Otherwise, on the electroconductive roller, at the side facing to the photosensitive member surface, an electroconductive resin sleeve is provided, or an insulating sleeve is provided at the side not facing to the photosensitive member to form an electroconductive layer. Another constitution may be possible in which a rigid roller is employed as the toner holder, and the photosensitive member is constituted of a flexible material like a belt. The development roller as the toner holder has a resistance ranging preferably from $10^2$ to $10^9$ Ω·cm.

In the contact development, the toner holder has preferably a surface roughness Ra (μm) ranging from 0.2 to 3.0 for simultaneous achievement of high image quality and high durability. The surface roughness Ra relates to the toner delivering capacity and the toner chargeableness. With the toner holder having the surface roughness of larger than 3.0, the toner layer on the toner holder cannot readily be made thin, and the toner chargeableness is not improved. With the toner holding member having the surface roughness of not larger than 3.0, the toner delivering capacity is reduced, the toner layer on the toner holder is made thin, and the frequency of contact of the toner with the toner holder is increased to have the toner chargeableness improved, thereby the image quality being improved. With the toner holding member having the surface roughness Ra of smaller than 0.2, the amount of the toner coating cannot readily be controlled.

In the contact development, the toner holder may be rotated in the same direction as the photosensitive member, or in the reverse direction. In rotation of the same direction, the peripheral speed of the toner holder is set preferably to be from 1.05 to 3.0 times that of the photosensitive member.

In the contact development, the photosensitive member is preferably a photosensitive drum or a photosensitive belt having a layer of a photosensitive insulating substance such as a-Se, CdS, $ZnO_2$, OPC, and a-Si. For an OPC photosensitive member, the binder resin for the organic photosensitive member is preferably selected from polycarbonate resins, polyester resins, acrylic resins in consideration of high transferability, high cleanability, and less liability of toner fusion-bonding to the photosensitive member and of filming of an external additive.

A process of one-component contact development is explained below by reference to the drawings.

Firstly, single color image formation with a cleanerless process is described by reference to FIG. 7.

Figure 7:
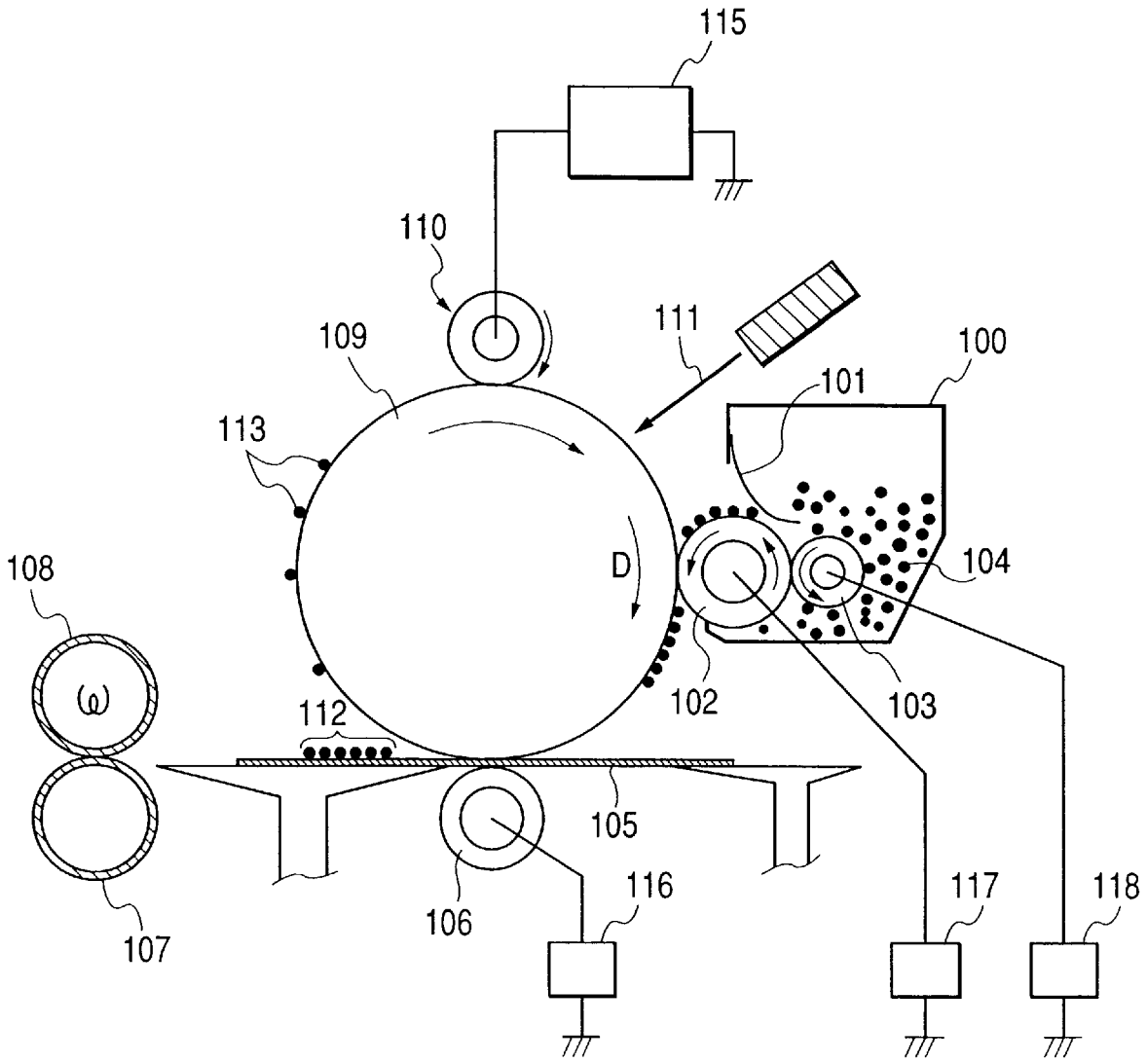
FIG. 7 is a schematic drawing for explaining an image formation process by one-component contact development.

The apparatus in FIG. 7 comprises a development device 100, a photosensitive member 109, a transfer member 106, pressing roller 107 for fixation, a heating roller 108 for fixation, a photosensitive member 109, and a primary charging member 110 for direct charging of the photosensitive member 109 by contact. The numeral 105 denotes a transfer medium. A bias power source 115 is connected to the primary charging member 110 to electrically charge the surface of the photosensitive member 109 uniformly.

The development device 100 stores a toner 104, and is provided with a toner holder 102 which is rotated in contact with the photosensitive member 109 in the arrow direction. The development device has additionally a development blade 101, and an application roller 103 rotating in the arrow direction to apply the toner 104 to the toner holder 102 and to charge electrically the toner. The toner holder 102 is connected to a development bias power source 117. The application roller is connected to a bias power source 118. For use of a negatively chargeable toner, the bias voltage is set to be more negative than the development bias, and for use of a positively chargeable toner, the bias voltage is set to be more positive than the development bias. The transfer member 106 is connected to a transfer bias voltage source 116 which applies a bias voltage of polarity opposite to the photosensitive member 109. The length of the contact portion between the photosensitive member in the rotation direction, namely the nip width ranges preferably from 0.2 to 8.0 mm. With the nip width of less than 0.2 mm, the amount of the development is insufficient, not giving sufficient image density, and lowering the ability of recovery of the untransferred toner. With the nip width of more than 8.0 mm, the toner feed is excessive, tending to cause more fogging of formed image, and abrasion of the photosensitive member.

The toner holder is preferably an elastic roller having an elastic layer on the surface. The material for the elastic layer has a hardness ranging preferably from 20° to 65° (JIS A). The toner holder has a volume resistivity preferably ranging from about $10^2$ to about $10^9$ Ω·m. The toner holder having a volume resistivity lower than $10^2$ Ω·cm is liable to cause an over-current, for example at a pinhole on the surface of the photosensitive member 209. On the other hand, the toner holder having a volume resistivity higher than $10^9$ Ω·cm tends to cause charge-up of the toner by frictional charging to result in low image density.

The amount of the toner coating on the toner holder ranges preferably from 0.1 to 1.5 mg/cm$^2$. With the toner coating of less than 0.1 mg/cm$^2$, the obtained image density is not sufficient, whereas with the toner coating of more than 1.5 mg/cm$^2$, the entire toner particles cannot uniformly be charged, and tends to cause fogging. More preferably, the amount of the toner coating ranges from 0.2 to 0.9 mg/cm$^2$. The amount of the toner coating is controlled by the development blade 101 which is in contact through the toner layer with the toner holder 102. The contact pressure of this contact ranges preferably from 5 to 50 g/cm. At the contact pressure lower than 5 g/cm, the amount of the toner coating cannot be controlled as desired, and frictional charging cannot be uniform to tend to increase the fogging of the image. At the contact pressure higher than 50 g/cm, the toner particles are subjected to excessive load and tend to be deformed, or the toner particles are liable to be fusion-bonded to the development blade or the toner holder. The control of the amount of the toner coating may be conducted by a metal blade or a roller instead of the elastic roller for application of the toner with pressure.

The elastic member for the control of the toner coating is made of a material selected from materials in the triboelectric series suitably for charging the toner to the desired polarity. The material includes rubber elastomers such as silicone rubbers, urethane rubbers, and NBR; synthetic rubber elastomers such as polyethylene terephthalate; metal elastic materials such as stainless steel, steel, and phosphor bronze; and composites thereof.

For the durability of the elastic control member and the toner holder, the elastic material is preferably prepared by bonding or applying a resin or a rubber onto contact portion of a metal elastic material.

Into the elastic control member, an organic material or an inorganic material may be incorporated by mixing, melt-blending, or dispersing. For example, the chargeableness of the toner can be controlled by addition of a metal oxide, a powdery metal, a ceramics, a carbon allotrope, a whisker, an inorganic fiber, a dye, a pigment, or a surfactant. In particular, the elastomer, when it is a molded article of a rubber or a resin, may contain a fine powdery metal oxide such as silica, alumina, titania, tin oxide, zirconium oxide, and zinc oxide; carbon black; or a charge-controlling agent used generally for toners.

Further, an AC electric field and/or an DC electric field may be applied to the controlling member for loosening of the toner, and for more uniform thin layer formation and more uniform charging, whereby image density and the image quality can be further improved.

In FIG. 7, the primary charging member 110 charges electrically uniformly the photosensitive member 109 rotating in a direction shown by the arrow. The primary charging member is a charging roller constituted basically of a central core metal 110*b*, and an electroconductive elastic layer 110*a* formed on the periphery of the central core metal. The charging roller 110 is brought into contact by pressure with the face of the electrostatic image holder, and is driven by the rotation of the electrostatic image holder 1.

The process conditions for the charging roller are as follows. The roller contact pressure ranges from 5 to 500 g/cm. The applied voltage may be DC voltage, or superposition of AC voltage and DC voltage without special limitation. However, simple DC voltage application is preferred in the present invention, the voltage ranging from 0.2 to 5 kV.

The charging means further includes a charging blade, and an electrconductive brush. The contact charging means do not require high-voltage application, and generate less ozone, in comparison with non-contact corona charging, advantageously. The material of the charging roller or the charging blade as the contact charging means is preferably an electroconductive rubber, and a releasing film may be provided on the surface of the rubber. The material for the releasing film includes nylon resins, PVDF (polyvinylidene fluoride), and PVDC (polyvinylidene chloride).

After the primary charging process, an electrostatic image is formed by light projection 111 from a light-emitting element onto the photosensitive member 109 in correspondence with the information signal. The electrostatic image is visualized by development with the toner at the position of contact with the toner holder 102. By employing digital latent image formation system, the latent dot image can be precisely developed without image disturbance. The visualized image is transferred by the transfer member 106 onto the transfer medium 105. The transferred toner 112 is allowed to pass together with the transfer medium 105 between the heating roller 108 and the press roller 107 to be fixed to form a permanent image. The hot-pressing fixing means in this embodiment is of a hot roller type, basically constituted of a heating roller having a built-in heater like a halogen heater and a pressing roller brought into pressure contact with it. In another type system, heat-fixation is conducted by heating through a film by means of a heater.

The untransferred toner 113 remaining on the photosensitive member 109 is allowed to pass between the photosensitive member 109 and the primary charging member 110 to reach again the development nip portion, and is recovered by the toner holder into the developing device 100.

Figure 8:
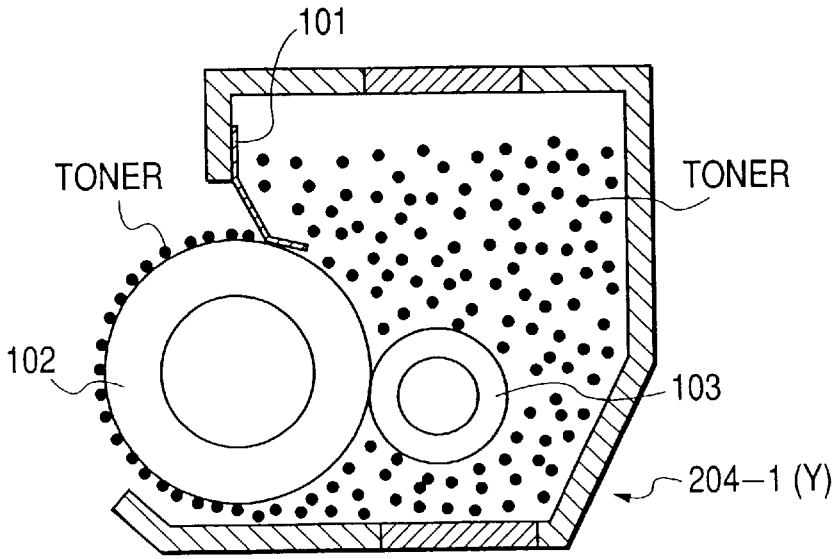
FIG. 8 is a schematic drawing for explaining a development device unit for practicing a one-component contact developing method.

An image-forming method for forming a full-color image, a multi-color image, or a mono-color image is explained by reference to FIG. 9. This method utilizes the development unit devices as shown in FIG. 8 as a yellow development device, a magenta development device, a cyan development device, and a black development device.

Figure 9:
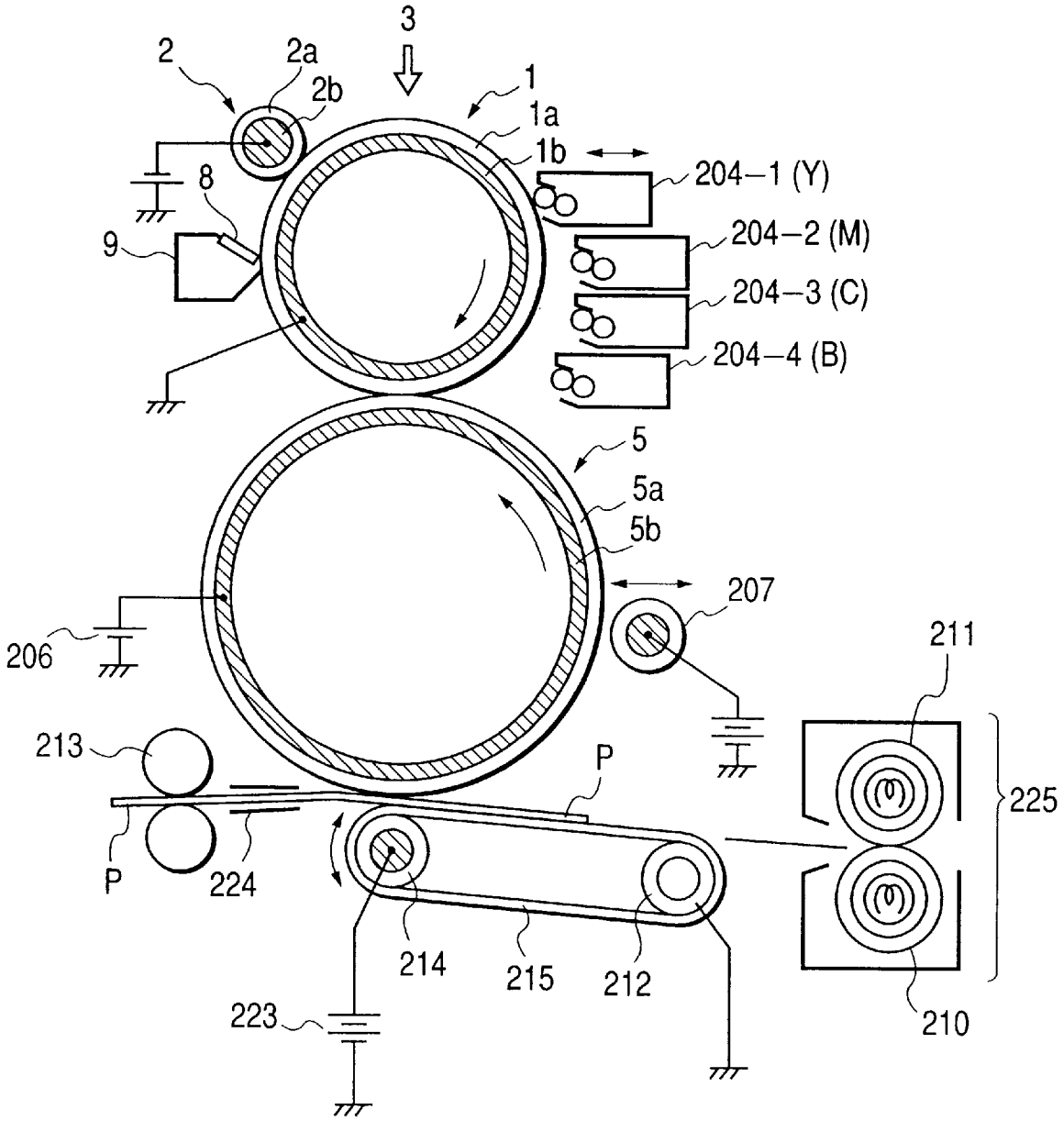
FIG. 9 is a schematic drawing for explaining an image-forming method of the present invention for forming a full-color, multi-color, or mono-color image.

In FIG. 9, the same numerals are used as in FIG. 1 for indicating respectively the corresponding members or devices.

An yellow development device 204-1 containing a yellow toner is allowed to slide to bring a yellow toner on a toner holder 102 into contact with an electrostatic image holder (photosensitive drum) 1. Thereby the electrostatic image is developed into a yellow toner image on the photosensitive drum 1. The yellow toner image on the photosensitive drum 1 is then transferred onto an intermediate transfer member 5. After the development, the yellow development device 204-1 is allowed to slide apart from the photosensitive drum 1. In turn, a magenta development device 204-2 is allowed to slide to bring a magenta toner on a toner holder 102 into contact with the photosensitive drum 1. Thereby the electrostatic image is developed into a magenta toner image on the photosensitive drum 1. The magenta toner image on the photosensitive drum 1 is then transferred onto the intermediate transfer member 5. In the same manner, development is conducted by a cyan development device 204-3, and a black development device 204-4.

The order of development with the yellow toner, the magenta toner, the cyan toner, and the black toner may be changed, as necessary.

In the image-forming method illustrated in FIG. 9, a transfer belt 215 is employed as the second transfer means. The transfer belt 215 is placed to have the rotation axis parallel to that of the intermediate transfer member 5 in contact with the bottom face of the intermediate transfer member. The transfer roller is supported by a bias roller 214 and a tension roller 212. To the bias roller 214, a necessary secondary transfer bias is applied, and the tension roller 212 is grounded.

The primary transfer bias for successive transfer in superposition of the first to fourth toner images is applied from a bias voltage source 206 with the polarity (+) opposite to that of the toner. In the successive transfer of the first to the fourth colors from the photosensitive drum 1 to the intermediate transfer member 5, the transfer belt 215 and an intermediate transfer member-cleaning roller 207 are separable from the intermediate transfer member.

The transfer of the color toner image having transferred in superposition on the intermediate transfer member 5 is transferred onto a transfer medium P as described below. The transfer belt 215 is brought into contact with the intermediate transfer member 5. Thereto, the transfer medium P is fed from a paper cassette (not shown in the drawing) through a registration roller 213 and a pre-transfer guide 224 to the contact nip between the intermediate transfer member 5 and the transfer belt 215. Simultaneously a bias voltage is applied to the bias roller 214 from a secondary transfer bias voltage source 223. By this secondary transfer bias, the color toner image is transferred from the intermediate transfer member 5 to the transfer medium P. This process is hereinafter referred to as secondary transfer.

The transfer medium having received the toner image is introduced to a hot-pressing fixation device 225 having a hot roller 211 and a pressing roller 210, and is fixed by oilless heating.

Figure 10:
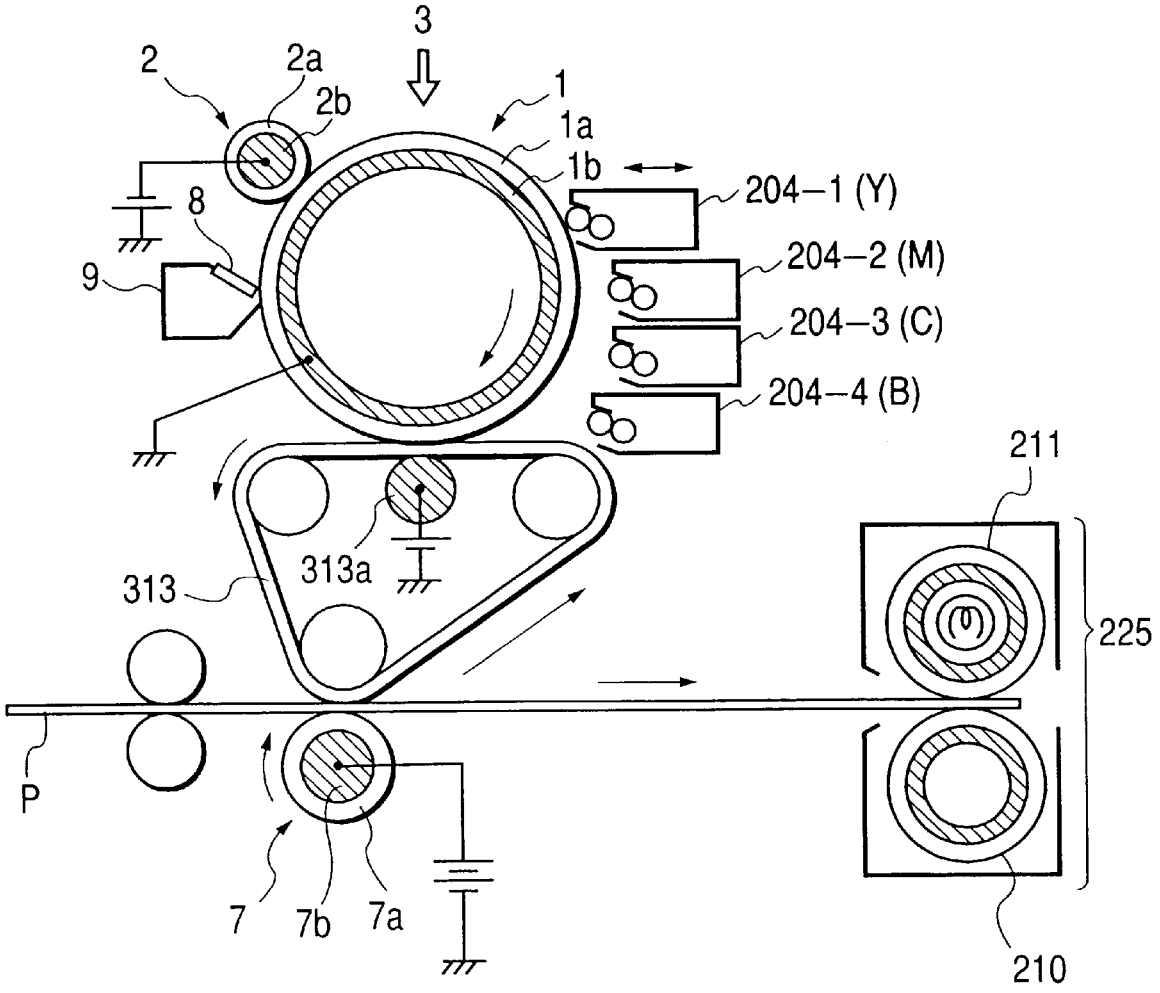
FIG. 10 is a schematic drawing for explaining an image-forming method of the present invention for forming a full-color, multi-color, or mono-color image.

FIG. 10 illustrates another multi-color, full-color, or mono-color image-forming apparatus. The apparatus shown in FIG. 10 employs a belt-shaped intermediate transfer member having a belt 313, and a bias means 313*a*. The fixed solid image formed with the black toner, and respective color toners has a gross value of from 5 to 30 (preferably from 10 to 25), and the differences of the gross values are preferably not more than 5.

The electrostatic image holder 1 in the present invention has a surface of a contact angle to water of not less than 85°, preferably not less than 90°. With the surface of a water contact angle of 85° or more, the transfer ratio of the toner image is higher, and the toner is less liable to cause filming.

The examples of the ester compound in the ester wax used in Examples and Comparative Examples are shown below.

Ester Compound No.1

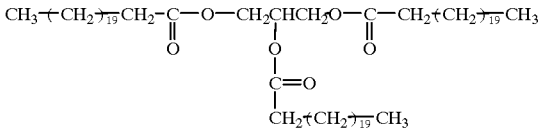

Ester Compound No.2

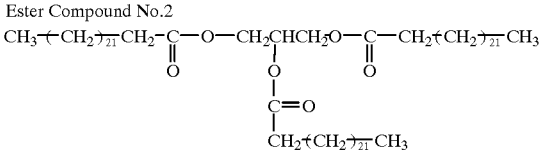

Ester Compound No.3

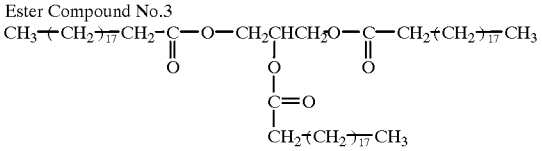

Ester Compound No.4:

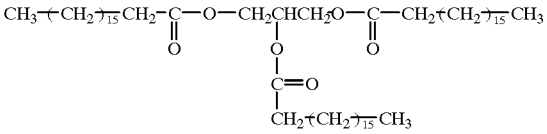

Ester Compound No.5

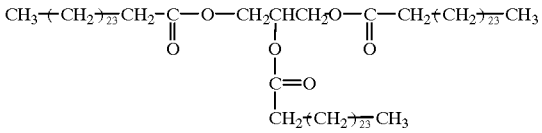

Ester Compound No.6

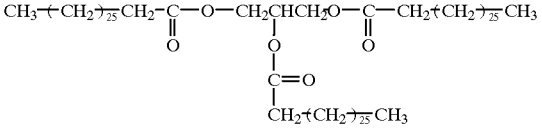

Ester Compound No.7

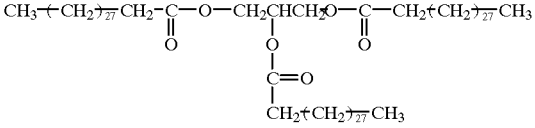

Ester Compound No.8

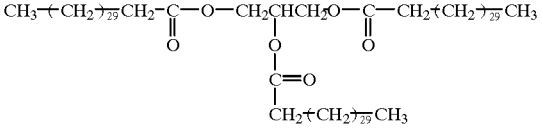

-continued

Ester Compound No.9

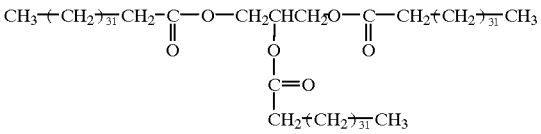

Ester Compound No.10

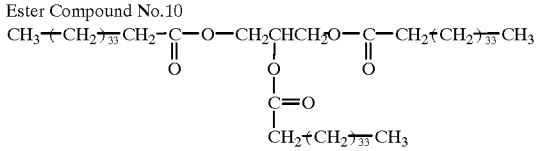

Ester Compound No.11

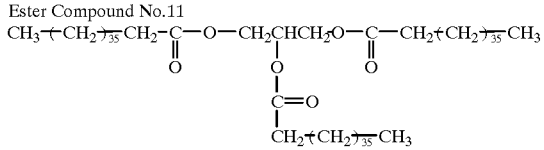

Ester Compound No.12

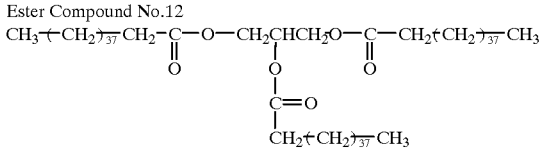

Ester Compound No.13 (Comparative Compound)

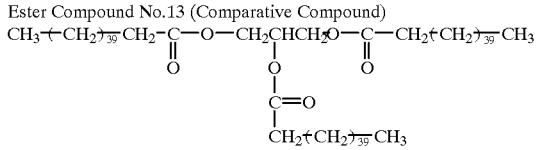

Ester Compound No.14 (Comparative Compound)

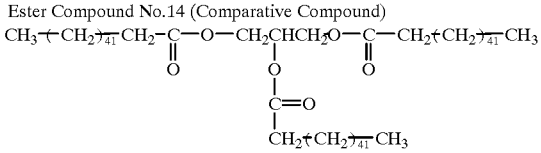

Ester Compound No.15 (Comparative Compound)

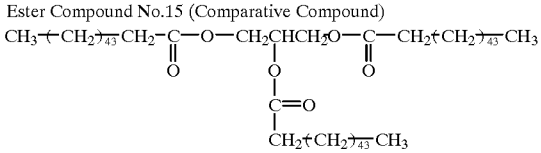

Ester Compound No.16 (Comparative Compound)

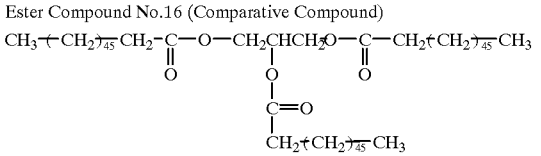

Ester Compound No.17

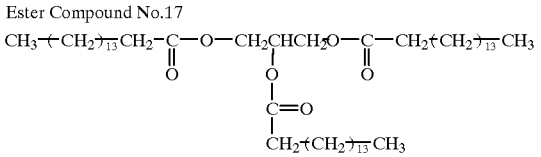

Ester Compound No.18

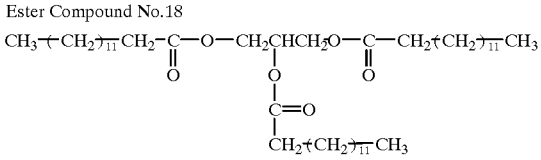

-continued
Ester Compound No.19
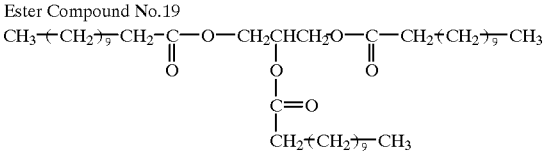
Ester Compound No.20
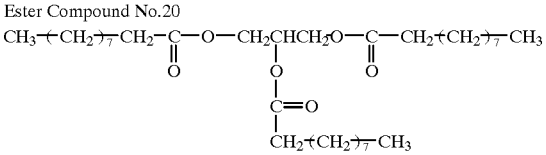
Ester Compound No.21 (Comparative Compound)
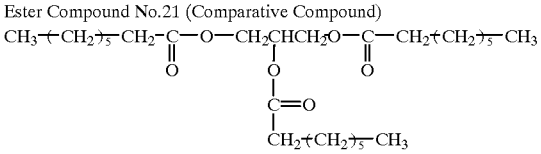
Ester Compound No.22 (Comparative Compound)
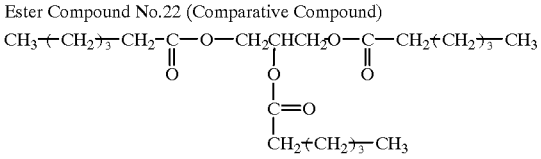
Ester Compound No.23
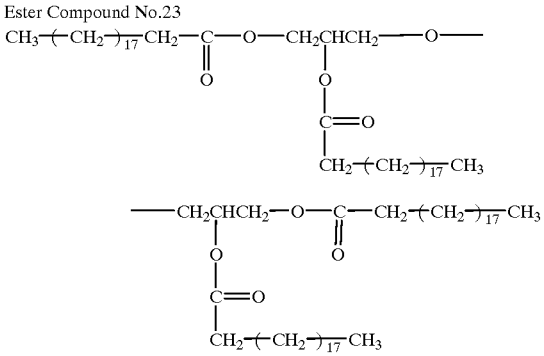
Ester Compound No.24
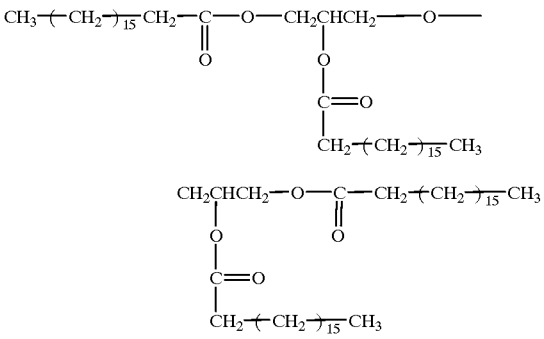
Ester Compound No.25
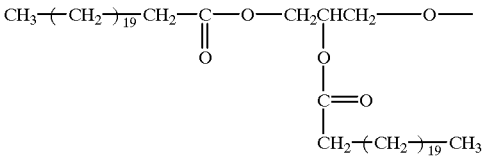
-continued
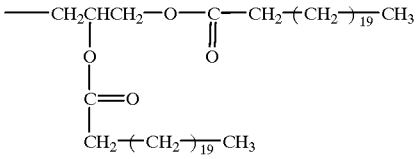
Ester Compound No.26
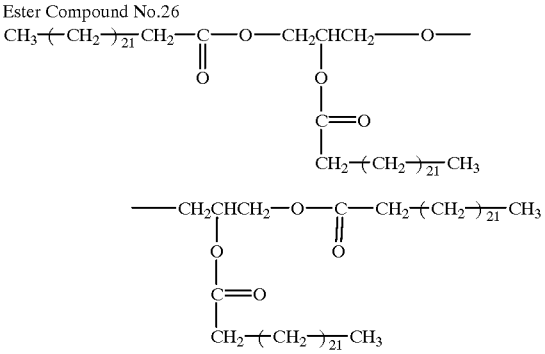
Ester Compound No.27
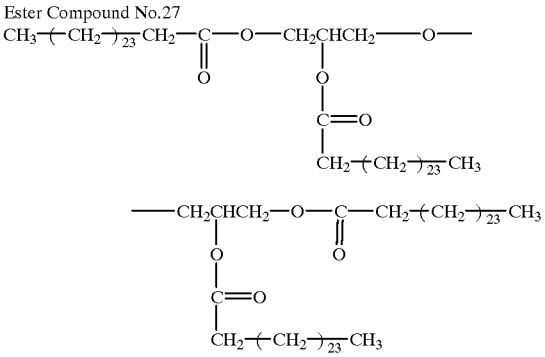
Ester Compound No.28
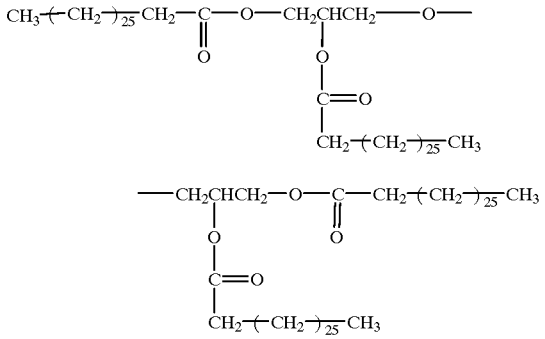
Ester Compound No.29
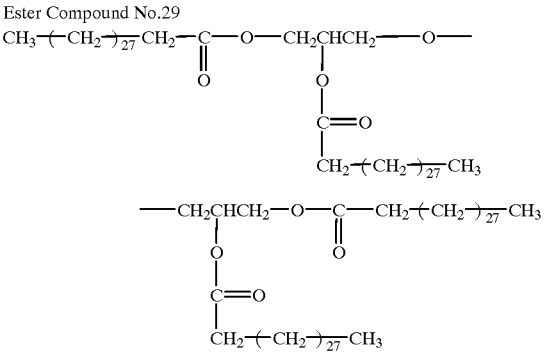

-continued
Ester Compound No.30
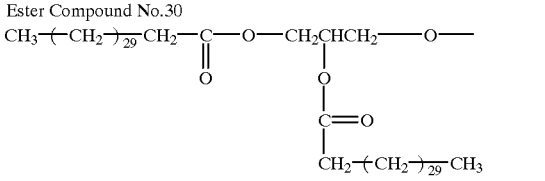
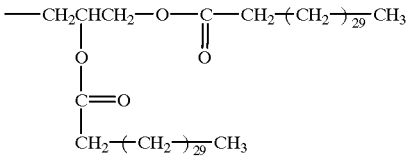
Ester Compound No.31
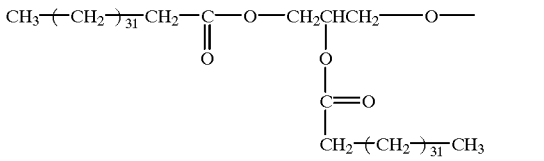
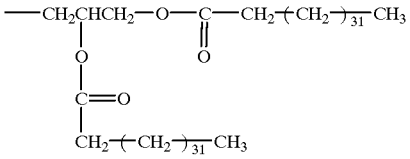
Ester Compound No.32
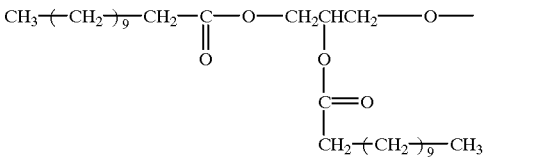
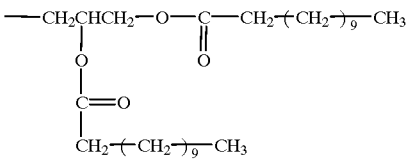
Ester Compound No.33
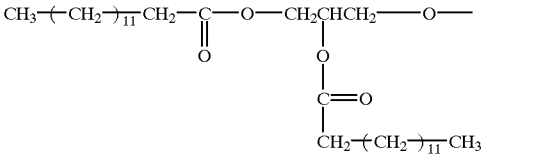
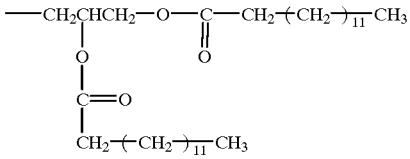
Ester Compound No.34
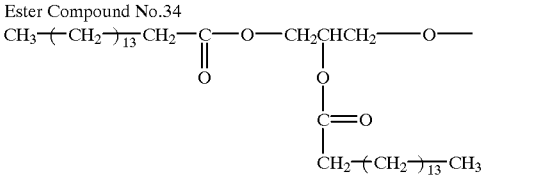
-continued
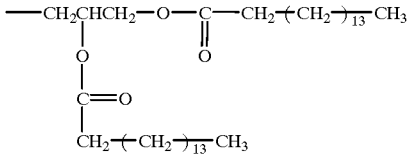
Ester Compound No.35 (Comparative Compound)
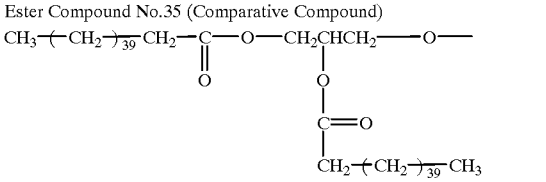
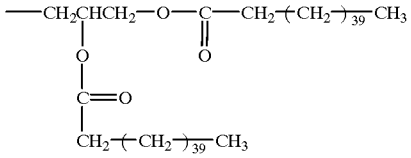
Ester Compound No.36 (Comparative Compound)
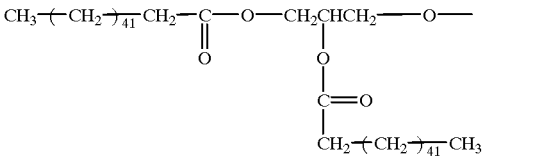
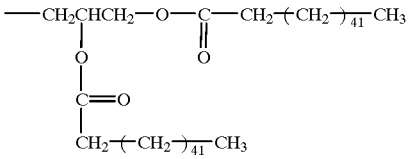
Ester Compound No.37 (Comparative Compound)
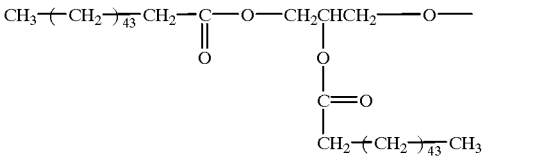
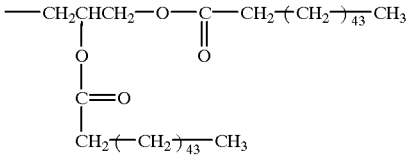
Ester Compound No.38 (Comparative Compound)
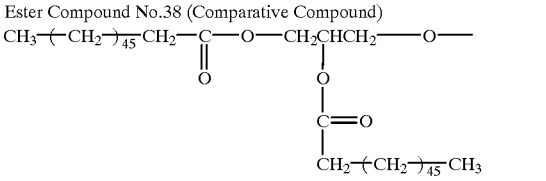
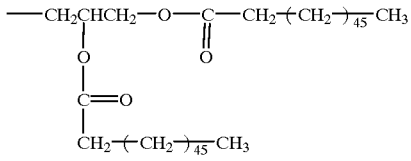

-continued

Ester Compound No.39 (Comparative Compound)

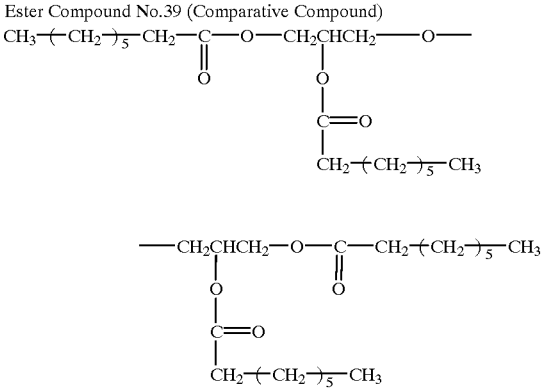

Ester Compound No.40 ( Comparative Compound)

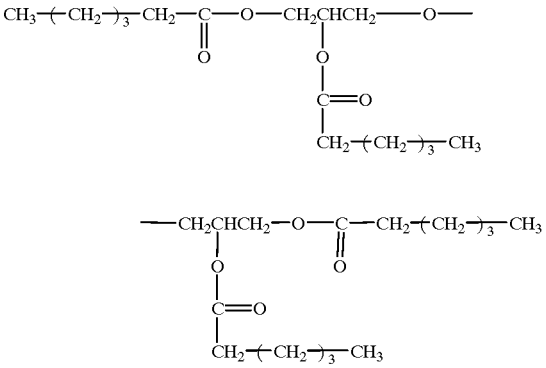

Ester Compound No.41

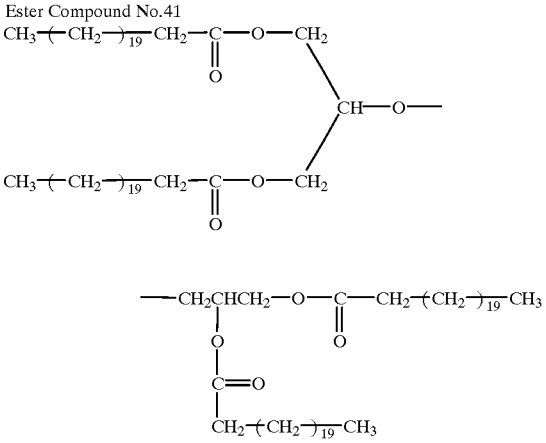

Ester Compound No.42

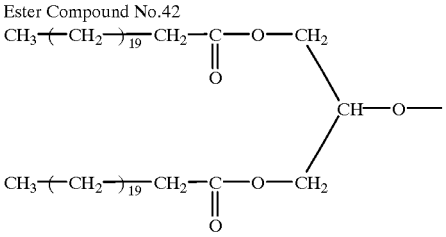

-continued

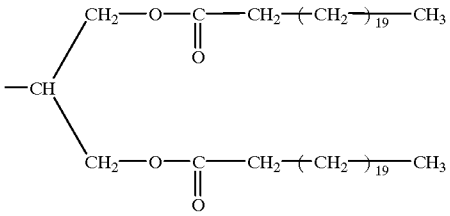

Ester Compound No.43 (Comparative Compound)

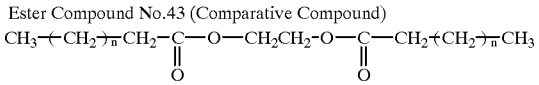

wherein n is an odd number of from 7 to 21

Ester Compound No.44 (Comparative Compound)

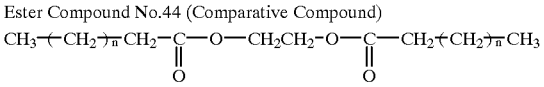

wherein n is an odd number of from 23 to 29

Ester Compound No.45 (Comparative Compound)

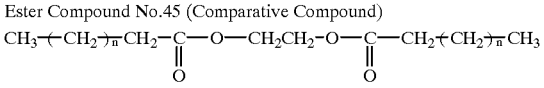

wherein n is an odd number of from 31 to 37

Ester Compound No.46 (Comparative Compound)

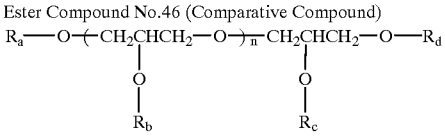

wherein $R_a$, $R_b$, $R_c$ and $R_d$ are

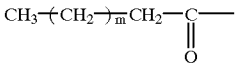

or hydrogen, m is an odd number of from 13 to 23, and n is average number of 6.

Ester Compound No.47 (Comparative Compound)

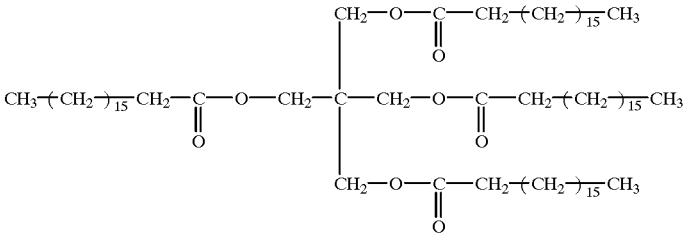

Ester Compound No.48 (Comparative Compound)

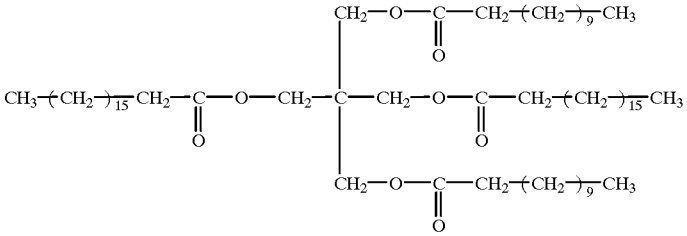

Ester Compound No.49 (Comparative Compound)

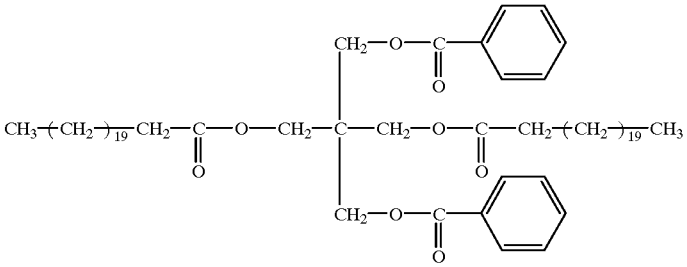

Ester Compound No.50 (Comparative Compound)

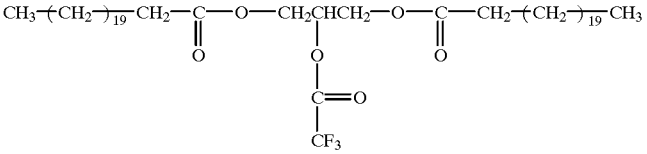

Ester Compound No.51 (Comparative Compound)

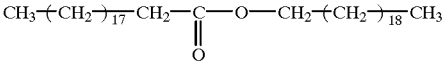

Ester Compound No.52 (Comparative Compound)

Montan Wax

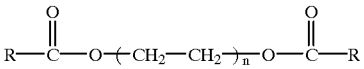

wherein R is $C_{21-28}$ hydrocarbon group, and n is an integer of 1 or above.

Physical properties of waxes used in Examples and Comparative Examples are shown in Tables 1—1 to 1–4 and Table 2.

TABLE 1-1

| Wax | Content of ester compounds represented by formula (A) to (D) (wt %) | Wax Composition: Ester compound (wt %) | | Wax Composition: Others (wt %) | Hydroxyl value (mgKOH/g) | Acid value (mgKOH/g) | State at room temperature (25° C.) | Main peak in DSC endothermic curve (° C.) |
|---|---|---|---|---|---|---|---|---|
| A | 93 | No.1: | 80 | Alcohol component: 0.3 | 2.1 | 1.5 | Solid | 70 |
| | | No.2: | 5 | Acid component: 0.9 | | | | |
| | | No.3: | 3 | Others: 5.8 | | | | |
| | | No.4, No.5, No.17 | 5 | | | | | |
| B | 90 | No.2: | 60 | Alcohol component: 0.5 | 0.1 | 3.6 | Solid | 74 |
| | | No.1: | 9 | Acid component: 1.9 | | | | |
| | | No.3: | 5 | Others: 7.6 | | | | |
| | | No.4, No.5, No.6, No.7, No.17, No.18 | 16 | | | | | |
| C | 91 | No.23: | 70 | Alcohol component: 2.6 | 4.6 | 0.2 | Solid | 72 |
| | | No.24: | 5 | Acid component: 0.1 | | | | |
| | | No.25: | 7 | Others: 6.3 | | | | |
| | | No.26, No.27, No.28, No.29, No.30, No.32, No.33, No.34 | 9 | | | | | |

TABLE 1-2

| Wax | Content of ester compounds represented by formula (A) to (D) (wt %) | Wax Composition: Ester compound (wt %) | | Wax Composition: Others (wt %) | Hydroxyl value (mgKOH/g) | Acid value (mgKOH/g) | State at room temperature (25° C.) | Main peak in DSC endothermic curve (° C.) |
|---|---|---|---|---|---|---|---|---|
| D | 84 | No.24: | 75 | Alcohol component: 2.0 | 3.7 | 0.9 | Solid | 69 |
| | | No.23: | 3 | Acid component: 0.5 | | | | |
| | | No.25: | 5 | Others: 13.5 | | | | |
| | | No.26, No.27, No.28, No.29, No.30, No.31, No.32, No.33, No.34 | 4 | | | | | |
| E | 75 | No.1: | 3 | Alcohol component: 1.2 | 8.9 | 4.3 | Solid | 66 |
| | | No.3: | 10 | Acid component: 2.6 | | | | |
| | | No.4: | 7 | Others: 21.2 | | | | |
| | | No.5: | 25 | | | | | |
| | | No.23: | 6 | | | | | |
| | | No.24: | 4 | | | | | |
| | | No.25: | 2 | | | | | |
| | | No.26: | 18 | | | | | |
| F | 95 | No.1: | 95 | Acid component: 3.0 | 2.6 | 2.8 | Solid | 71 |
| | | | | Acid component: 1.0 | | | | |
| | | | | Others: 1 | | | | |
| G | 74 | No.6: | 45 | Alcohol component: 0.6 | | | | |
| | | No.7: | 29 | Acid component: 2.6 | 0.8 | 3.9 | Solid | 76 |
| | | | | Others: 22.8 | | | | |
| H | 65 | No.11: | 30 | Alcohol component: 4.1 | | | | |
| | | No.12: | 35 | Acid component: 8.2 | 7.3 | 9.2 | Solid | 80 |
| | | | | Others: 22.7 | | | | |

TABLE 1-3

| Wax | Content of ester compounds represented by formula (A) to (D) (wt %) | Wax Composition: Ester compound (wt %) | | Wax Composition: Others (wt %) | Hydroxyl value (mgKOH/g) | Acid value (mgKOH/g) | State at room temperature (25° C.) | Main peak in DSC endothermic curve (° C.) |
|---|---|---|---|---|---|---|---|---|
| I | 63 | No.19: | 23 | Alcohol component: 1.5 | 2.3 | 0.6 | Solid | 52 |
| | | No.20: | 40 | Acid component: 0.2 | | | | |
| | | | | Others: 35.3 | | | | |
| J | 65 | No.25: | 58 | Alcohol component: 0.9 | 1.7 | 1.4 | Solid | 64 |
| | | No.41: | 7 | Acid component: 0.6 | | | | |
| | | No.42: | 1 | Others: 33.5 | | | | |
| K | | No.11: | 7 | Alcohol component: 2.7 | 4.4 | 2.3 | Solid | 117 |
| | 62 | No.12: | 55 | Acid component: 2.0 | | | | |
| | | | | Others: 33.3 | | | | |
| (a) | 4 | No.20: | 4 | Alcohol component: 0 | 0.06 | 1.6 | Paste | 34 |
| | | No.21: | 90 | Acid component: 0.7 | | | | |
| | | No.22: | 5 | Others: 0.3 | | | | |
| (b) | 16 | No.30: | 6 | Alcohol component: 4.0 | 11.4 | 0.1 | Solid | 82 |
| | | No.31: | 10 | Acid component: 0 | | | | |
| | | No.35: | | Others: 0 | | | | |
| | | No.36: | 80 | | | | | |
| | | No:37: | | | | | | |
| | | No:38: | | | | | | |
| (c) | 0 | No.43: | 12 | Alcohol component: 0 | 31.5 | 3.7 | Solid | 59 |
| | | No.44: | 70 | Acid component: 2.1 | | | | |
| | | No.45: | 8 | Others: 7.9 | | | | |
| (d) | 0 | No.46: | 80 | Alcohol component: 2.0 | 44.8 | 1.9 | Solid | 67 |
| | | | | Acid component: 1.0 | | | | |
| | | | | Others: 17.0 | | | | |

TABLE 1-4

| Wax | Content of ester compounds represented by formula (A) to (D) (wt %) | Wax Composition: Ester compound (wt %) | | Wax Composition: Others (wt %) | Hydroxyl value (mgKOH/g) | Acid value (mgKOH/g) | State at room temperature (25° C.) | Main peak in DSC endothermic curve (° C.) |
|---|---|---|---|---|---|---|---|---|
| (e) | 0 | No.13: | 16 | Alcohol component: 0 | 0.04 | 7.8 | Solid | 122 |
| | | No.14: | 30 | Acid component: : 5.9 | | | | |
| | | No.15: | 11 | Others: 30.1 | | | | |
| | | No.16: | 7 | | | | | |
| (f) | 0 | No.39: | 47 | Alcohol component: 0.5 | 1.6 | 0.9 | Paste | 28 |
| | | No.40: | 39 | Acid component: : 0.3 | | | | |
| | | | | Others: 13.2 | | | | |
| (g) | 0 | No.47: | 76 | Alcohol component: 0.3 | 1.5 | 0.6 | Solid | 60 |
| | | | | Acid component: : 0.3 | | | | |
| | | | | Others: 23.4 | | | | |
| (h) | 0 | No.48: | 51 | Alcohol component: 0.7 | 2.4 | 0.3 | Solid | 62 |
| | | | | Acid component: : 0.1 | | | | |
| | | | | Others: 48.2 | | | | |
| (i) | 0 | No.49: | 54 | Alcohol component: 0.4 | 1.2 | 3.5 | Solid | 74 |
| | | | | Acid component: : 1.2 | | | | |
| | | | | Others: 44.4 | | | | |
| (j) | 0 | No.50: | 63 | Alcohol component: 1.2 | 3.3 | 2.5 | Solid | 68 |
| | | | | Acid component: 1.5 | | | | |
| | | | | Others: 34.4 | | | | |
| (k) | 0 | No.51: | 81 | Alcohol component: 0.2 | 0.9 | i.2 | Solid | 70 |
| | | | | Acid component: 0.8 | | | | |
| | | | | Others: 18.0 | | | | |
| (l) | 0 | No.52: | 90 | Alcohol component: 0.1 | 7.8 | 27 | Solid | 66 |
| | | | | Acid component: 2.6 | | | | |
| | | | | Others: 7.3 | | | | |

TABLE 2

| Wax | Type | Weight average molecular weight | State at room temperature (25° C.) | Main peak in DSC endothermic curve (° C.) |
|---|---|---|---|---|
| (m) | paraffin wax | 500 | Solid | 75 |
| (n) | polyethylene wax | 1,200 | Solid | 110 |
| (o) | polypropylene wax | 6,000 | Solid | 135 |

EXAMPLE 1

Six hundred parts by weight of ion exchange water and 500 parts by weight of 0.1 mol/liter of $Na_3PO_4$ water solution were fed in a four-neck flask including a fast agitator TK-type homo mixer (manufactured by Tokushukika Kogyo Co., Ltd.) and a baffle plate. The number of rotations was adjusted to 12,000 rpm and the flask was heated to 65° C. Seventy parts by weight of 1.0 mol/liter $CaCl_2$ water solution was gradually added to the mixture to prepare an aqueous medium containing a fine water-insoluble dispersion stabilizer $Ca_3(PO_4)_2$.

| | |
|---|---|
| Styrene | 78 parts by weight |
| n-butylacrylate | 22 parts by weight |
| Carbon black (oil absorption = 70 ml/g, pH = 7.0) | 10 parts by weight |
| Polyester resin (Mw = 10,800, peak molecular weight = 5,200, Tg = 65° C., acid value = 8.2 mgKOH/g) | 4 parts by weight |
| Negative-charging control agent (iron complex of dialkyl salicylate) | 2 parts by weight |
| Wax F | 10 parts by weight |

A mixture of these materials was dispersed for three hours using Attriter (manufactured by Mitsui Metal Inc.), and 6 parts by weight of 2, 2'-azobis (2, 4-dimethylvaleronitrile) was added to the mixture to prepare a polymerized monomer composition.

Next, the polymerized monomer composition was fed in the aqueous medium and then agitated in an $N_2$ atmosphere at an internal temperature of 65° C. for 15 minutes with the number of rotations of the fast agitator maintained at 12,000 rpm to granulate the polymerized monomer composition in the aqueous medium. Subsequently, the agitator was replaced by a propeller agitating vane, and the composition was held at the same temperature for 10 hours while the shape of particles was controlled by varying the number of rotations of the agitating vane and the angle of the baffle plate. Thus, polymerization was completed.

After polymerization, the turbid liquid was cooled and dilute hydrochloric acid was added to the liquid to remove the dispersion stabilizer. Furthermore, flushing was repeated several times, and the liquid was dried to obtain polymer particles (black toner particles) (A). The polymer particles (A) had a weight average diameter of 5.5 $\mu$m, a number distribution variation coefficient of 16%, a shape factor SF-1 of 106, and a shape factor SF-2 of 102. (SF-2)/(SF-1) was 0.96, the peak molecular weight in a molecular-weight distribution measured by a gel permeation chromatography (GPC) was 15,000, and Mw/Mn was 18. The content of wax F in the polymer particles (A) was observed by a TEM to find that the wax was included in the particle in the form of a substantial sphere due to its incompatibility with binder resin as shown in the model drawing in FIG. 11A. About 10 parts by weight of wax F was contained in toner particles (A) per 100 parts by weight of binder resin components.

One hundred parts by weight of the polymer particles (A) and 2 parts by weight of dimethyl silicone oil-processed hydrophobic silica fine powders (BET specific surface area: about 120 $m^2/g$) were dry-mixed using a Henschel mixer to obtain black toner (A). Table 3 shows the physical properties of the black toner particles (A) and black toner A.

EXAMPLES 2 TO 11

Black toner particles B to K were obtained in the same manner as in Example 1 except for the use of wax A (Example 2), wax B (Example 3), wax C (Example 4), wax D (Example 5), wax E (Example 6), wax G (Example 7), wax H (Example 8), wax I (Example 9), wax J (Example 10), or wax K (Example 11) instead of the wax F. Furthermore, black toners B to K were obtained. Table 3 shows the physical properties of the black toner particles and black toners B to K obtained.

COMPARATIVE EXAMPLES 1 TO 12

Black toner particles (a), (b), and (e) to (l) were obtained in the same manner as in Example 1 except for the use of waxes (a) to (l) instead of the wax F. Furthermore, black toners (a), (b), and (e) to (l) were obtained.

In Comparative Examples 3 and 4 using the waxes (c) and (d), a polymerized monomer was difficult to granulate in an aqueous medium, and particles were merged together to prevent toner particles from being generated.

Table 3 shows the physical properties of the black toner particles (a), (b), and (e) to (l) obtained.

COMPARATIVE EXAMPLE 13

| | |
|---|---|
| Styrene-n-butylacrylate copolymer (copolymerization weight ratio 80:20; weight average molecular weight: 139,000; main peak molecular weight: 16,000; Mw/Mn: 2.2; Tg: 55° C.) | 100 parts by weight |
| Polyester resin used in Example 1 | 4 parts by weight |
| Carbon black used in Example 1 | 10 parts by weight |
| Negative-charging control agent used in Example 1 | 2 parts by weight |
| Wax (C) | 10 parts by weight |

A mixture of these materials was melted and kneaded using a two-axis extruder, and the kneaded mixture was cooled and roughly crushed using a hammer mill. The roughly crushed mixture was finely crushed using a jet mill, and the finely crushed mixture obtained and commercially available calcium phosphate were mixed using a Henschel mixer. The mixed powders obtained was fed in a container containing water and dispersed in the water using a homo mixer. The temperature of the water was gradually increased, and the powders were heated at 60° C. for two ho urs. Subsequently, dilute hydrochloric acid was added to the container to sufficiently dissolve calcium phosphate on the surface of the particles of the finely crushed mixture. The black resin particles were filtered, flushed, dried, and then passed through a sieve of 400 meshes to remove aggregates therefrom. The particles were then classified to obtain black toner particles (m). The black toner particles (m) were used to obtain black toner (m) as in Example 1.

The wax (C) was dispersed in the black toner particle (m) in the form of fine powders, as shown in the model drawing in FIG. 11B.

Table 3 shows the physical properties of the black toner particles (m) and the black toner (m).

COMPARATIVE EXAMPLE 14

Black toner particles (n) were obtained in the same manner as in Comparative Example 13 except for the use of wax (d) instead of the wax (c). Furthermore, black toner (n) was obtained.

Table 3 shows the physical properties of the black toner particles (n) and black toner (n) obtained.

COMPARATIVE EXAMPLES 15 TO 17

Black toners (D), (P), and (Q) were obtained in the same manner as in Example 1 except for the use of the wax (m) (Comparative Example 15), the wax (n) (Comparative Example 16), wax (o) (Comparative Example 17) instead of the wax (F). Table 3 shows the physical properties of the black toner obtained.

Evaluation of the blocking resistance of the toners

The following method was used to grade the toners at four levels: A, B, C, and D.

Ten g of toner was placed in a 50-ml polyethylene cup, which was then placed in a hot-air drier set at 50° C. The cup was left as it was for one week. The polyethylene cup was then removed, slowly rotated, and then left as it was. The toner was then visually evaluated.

A: Fluidity is maintained.

B: Fluidity has decreased but recovers as the cup rotates.

C: Aggregates remain but are loosened when poked with a needle.

D: Aggregates are granulated or caked in such a way that they cannot be loosened when poked with a needle.

TABLE 3

| | Toner particles | | | | | | Toner | | | | | | | | | |
|---|---|---|---|---|---|---|---|---|---|---|---|---|---|---|---|---|
| | | | | | Weight average | Variation | | | | | Weight average | Variation | Blocking resistance (temperature: 50° C.) | | | |
| | Type | SF-1 | SF-2 | SF-2/SF-1 | particle size (μm) | coefficient (%) | Type | SF-1 | SF-2 | SF-2/SF-1 | particle size (μm) | coefficient (%) | 8 hours later | 16 hours later | 24 hours later | 1 week later |
| Example 1 | A | 106 | 102 | 0.96 | 5.5 | 16 | A | 106 | 102 | 0.96 | 5.5 | 16 | A | A | A | A |
| Example 2 | B | 107 | 104 | 0.97 | 5.6 | 19 | B | 107 | 104 | 0.97 | 5.6 | 19 | A | A | A | B |
| Example 3 | C | 111 | 107 | 0.96 | 6.1 | 25 | C | 111 | 107 | 0.96 | 6.1 | 25 | A | A | A | B |
| Example 4 | D | 123 | 114 | 0.93 | 6.5 | 27 | D | 123 | 114 | 0.93 | 6.5 | 27 | A | A | B | |
| Example 5 | E | 128 | 123 | 0.96 | 7.4 | 31 | E | 128 | 123 | 0.96 | 7.4 | 31 | A | A | B | B |
| Example 6 | F | 152 | 141 | 0.93 | 7.8 | 34 | F | 152 | 141 | 0.93 | 7.8 | 34 | A | A | B | C |
| Example 7 | G | 121 | 116 | 0.96 | 6.9 | 32 | G | 121 | 116 | 0.96 | 6.9 | 32 | A | A | B | B |
| Example 8 | H | 119 | 115 | 0.97 | 6.8 | 29 | H | 119 | 115 | 0.97 | 6.8 | 29 | A | A | B | B |
| Example 9 | I | 135 | 138 | 1.02 | 6.6 | 33 | I | 135 | 138 | 1.02 | 6.6 | 33 | A | B | B | C |
| Example 10 | 3 | 122 | 112 | 0.92 | 7.0 | 30 | J | 122 | 112 | 0.92 | 7.0 | 30 | A | A | B | B |
| Example 11 | K | 118 | 119 | 1.01 | 6.7 | 28 | K | 118 | 119 | 1.01 | 6.7 | 28 | A | A | B | B |
| Comparative example 1 | a | 130 | 122 | 0.94 | 6.0 | 43 | a | 130 | 122 | 0.94 | 6.0 | 43 | A | B | C | D |
| Comparative example 2 | b | 144 | 137 | 0.95 | 8.2 | 47 | b | 144 | 137 | 0.95 | 8.2 | 47 | A | A | B | D |
| Comparative example 5 | e | 134 | 128 | 0.96 | 7.9 | 38 | e | 134 | 128 | 0.96 | 7.9 | 38 | A | A | B | C |
| Comparative example 6 | f | 129 | 129 | 1.00 | 7.8 | 34 | f | 129 | 129 | 1.00 | 7.8 | 34 | B | B | C | D |
| Comparative example 7 | g | 138 | 133 | 0.96 | 8.3 | 39 | g | 138 | 133 | 0.96 | 8.3 | 39 | A | B | B | C |
| Comparative example 8 | b | 140 | 131 | 0.94 | 9.1 | 35 | h | 140 | 131 | 0.94 | 9.1 | 35 | A | B | B | C |
| Comparative example 9 | i | 135 | 129 | 0.96 | 8.4 | 37 | i | 135 | 129 | 0.96 | 8.4 | 37 | B | B | C | D |
| Comparative example 10 | j | 131 | 136 | 1.04 | 8.1 | 33 | j | 131 | 136 | 1.04 | 8.1 | 33 | B | B | C | D |
| Comparative example 11 | k | 146 | 140 | 0.96 | 9.2 | 36 | k | 146 | 140 | 0.96 | 9.2 | 36 | A | B | B | D |
| Comparative example 12 | l | 137 | 121 | 0.88 | 8.5 | 33 | I | 137 | 121 | 0.88 | 8.5 | 33 | B | B | C | D |
| Comparative example 13 | m | 162 | 145 | 0.90 | 6.4 | 29 | m | 162 | 145 | 0.90 | 6.4 | 29 | B | C | C | D |
| Comparative example 14 | n | 169 | 150 | 0.89 | 6.9 | 32 | n | 169 | 150 | 0.89 | 6.9 | 32 | B | B | C | D |
| Comparative example 15 | o | 125 | 121 | 0.97 | 6.8 | 28 | o | 125 | 121 | 0.97 | 6.8 | 28 | A | A | B | C |
| Comparative example 16 | p | 123 | 120 | 0.98 | 6.7 | 31 | p | 123 | 120 | 0.98 | 6.7 | 31 | A | A | A | C |
| Comparative example 17 | q | 138 | 134 | 0.97 | 8.9 | 36 | q | 138 | 134 | 0.97 | 8.9 | 36 | A | A | A | C |

EXAMPLE 12

Five parts by weight of the black toner A obtained in Example 1 and 95 parts by weight of silicone resin coated magnetic ferrite carrier (number average particle size: 45 μm) were mixed together to prepare a two-component developer. The developer was then introduced into the black developing device 4—4 shown in FIG. 1 to conduct a printout test in a monocolor mode. The black toner (A) has a negative triboelectric characteristic.

An image-forming apparatus (1) used for evaluation is described. FIG. 1 is a schematic explanatory drawing of a cross section of the image-forming apparatus (1).

A photosensitive drum 1 had a photosensitive layer 1*b* having an organic photosemiconductor on a substrate 1*a* and rotates in the direction shown by the arrow. A charging roller 2 (a conductive elastic layer 2*a* and a core 2*b*) opposed to the photosensitive drum 1 so as to rotate while contacting the drum 1 was used to charge the drum 1 to a surface potential of about −600 V. An exposure 3 was turned on and off using a polygon mirror, depending on digital image information, so that an electrostatic image having an exposure potential of −100 V and a dark potential of −600 V was formed on the photosensitive drum 1. The developing device 4—4 and the reverse developing method were used to obtain a black toner image on the photosensitive drum 1. The black toner image was transferred to an intermediate transfer member 5 (an elastic layer 5*a* and a core 5*b* as a support), from which the image was further transferred to transfer paper 6. The remaining toner on the photosensitive member 1 was cleaned using a cleaning member 8.

The intermediate transfer member 5 was produced by coating the pipe-shaped core 5*b* with the elastic layer 5*b* comprising nitrile-butadiene rubber (NBR) in which a conductivity-applying member of carbon black was sufficiently dispersed. The coat layer 5*b* had a hardness of 30 in conformity to "JIS K-6301" and had a volume-specific resistance value of $10^9\Omega\cdot$cm. A transfer current required for transfer from the photosensitive drum 1 to the intermediate transfer member 5 was about 5 μA, which was obtained by providing +500 V to the core 5*b* from a power supply.

The transfer roller 7 had an elastic layer 7*a* generated by coating on a core 7*b* of 20 mm outer diameter and 10 mm diameter, a foaming member of ethylene-propylene-diene three-component polymer (EPDM) in which a conductivity-applying member of carbon was sufficiently dispersed. The elastic layer 7*a* had a volume-specific resistance value of $10^6\Omega\cdot$cm and had a hardness of 35 according to "JIS J-6301". A voltage was applied to the transfer roller to allow a 15-μA transfer current to flow therethrough.

A heating pressurizing roller fixing apparatus H comprised a thermal-roll fixing apparatus having no oil-applying function. Both the top and bottom rollers had a fluorine resin surface layer, and had a diameter of 55 mm. In addition, the fixing temperature was set at 140° C. and the nip width was set at 7 mm.

Under the above setting conditions and in a normal temperature and humidity (25° C., 60% RH), a low temperature and humidity (15° C., 10% RH), or a high temperature and humidity (30° C., 80% RH) environment, a printout test was conducted in a monotone continuous mode (that is, the mode that facilitates the consumption of toner without pausing the developing device) at a printout speed of 12 sheets (A4 size)/min. while refilling the black toner A in the two-component developer as required. The printout images obtained were evaluated for the following items.

The matching between the image-forming apparatus and the two-component developer was also evaluated.

Printout Image Evaluations

<1> Image density

The image density maintained when the printout of a predetermined number of sheets of ordinary paper (75 g/m$^2$) for copiers was finished was evaluated. The image density was measured in terms of a density relative to a printout image against a white background of manuscript density 0.00, using "Macbeth Reflection Density Meter" manufactured by Macbeth Inc..

A: 1.40 or more
B: 1.35 or more, less than 1.40
C: 1.00 or more, less than 1.35
D: Less than 1.00

<2> Dot Reproductivity

An image having an isolated dot pattern of a small diameter (45 μm) such as that shown in FIG. 8 was printed out to evaluate its dot reproductivity; such an image is difficult to reproduce because electric fields are likely to be closed by latent image electric fields.

A: 2 or less/100 dots are missing.
B: 3 to 5/100 dots are missing.
C: 6 to 10/100 dots are missing
D: 11 or more/100 dots are missing.

<3> Image Fogging

The fog density (%) was calculated from the difference between the whiteness of the white portion of a printout image and that of transfer paper measured by "REFLECTOMETER" (Tokyo Denshoku Inc.) in order to evaluate image fogging.

Figure 13A:
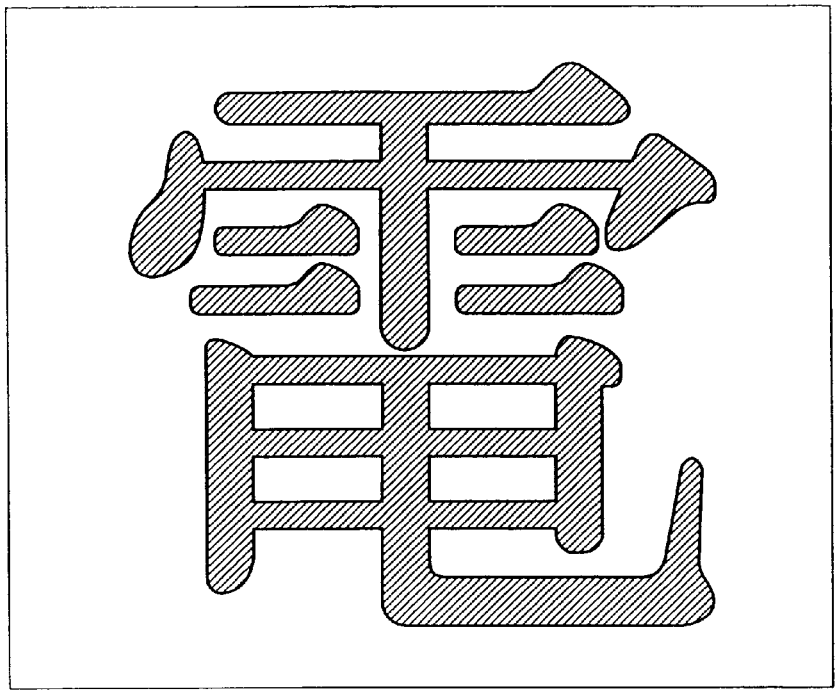
FIGS. 13A and 13B are schematic drawings showing scattering of a Chinese character image.
Figure 13B:
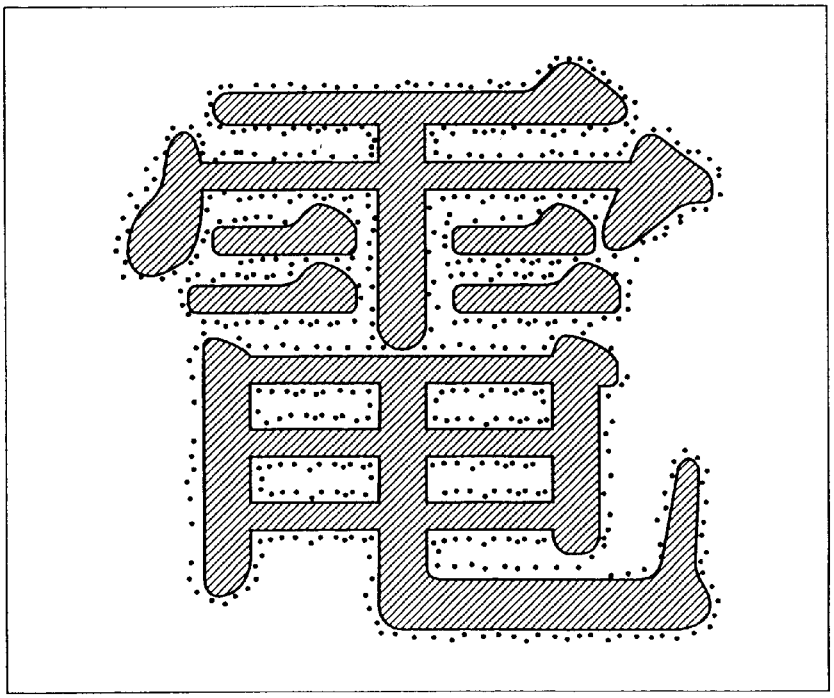

A: Less than 1.5%
B: 1.5% or more, less than 2.5%
C: 2.5% or more, less than 4.0%
D: 4.0% or more <4> Image Scattering The character pattern "電" shown in FIG. 13A was printed on ordinary paper (75 g/m$^2$) and thick paper (105 g/m$^2$ and 135 g/m$^2$), and this character was visually checked for the scattering of toner on its periphery (see FIG. 13B).

A: Almost no scatter
B: Minor scatter
C: Small scatter
D: Large scatter

<5> Unprinted Portions of Images

Figure 14A:
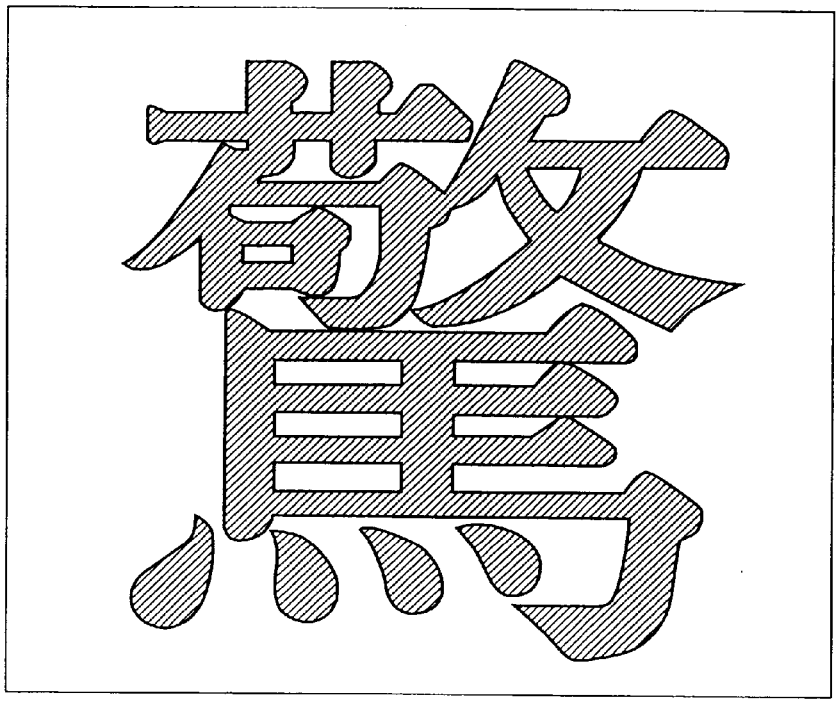
FIGS. 14A and 14B are schematic drawings showing a state of white spots (untransfered spots) in a character image.
Figure 14B:
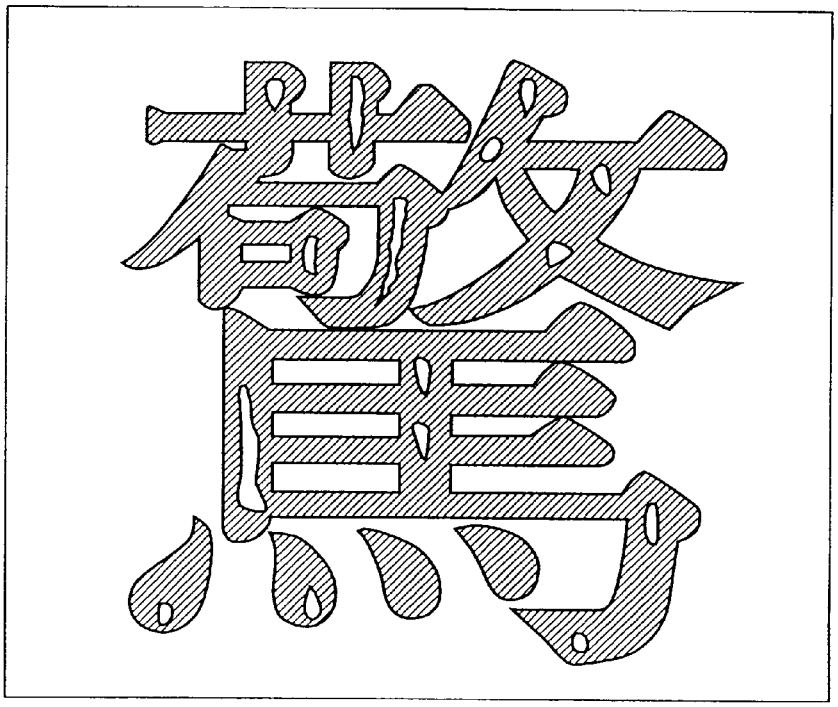

The character pattern "驚" shown in FIG. 14A was printed on thick paper (128 g/cm$^2$ and 135 g/m$^2$), and this character was visually evaluated for its unprinted portions (see FIG. 14B).

Figure 15C:
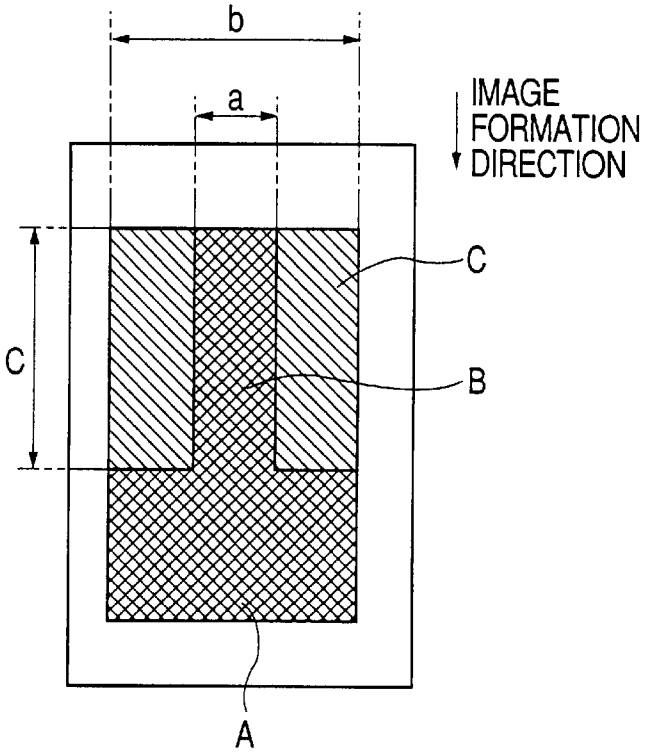
FIGS. 15A, 15B and 15C show a sleeve ghost.
Figure 15B:
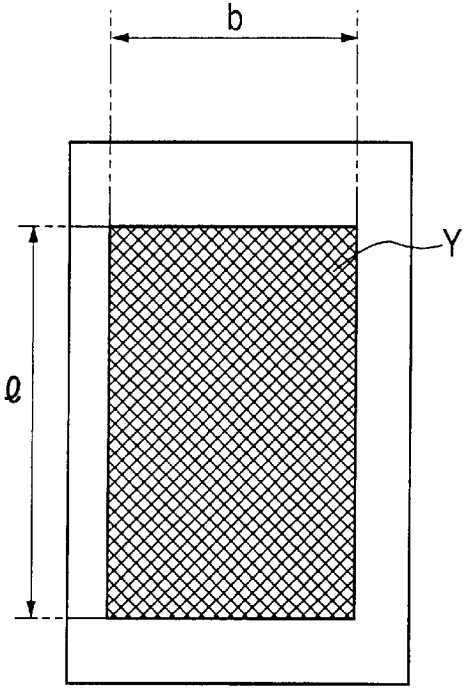
Figure 15A:
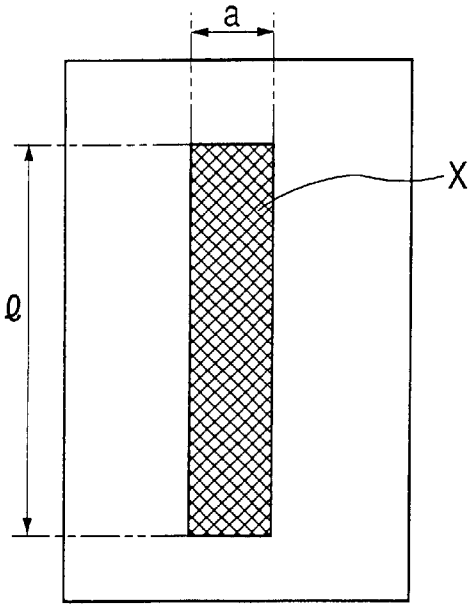

A: Almost no unprinted portions
B: Minor unprinted portions
C: Small unprinted portions
D: Large unprinted portions <6> Sleeve Ghost After a solid-black band-shaped image X of width a and length 1, which is shown in FIG. 15A, was printed out, a halftone image Y of width b (>a) and length 1, which is shown in FIG. 15B, was printed out to visually check the difference in density observed on the halftone image (portions A, B, and C in FIG. 15C).

A: No difference in density was observed.
B: Minor difference was observed between B and C.
C: Small difference was observed between A and B and C.
D: Distinct difference was observed.
<7> Fixing property For the fixing property, a load of 50 g/cm$^2$ and soft thin paper were used to rub the fixed image to evaluate how the density had decreased after rubbing (%).

A: Less than 5%
B: 5% or more, less than 10%
C: 10% or more, less than 20%
D: 20% or more
<8> Offset Resistance For offset resistance, a sample image having an image area rate of about 5% was printed out to evaluate how the image was stained after 3,000 sheets of printout.

A: No stains
B: Almost no stains
C: Small stains were found on the image.
D: Large stains were found on the image.
Image-forming Apparatus Matching Evaluations
<1> Matching with a developing sleeve After the printout test, visual checks were conducted for the sticking of remaining toner to the surfaces of the developing sleeve and its effects on the printout images.

A: No sticking
B: Almost no sticking
C: Sticking occurred but had few effects on the images.
D: Distinct sticking occurred, resulting in non-uniform images.
<2> Matching with the photosensitive drum After the printout test, visual checks were conducted for damage to the surface of the photosensitive drum, the sticking of remaining toner, and their effects on the printout images.

A: None occurred.
B: Despite slight damage, the images were not affected.
C: Despite sticking or damage, there were few adverse effects on the images.
D: Distinct sticking occurred, resulting in vertical stripe-shaped defects in the images.
<3> Matching with the intermediate transfer member After the printout test, visual checks were conducted for damage to the surface of the intermediate transfer member and the sticking of remaining toner.

A: None occurred.
B: Despite the presence of remaining toner on the surface, the images were not affected.
C: Despite sticking or damage, there were few adverse effects on the images.
D: Distinct sticking occurred, resulting in defects in the images.
<4> Matching with the fixing apparatus After the printout test, visual checks were conducted for damage to the surfaces of fixing films and the sticking of remaining toner.

A: None occurred.
B: Despite slight sticking, the images were not affected.
C: Despite sticking or damage, there were few adverse effects on the images.
D: Distinct sticking occurred, resulting in defects in the images.
Fixing Property Before fix the image using the fixing apparatus of the image-forming apparatus shown in FIG. 1, the unfixed image was picked up and the heating pressurizing roller was used to fix it while using an external fixing machine to vary the fixing temperature at an interval of 5° C. in order to measure the minimum fixing temperature at which low-temperature offset did not occur and the maximum fixing temperature at which high-temperature offset did not occur.

Table 4 shows the results of evaluations.

EXAMPLES 13 TO 22 AND COMPARATIVE EXAMPLES 18 TO 32

The black toners B to K and the black toners (a), (b), and (e) to (g) were evaluated as in Example 2. Table 4 shows the results of evaluations.

TABLE 4

Results of Printout Image Evaluations and Image-forming Apparatus Matching Evaluations

| | | Printout image evaluations | | | | | | | | | Image-forming apparatus matching evaluations | | | Fixing property | | |
|---|---|---|---|---|---|---|---|---|---|---|---|---|---|---|---|---|
| | | Normal temperature and humidity | | | High temperature and humidity | | | | | | | | | | | |
| | | | | | | | Image density uniformity | | | | | | | | | |
| | Toner type | Image density | Dot reproductivity | Fogging | Ghost | Image density | 75 g/m$^2$ paper | 105 g/m$^2$ paper | 135 g/m$^2$ paper | Dot reproductivity | Photosensitive drum | Intermediate transfer member | Fixing apparatus | Minimum fixing temp. (° C.) | Maximum fixing temp. (° C.) | Fixing region temp. range (° C.) |
| Example 12 | A | A | A | A | A | A | A | A | A | A | A | A | A | 120 | 220 | 100 |
| Example 13 | B | A | A | A | A | A | A | A | A | A | A | A | A | 120 | 210 | 90 |
| Example 14 | C | A | A | A | A | A | A | A | B | A | A | A | A | 125 | 205 | 80 |
| Example 15 | D | A | A | A | A | B | A | A | B | A | A | A | A | 125 | 200 | 75 |
| Example 16 | E | A | B | B | B | B | B | B | C | B | B | B | A | 125 | 195 | 70 |
| Example 17 | F | A | B | B | B | B | B | C | C | C | C | C | B | 130 | 190 | 60 |
| Example 18 | G | A | B | C | B | B | B | C | C | C | B | C | C | 135 | 195 | 60 |
| Example 19 | H | A | B | C | C | B | B | C | C | C | C | B | C | 135 | 210 | 75 |
| Example 20 | I | B | C | C | C | B | C | C | C | C | C | C | C | 120 | 180 | 60 |
| Example 21 | J | B | C | C | C | B | B | C | C | C | C | C | C | 125 | 195 | 70 |
| Example 22 | K | B | C | C | C | B | B | C | C | C | C | C | C | 140 | 220 | 80 |
| Comparatve example 18 | a | D | D | C | C | D | C | D | D | D | D | D | D | 130 | 170 | 40 |
| Comparative example 19 | b | C | C | D | C | D | C | C | D | D | C | D | C | 160 | 220 | 60 |
| Comparative example 20 | e | C | D | D | C | D | C | C | C | D | D | D | C | 155 | 220 | 65 |
| Comparative example 21 | f | D | D | D | C | D | D | D | D | D | C | D | D | 130 | 150 | 20 |
| Comparative example 22 | g | D | C | D | D | D | D | D | D | C | D | D | C | 130 | 185 | 55 |
| Comparative example 23 | h | C | D | D | C | D | D | D | D | D | D | D | C | 130 | 180 | 50 |
| Comparative example 24 | i | D | C | D | C | D | D | D | D | C | D | D | D | 135 | 190 | 55 |
| Comparative example 25 | j | D | D | C | C | D | D | D | D | D | D | D | D | 135 | 195 | 60 |
| Comparative example 26 | k | C | C | D | D | C | C | C | D | C | D | D | D | 130 | 190 | 60 |
| Comparative example 27 | 1 | C | C | C | D | C | C | C | D | C | D | D | D | 140 | 180 | 40 |
| Comparative example 28 | m | B | C | D | C | C | C | D | D | D | D | D | C | 140 | 180 | 40 |
| Comparative example 29 | n | C | D | D | D | C | D | D | D | D | D | D | D | 135 | 180 | 45 |
| Comparative example 30 | o | C | C | D | D | D | D | D | D | D | D | D | C | 145 | 195 | 50 |
| Comparative example 31 | p | C | C | D | C | D | D | D | D | D | D | C | 150 | 180 | 30 | |
| Comparative example 32 | q | C | D | D | C | C | C | D | D | D | D | D | D | 165 | 200 | 35 |

EXAMPLES 23 TO 25

Yellow, magenta, and cyan toner particles were generated in the same manner as in Example 1 except for the use of 4.5 parts by weight of yellow colorant (C.I. Pigment Yellow 17), 5.0 parts by weight of magenta colorant (C.I. Pigment Red 202), or 5.0 parts by weight of cyan colorant (C.I. Pigment Blue 15:3) instead of carbon black as a colorant. Furthermore, toners and two-component developers of the above colors were prepared as in Example 1. In the image-forming apparatus shown in FIG. 1, the yellow two-component developer was placed in a developing apparatus 4-1, the magenta two-component developer was placed in a developing apparatus 4-2, the cyan two-component developer was placed in a developing apparatus 4-3, and the black two-component developer of Example 1 was placed in the developing apparatus 4—4. When a printout test was conducted in a full color mode, good full color images faithful to the original image were obtained.

Table 5 shows the physical properties of the yellow, magenta, and cyan toners.

TABLE 5

| | Toner | | | | | | | | |
|---|---|---|---|---|---|---|---|---|---|
| | | | | Weight average | Variation | Blocking resistance (temperature: 50° C.) | | | |
| Type | SF-1 | SF-2 | SF-2/SF-1 | particle size (μm) | coefficient (%) | 8 hours later | 16 hours later | 24 hours later | 1 week later |
| Yellow toner | 106 | 103 | 0.97 | 5.6 | 22 | A | A | A | A |
| Magenta toner | 110 | 108 | 0.98 | 5.9 | 19 | A | A | A | A |
| Cyan toner | 109 | 105 | 0.96 | 5.8 | 25 | A | A | A | A |

EXAMPLE 26 AND COMPARATIVE EXAMPE 33

The black toner A or (a) prepared in Example 1 was introduced into the image-forming apparatus shown in FIG. 3 to conduct a printout test using non-magnetic one component jumping development. Table 6 shows the results.

In the image-forming apparatus, the transfer speed on the surface of a developing sleeve 24 was set 3.0 times as high as that of a photosensitive drum 25, evaluations were conducted in a monochromatic intermittent mode (that is, the mode in which the developing device is paused for 10 seconds each time one sheet has been printed out so that its extra operation during re-activation facilitates the degradation of the toner) as in Example 12 while refilling the toner as required.

The surface roughness Ra of the developing sleeve 24 was 1.5, and a toner restraining plate 23 comprised a phosphor bronze base plate to which urethane rubber is adhered and having a surface abutted by the developing sleeve 24 and coated with nylon. In addition, the heating pressurizing fixing apparatus comprised the fixing apparatus shown in FIGS. 5 and 6. The surface temperature of a temperature-detecting element 31*d* of a heating element 31 was 140° C., the total pressure between the heating element 31 and a sponge pressurizing roller 33 having a foaming member of silicon rubber in its underlayer was set at 8 kg, and the nip between the pressurizing roller and a film was set at 6 mm. A fixing film 32 comprised a heat-resistant polyimide film of thickness 60 μm having in its interface with a transfer material, a mold releasing layer of low resistance containing a conductive material dispersed in PTEF (a high-molecular-weight type).

TABLE 6

Results of Printout Image Evaluations and Image-forming Apparatus Matching Evaluations

| | | Printout image evaluations | | | | | | | | | | | | Image-forming apparatus matching evaluations | |
|---|---|---|---|---|---|---|---|---|---|---|---|---|---|---|---|
| | | Normal temperature and humidity | | | | High temperature and humidity | | | | | | | | | |
| | | | Dot re- | | | | Dot re- | | | Unprinted portions | | Fix- | Offset | | Inter- |
| | Toner type | Image density | productivity | Fogging | Ghost | Image density | productivity | Fogging | Scattering | 128 g/m² paper | 135 g/m² paper | property | resistance | Developing sleeve | mediate transfer member |
| Example 26 | (A) | A | A | A | A | A | A | A | A | A | A | A | A | A | A |
| Comparative example 33 | (a) | C | D | D | D | C | D | D | D | D | D | C | D | C | D |

EXAMPLE 27 AND COMPARATIVE EXAMPLE 34

Figure 4:
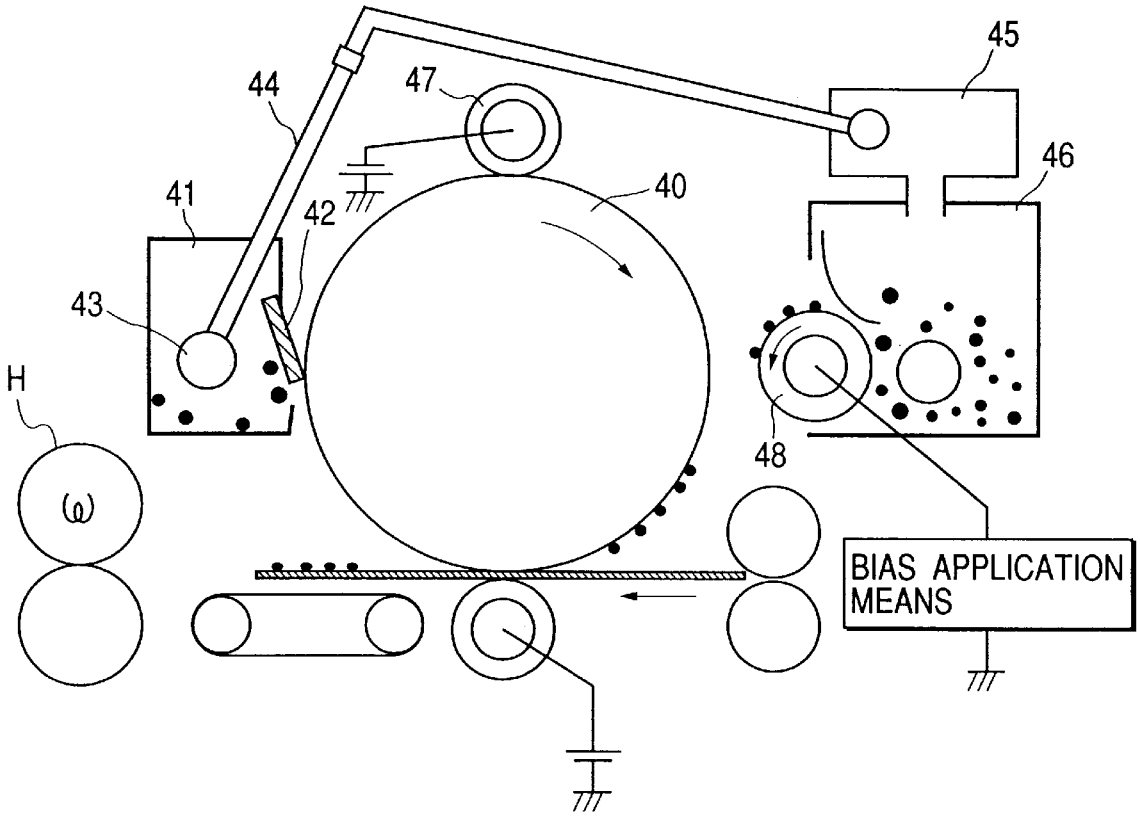
FIG. 4 is a schematic drawing of a main portion of an image-forming apparatus in which a remaining untransferred toner is reused.

This example used the image-forming apparatus shown in FIG. 4, comprising commercially available Laser Beam Printer LBP-EX (Canon Inc.) which was modified by mounting a reuse mechanism therein. In the image-forming apparatus in FIG. 4, the toner remaining on a photosensitive drum 40 without being transferred was scraped by an elastic blade 42 of a cleaner 41 abutting the photosensitive drum and was fed to the inside of a cleaner using a cleaner roller. The toner then passed through a cleaner screw 43 and was returned to a developing device 46 through a supply pipe 44 having a transfer screw and through a hopper 45. Then again, a system enabling toner to be recycled was mounted, and a dark potential $V_D$ of −700 V and a bright potential $V_L$ of −200 V were formed on the photosensitive drum 40 using laser exposure (600 dpi) and using as a primary charging roller 47 a rubber roller (diameter: 12 mm; abutting pressure: 50 g/cm) covered with nylon resin and having conductive carbon dispersed therein. A toner carrier 48 had coated on its surface, resin having carbon black dispersed therein, and had a surface roughness Ra of 1.1, and the transfer speed on the surface of the developing sleeve 48 was set 1.1 times as high as that of the photosensitive drum 40. Then, the gap between the photosensitive drum 40 and the toner carrier 48 (S-D) was set at 270 $\mu$m, an urethane rubber blade was used as a toner regulating member in such a way as to abut the drum. As a developing bias, an alternating bias component was superposed on a direct bias component. The temperature of the heating pressurizing fixing apparatus was set at 150° C.

Under these set conditions and in a normal temperature and humidity (25° C., 60% RH) and a low temperature and humidity (15° C., 10% RH) environment, a printout test was conducted at a print out speed of 12 sheets (A4 size)/min. in the intermittent mode (that is, the mode in which the developing device is paused for 10 seconds each time one sheet has been printed out so that its extra operation during re-activation facilitates the degradation of the toner), while the black toner (A) and the black toner (O) were supplied successively, and the printout images obtained were evaluated for the following items.

Table 7 shows the results of the evaluations.

then heated up to 60° C. A fast agitator TK-type homo mixer (manufactured by Special Mechanical and Chemical Industry Inc.) was used to agitate the mixture at 12,000 rpm. 70 parts by weight of 1.0M-$CaCl_2$ water solution was gradually added to the mixture to obtain an aqueous medium containing a fine water-insoluble dispersion stabilizer.

| | |
|---|---|
| Styrene | 80 parts by weight |
| n-butylacrylate | 20 parts by weight |
| Polyester resin (weight average molecular weight: 10,600, peak molecular weight = 8,900, acid value = 6.3) | 4 parts by weight |
| Colorant (carbon black) | 6 parts by weight |
| Negative-charging control agent (iron compound of monoazo pigment) | 2 parts by weight |
| Wax F | 15 parts by weight |

Of these materials, the colorant, the iron compound of monoazo pigment, and styrene were used to manufacture a master batch of carbon black using Attriter (Mitsui Metal Inc.). Then, the master batch and the remaining materials were heated up to 60° C., dissolved, and dispersed to obtain a polymerized monomer mixture. Furthermore, 8 parts by weight of 2, 2'-azobis (2, 4-dimethylvaleronitrile), which was a polymerization initiator, was added to the mixture while the temperature was maintained at 60° C. in order to prepare a polymerized monomer composition.

The polymerized monomer composition was fed in the aqueous medium in the flask including the homo mixer. The mixture was then agitated in an $N_2$ atmosphere at 60° C. for 20 minutes using the TK homo mixer rotated at 12,000 rpm to granulate the polymerized monomer composition in the aqueous medium. Subsequently, the composition was reacted at 60° C. for six hours while being agitated by a paddle agitating vane, and then polymerized at 80° C. for 8 hours.

After polymerization, the turbid liquid was cooled, and hydrochloric acid was added to the liquid to dissolve $Ca_3(PO_4)_2$, followed by filtering, flushing, and drying to obtain black toner particles (I) of weight average particle size 7.4 $\mu$m.

One point five parts by weight of hydrophobic silica fine powders (BET specific surface area 120 $m^2/g$) obtained by

TABLE 7

Results of Printout Image Evaluations and Image-forming Apparatus Matching Evaluations

| | | Printout image evaluations | | | | | | | | | | Image-forming apparatus matching evaluations | |
|---|---|---|---|---|---|---|---|---|---|---|---|---|---|
| | | Normal temperature and humidity | | | | Low temperature and humidity | | | | | | | |
| | | | Dot re- | | | | Dot re- | Scattering | | | | Photo- | Develop- |
| | Toner type | Image density | productivity | Fogging | Ghost | Image density | productivity | 75 g/m² paper | 105 g/m² paper | 135 g/m² paper | Ghost | sensitive drum | ing sleeve |
| Example 27 | (A) | A | A | A | A | A | A | A | A | A | A | A | A |
| Comparative example 34 | (o) | C | D | C | D | C | D | D | D | D | D | D | D |

EXAMPLE 28

Five hundred parts by weight of 0.1M-$Na_3PO_4$ solution was fed in 650 parts by weight of ion exchange water in a four-neck flask including a baffle plate, and the flask was treating silica powders of BET specific surface area 200 $m^2/g$ using a silane coupling agent and dimethyl silicone oil was externally added to 100 parts by weight of black toner particles (I) obtained to obtain black toner (I).

A fault plane of the black toner particle (I) was TEM-observed to find that the wax (F) was dispersed all over the toner particle substantially in the form of sphere in an undefined form due to its incompatibility with the binder resin.

The wax F was contained in about 15 parts by weight of toner particles per 100 parts by weight of binder resin component, and the black toner (I) had a negative triboelectric characteristic. Table 8 shows the physical properties of the black toner (I) obtained.

EXAMPLES 29 AND 30

Black toners (II) and (III) were prepared in the same manner as in Example 28 except for the use of 1.4 (Example 29) or 30 (Example 30) parts by weight of wax (F). Table 8 shows the physical properties of each black toner obtained.

EXAMPLES 31 TO 35

Black toners (IV), (V), (VI), (VII), and (VIII) were obtained in the same manner as in Example 28 except for the use of wax A (Example 31), wax B (Example 32), wax C (Example 33), wax D (Example 34), or wax E (Example 35). Table 8 shows the physical properties of each black toner obtained.

EXAMPLE 36

Five hundred and twenty parts by weight of 0.1M-$Na_3PO_4$ was fed in 710 parts by weight of ion exchange water in a four-neck flask including a baffle plate, and the flask was then heated up to 60° C. A fast agitator TK-type homo mixer (manufactured by Tokushukika Kogyo Co., Ltd.) was used to agitate the mixture at 12,000 rpm. Eighty five parts by weight of 1.0M-$CaCl_2$ water solution was gradually added to the mixture to prepare an aqueous medium containing a fine water-insoluble stabilizer.

| | |
|---|---|
| Styrene | 80 parts by weight |
| n-butylacrylate | 20 parts by weight |
| Polyester resin (weight average molecular weight: 10,600, peak molecular weight = 8,900, acid value = 6.3) | 4 parts by weight |
| Cyan colorant (C.I. pigment blue 15:3) | 5 parts by weight |
| Negative-charging control agent (A1 compound of 2,5-di-tert-butyl salicylate) | 2 parts by weight |
| Wax F | 15 parts by weight |

Of these materials, the colorant, the Al compound of di-tert-butyl salicylate, and styrene were preliminarily mixed together using Ebara milder (manufactured by Ebara Manufacturing Company). Then, the remaining materials were added to the flask, which was then heated up to 60° C. to dissolve and disperse the mixture to obtain a polymerized monomer mixture. Furthermore, 10 parts by weight of polymerization initiator, 2, 2'-azobis (2, 4-dimethylvaleronitrile) was added to the mixture while the temperature was maintained at 60° C. in order to prepare a polymerized monomer composition.

The polymerized monomer composition was fed in the aqueous medium in the flask including the homo mixer. The mixture was then agitated in an $N_2$ atmosphere at 60° C. for 20 minutes using the TK homo mixer rotated at 10,000 rpm to granulate the polymerized monomer composition in the aqueous medium. Subsequently, the composition was reacted at 60° C. for six hours while being agitated by a paddle agitating vane, and then polymerized at 80° C. for 10 hours.

After polymerization, the turbid liquid was cooled, and hydrochloric acid was added to the liquid to dissolve $Ca_3(PO_4)_2$, followed by filtering, flushing, and drying to obtain cyan toner particles of weight average particle size 7.0 $\mu$m.

One point five parts by weight of hydrophobic silica fine powders according to Example 28 was externally added to 100 parts by weight of cyan toner particles obtained to obtain cyan toner. The cyan toner obtained exhibit the physical properties shown in Table 8.

EXAMPLES 37 AND 38

Magenta and yellow toners were obtained in the same manner as in Example 36 except for the use of a magenta colorant (C.I. pigment red 202) or a yellow colorant (C.I. pigment yellow 17). Table 8 shows the physical properties of the toners obtained.

EXAMPLE 39

| | |
|---|---|
| Styrene-n-butylacrylate copolymer (weight average molecular weight: 141,000; copolymerization ratio 80:20) | 100 parts by weight |
| Polyester resin (weight average molecular weight: 10,600; peak molecular weight: 8,900; acid value: 6.3) | 4 parts by weight |
| Colorant (carbon black) | 6 parts by weight |
| Negative-charging control agent (iron compound of a monoazo pigment) | 2 parts by weight |
| Wax F | 5 parts by weight |

These materials were mixed together beforehand and melted and kneaded using a two-axis extruder at 130° C., and the melted and kneaded mixture was cooled and roughly crushed using a hammer mill to obtain roughly crushed toner of 1 mm mesh path. The roughly crushed mixture was finely crushed using a impact crusher that uses a jet stream, and the finely crushed mixture was air-classified to obtain black toner particles (IX) of weight average particle size 9.4 $\mu$m. Hydrophobic silica fine powders having a specific surface area of 120 $m^2/g$ obtained by treating a silane coupling agent and silicone oil to make hydrophobic the surface of silica fine powders having a specific surface area of 200 $m^2/g$ by the BET method using a silane coupling agent and dimethyl siicone oil was externally added at 1.0 pts. wt to 100 parts by weight of black toner particles (IX) obtained to obtain black toner (IX). Table 8 shows the physical properties of the black toner (IX) obtained.

A fault plane of the black toner particle (IX) was TEM-observed to find that the wax F was dispersed all over the toner particle in an undefined form due to its incompatibility with the binder resin.

EXAMPLE 40

Black toner (X) was obtained in the same manner as in Example 39 except for the use of 15 parts by weight of wax F. Table 8 shows the physical properties of the black toner (X) obtained.

EXAMPLE 41

The black toner particles (IX) according to Example 39 were added to a water solution containing a surface active agent, and the solution was surface-treated at 80° C. for 2.5 hours while being agitated at a high speed. The solution was then filtered, flushed, and dried to obtain black toner particles (XI) of weight average particle size 9.6 μm. One point zero parts by weight of hydrophobic silica powders according to Example 39 were externally added to 100 parts by weight of black toner particles (XI) to obtain black toner (XI). Table 8 shows the physical properties of the black toner (XI) obtained.

COMPARATIVE EXAMPLES 35 TO 41

Black toners (i), (ii), (iii), (iv), (v), (vi), and (vii) were obtained in the same manner as in Example 28 except for the use of wax (a) (Comparative Example 35), wax (b) (Comparative Example 36), wax (e) (Comparative Example 37), wax (h) (Comparative Example 38), wax (m) (Comparative Example 39), wax (n) (Comparative Example 40), or wax (o) (Comparative Example 40) instead of the wax F. Table 8 shows the physical properties of the black toners obtained.

TABLE 8

| | Toner | | | | | | | | | |
|---|---|---|---|---|---|---|---|---|---|---|
| | | | | | Weight average | Variation | Blocking resistance (temperature: 50° C.) | | | |
| | Type | SF-1 | SF-2 | SF-2/SF-1 | particle size (μm) | coefficient (%) | 8 hours later | 16 hours later | 24 hours later | 1 week later |
| Example 28 | Black toner (I) | 114 | 111 | 0.97 | 7.4 | 23 | A | A | A | A |
| Example 29 | Black toner (II) | 122 | 116 | 0.95 | 7.1 | 32 | A | A | A | A |
| Example 30 | Black toner (III) | 129 | 123 | 0.95 | 6.8 | 20 | A | A | A | B |
| Example 31 | Black toner (IV) | 118 | 113 | 0.96 | 7.2 | 22 | A | A | A | B |
| Example 32 | Black toner (V) | 117 | 109 | 0.93 | 7.6 | 24 | A | A | A | B |
| Example 33 | Black toner (VI) | 128 | 121 | 0.95 | 7.0 | 28 | A | A | B | B |
| Example 34 | Black toner (VII) | 131 | 124 | 0.95 | 6.9 | 25 | A | A | B | B |
| Example 35 | Black toner (VIII) | 143 | 127 | 0.89 | 7.2 | 27 | A | A | B | C |
| Example 36 | Cyan toner | 115 | 112 | 0.97 | 7.0 | 22 | A | A | A | A |
| Example 37 | Magenta toner | 113 | 110 | 0.97 | 7.1 | 24 | A | A | A | A |
| Example 38 | Yellow toner | 114 | 109 | 0.96 | 7.1 | 23 | A | A | A | A |
| Example 39 | Black toner (IX) | 163 | 171 | 1.05 | 9.4 | 32 | B | B | B | C |
| Example 40 | Black toner (X) | 168 | 165 | 0.98 | 9.9 | 35 | B | B | C | C |
| Example 41 | Black toner (XI) | 144 | 141 | 0.98 | 9.6 | 30 | B | B | C | C |
| Comparative example 35 | Black toner (i) | 120 | 116 | 0.97 | 7.8 | 29 | B | B | C | D |
| Comparative example 36 | Black toner (ii) | 124 | 127 | 1.02 | 6.9 | 32 | A | B | C | D |
| Comparative example 37 | Black toner (iii) | 132 | 136 | 1.03 | 6.7 | 30 | A | B | C | D |
| Comparative example 38 | Black toner (iv) | 128 | 119 | 0.93 | 7.8 | 31 | B | B | C | D |
| Comparative example 39 | Black toner (v) | 131 | 120 | 0.92 | 8.4 | 33 | B | C | C | D |
| Comparative example 40 | Black toner (vi) | 111 | 108 | 0.97 | 8.0 | 36 | B | B | C | D |
| Comparative example 41 | Black toner (vii) | 122 | 119 | 0.98 | 8.3 | 37 | B | B | B | D |

EXAMPLES 42 TO 55 AND COMPARATIVE EXAMPLES 42 TO 48

The electrophotographic apparatus comprised a 600-dpi laser beam printer (manufactured by Canon Inc.: LBP-860) that was modified so as to operate at a process speed of 60 mm/s. FIG. 7 shows its schematic drawing. A cleaning rubber blade in a process cartridge for the laser beam printer was removed, direct charging based on the abutment of a rubber roller 110 was used as an apparatus charging method, and a DC voltage component (−1200 V) was applied.

Next, a developing part of the process cartridge was modified. A medium-resistance rubber roller (diameter: 16 mm; hardness: ASKER C 45; resistance: $10^5\Omega\cdot$cm) consisting of silicone rubber with carbon black dispersed therein was used as a toner carrier 102, instead of the stainless sleeve as a toner supplier, and was contacted with a photosensitive drum 109. The developing nip width was set at about 3 mm. The toner carrier 102 was driven in the same direction as the photosensitive drum 109 at the contact portion between the carrier and the drum and at a rotational peripheral speed that was 140% of that of the drum 109. The one-component contact developing method and the reverse developing method were used to develop electrostatic images.

The photosensitive drum 109 was produced by using as a substrate an aluminum cylinder of diameter 30 mm and length 254 mm and sequentially layers of the following constitutions by means of dip application.

(1) Conductive coating layer: Mainly consists of tin- and titanium-oxide powders dispersed in phenol resin. It is 15 μm thick.

(2) Undercoating layer: Mainly consists of modified nylon and copolymerized nylon. It is 0.6 μm thick.

(3) Charge generating layer: Mainly consists of titanylphthalocyanine pigment capable of absorption in a long-wavelength region and dispersed in butyral resin. It is 0.6 μm thick.

(4) Charge transporting layer: Mainly consists of a hole-transporting triphenylamine compound dissolved into polycarbonate resin (molecular weight based on the Ostwald viscometry: 20,000) at a mass ratio of 8:10. It is 20 μm thick.

A coating roller 103 consisting of urethane foaming rubber was provided in a developing device as a means for coating toner on the toner carrier 102, and was contacted with the toner carrier 102. A voltage of about −550 V was applied to the coating roller 103.

Furthermore, a stainless blade 101 on which resin was coated to control the toner coating layer on the toner carrier 102 was mounted in such a way that a linear contact pressure of about 20 g/cm was effected between the blade and the toner carrier 102. Only a DC voltage component (−450V) was applied during development.

To adapt the electrophotographic apparatus and the process conditions for the modified process cartridge, the apparatus was modified and the conditions were set as follows.

The modified apparatus used a roller charger 110 (applying only a direct current) to uniformly charge the photosensitive drum 109. Then, an image part was exposed to laser beams to form an electrostatic image. Subsequently, development was executed to form a toner image, and a transfer roller 106 to which a voltage of +700 V had been applied was used to transfer the toner image to a transfer material 105.

With respect to the charging potential of the photosensitive drum 109, the dark potential was −580 V and the bright potential was −150 V. The transfer material 105 comprised 75 g/m$^2$ paper.

The black toners (I) to (XI), cyan toner, magenta toner, yellow toner, and black toners (i) to (vii) were introduced into the process cartridge to conduct a printout test. Table 9 shows the results of evaluations.

Now, the evaluation method is described. The transfer property was evaluated by using Mylar tape to scrape the remaining toner on the photosensitive drum after the 20-th sheet was printed during the initial durability evaluation period using solid black development and subtracting the Macbeth density of this tape from the Macbeth density on the paper. Thus, the smaller this value, the better the transfer property.

The toner recycling capability during the development process was determined by an image of a non-image part (so called a ghost image) appeared on the image sample obtained. If the toner remaining on the photosensitive drum without being transferred is recycled during the development process, an image of the non-image part does not appear. If, however, the toner is not recycled appropriately, untreated toner again passes through the transfer process again and was then transferred to paper, resulting in ghost images.

A: No ghost occurred.

B: Good (no ghost could be observed without a steady gaze)

C: Ghosts occurred but the image was at a practical level.

D: Bad

Up to 2,000 sheets were printed when no ghost or non-uniform charging occurred.

In addition, the resolution during the initial durability evaluation period was evaluated based on the reproducibility for one isolated dot of a small diameter at 600 dpi which was difficult to reproduce because electric fields are likely to be closed by latent image fields.

A: Very good: 5 or less/100 dots missing

B: Good: 6–10/100 dots missing

C: Normal: 11 to 20/100 dots missing

D: Bad: 20 or more/100 dots missing

The offset was evaluated by checking the rear sides of up to 100-th image samples for stains and counting the number of stained samples.

Fogging was measured using REFLECTOMETER MODEL TC-6DS manufactured by Tokyo Denshoku Inc.

An umber light filter was used for the cyan toner, a blue filter was used for the yellow toner, and a green filter was used for the other toners. The following equation was used for calculations. The smaller this value, less and less distinct fogging. Fogging [reflectivity (%)]=[reflectivity (%) on standard paper]−[reflectivity of the non-image part on the sample]

TABLE 9

| | | Initial durability evaluation period | | | | Presence of ghosts caused by | | |
|---|---|---|---|---|---|---|---|---|
| | Type | Image density | Fog-ging | Transfer property | Resolution | inappropriate recycling | Stains on the rear surface of the print | Time when non-uniform charging occurred |
| Example 42 | Black toner (I) | 1.53 | 0.4 | 0.02 | A | A | Absent | Not occurred |
| Example 43 | Black toner (II) | 1.40 | 0.3 | 0.04 | B | C | Present on 6/100 sheets | 1800-th sheet and later (minor) |
| Example 44 | Black toner (III) | 1.46 | 1.3 | 0.08 | B | B | Absent | 1900-th sheet and later (minor) |
| Example 45 | Black toner (IV) | 1.52 | 0.6 | 0.03 | A | A | Absent | Not occurred |
| Example 46 | Black toner (V) | 1.44 | 0.4 | 0.10 | B | C | Absent | 1800-th sheet and later (minor) |
| Example 47 | Black toner (VI) | 1.50 | 0.6 | 0.04 | A | A | Absent | Not occurred |
| Example 48 | Black toner (VII) | 1.50 | 0.6 | 0.04 | A | A | Absent | Not occurred |
| Example 49 | Black toner (VIII) | 1.49 | 0.8 | 0.07 | A | B | Absent | 1900-th sheet and later (minor) |
| Example 50 | Cyan toner | 1.52 | 0.4 | 0.02 | A | A | Absent | Not occurred |
| Example 51 | Magenta toner | 1.51 | 0.4 | 0.03 | A | A | Absent | Not occurred |
| Example 52 | Yellow toner | 1.54 | 0.4 | 0.02 | A | A | Absent | Not occurred |
| Example 53 | Black toner (IX) | 1.40 | 1.5 | 0.16 | C | C | Absent | 1600-th sheet and later (minor) |
| Example 54 | Black toner (X) | 1.40 | 1.6 | 0.18 | C | C | Absent | 1500-th sheet and later (minor) |
| Example 55 | Black toner (XI) | 1.44 | 1.3 | 0.14 | B | C | Absent | 1700-th sheet and later (minor) |
| Comparative example 42 | Black toner (i) | 1.39 | 1.1 | 0.19 | C | C | Absent | 800-th sheet |
| Comparative example 43 | Black toner (ii) | 1.39 | 1.8 | 0.17 | C | C | Absent | 900-th sheet |
| Comparative example 44 | Black toner (iii) | 1.36 | 1.9 | 0.18 | C | C | Absent | 700-th sheet |
| Comparative example 45 | Black toner (iv) | 1.35 | 2.0 | 0.20 | C | C | Absent | 600-th sheet |
| Comparative example 46 | Black toner (v) | 1.31 | 0.6 | 0.28 | C | D(1) | Present on 11/100 sheets | Evaluation was aborted. |
| Comparative example 47 | Black toner (vi) | 1.25 | 0.7 | 0.33 | C | D(1) | Present on 6/100 sheets | Evaluation was aborted. |
| Comparative example 48 | Black toner (vii) | 1.24 | 0.7 | 0.34 | C | D(1) | Present on 5/100 sheets | Evaluation was aborted. |

Note (1):
A distinct ghost phenomenon occurred so the durability evaluation was aborted.

EXAMPLE 56

In the image-forming apparatus shown in FIG. 9, the yellow toner according to Example 38 was introduced into a yellow developing device 204-1, the magenta toner according to Example 37 was introduced into a magenta developing device 204-2, the cyan toner according to Example 38 was introduced into a cyan developing device 204-3, and the black toner (I) according to Example 28 was introduced into a black developing device. Then, a printout test was conducted in a full color mode.

A photosensitive drum 1 had a photosensitive layer 1*b* having an organic photosemiconductor on a substrate 1*a* and rotated in the direction shown by the arrow. A charging roller 2 (a conductive elastic layer 2*a* and a core 2*b*) opposed to the photosensitive drum 1 so as to rotate while contacting the drum 1 was used to charge the drum 1 to a surface potential of about −600 V. An exposure 3 was turned on and off using a polygon mirror, depending on digital image information, so that an electrostatic digital image having an exposure potential of −100 V and a dark potential of −600 V was formed on the photosensitive drum 1. Developing devices 204-1, 204-2, 204-3, and 204-4 were used to reversely develop the electrostatic image formed on the photosensitive drum 1 using the contact developing method of the non-magnetic one component, thereby sequentially forming toner images of the respective colors on the photosensitive drum 1. After development for each color, the toner images were sequentially transferred to an intermediate transfer member 5, and was finally collectively transferred onto a transfer member P. In this case, the toner remaining on the photosensitive drum 1 without being transferred was cleaned by means of a cleaning member 8, and the toner remaining on the intermediate transfer member 5 was charged by a charging means 207 and was moved to the photosensitive drum 1, where it was cleaned.

The intermediate transfer member 5 was produced by coating a pipe-shaped core 5*b* with an elastic layer 5*a* comprising nitrile-butadiene rubber (NBR) in which a conductivity-applying member of carbon black was sufficiently dispersed. The coat layer 5*a* had a hardness of 20 in conformity to "JIS K-6301" and had a volume-specific resistance value of $10^9\Omega\cdot$cm. According to this example, images were transferred from the photosensitive drum 1 to the intermediate transfer member 5 by applying +700 V to the core 5*b* from a power supply 206. A roller 214 for charging a transfer belt 215 had an outer diameter of 20 mm, and had an elastic layer generated by coating a core of diameter 10 mm with a foaming member of ethylene-propylene-diene three-component polymer (EPDM) in which a conductivity-applying member of carbon was sufficiently dispersed. The elastic layer had a volume-specific resistance value of $10^6\Omega\cdot$cm and had a hardness of 35 according to "JIS K-6301". A voltage was applied to the roller to allow a 11-$\mu$A transfer current to flow therethrough.

A heating pressurizing fixing apparatus 225 comprised a thermal-roll fixing apparatus having no oil-applying function.

Under the above setting conditions, a durability evaluation for an image of printing area 7% was conducted at a temperature of 30° C. and a humidity of 85%, using continuous printing at a feeding speed of 8 sheets/min (A4 size).

As a result, no ghosts or rear stains occurred, and no problem occurred up to the 2,000-th full color print in terms of image density or transfer property. Full color images faithful to the original image and having excellent colors were obtained.

What is claimed is:

1. A toner for developing an electrostatic image, comprising toner particles containing at least a binder resin, a colorant, and a wax, wherein the wax contains an ester compound represented by Formula (A), (B), (C), or (D), or a mixture thereof at a content ranging from 50 to 100% by weight based on the weight of the wax:

(A)

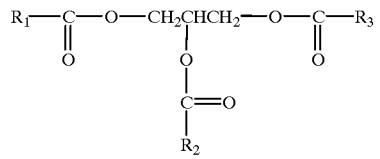

(where $R_1$, $R_2$, and $R_3$ are independently an organic group having from 9 to 39 carbons);

(B)

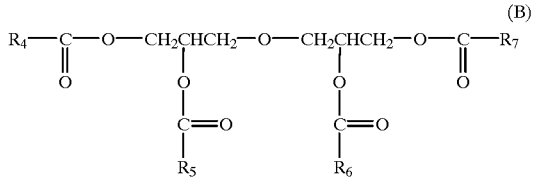

(where $R_4$, $R_5$, $R_6$, and $R_7$ are independently an organic group having from 9 to 39 carbons);

(C)

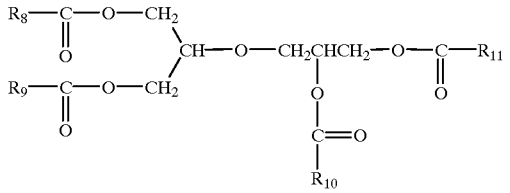

(where $R_8$, $R_9$, $R_{10}$ and $R_{11}$ are independently an organic group having from 9 to 39 carbons);

(D)

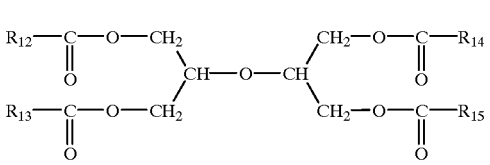

(where $R_{12}$, $R_{13}$, $R_{14}$ and $R_{15}$ are independently an organic group having from 9 to 39 carbons).

2. The toner according to claim 1, wherein the wax contains the ester compound represented by Formula (A) at a content ranging from 60 to 100% by weight.

3. The toner according to claim 1, wherein the wax contains the ester compound represented by Formula (A) at a content ranging from 70 to 100% by weight.

4. The toner according to claim 1, wherein the wax contains the ester compound represented by Formula (A) at a content ranging from 80 to 100% by weight.

5. The toner according to claim 1, wherein the wax contains the ester compound represented by Formula (A) at a content ranging from 90 to 100% by weight.

6. The toner according to claim 1, wherein the wax contains the ester compound represented by Formula (B) at a content ranging from 60 to 100% by weight.

7. The toner according to claim 1, wherein the wax contains the ester compound represented by Formula (B) at a content ranging from 70 to 100% by weight.

8. The toner according to claim 1, wherein the wax contains the ester compound represented by Formula (B) at a content ranging from 80 to 100% by weight.

9. The toner according to claim 1, wherein the wax contains the ester compound represented by Formula (B) at a content ranging from 90 to 100% by weight.

10. The toner according to claim 1, wherein groups $R_1$ to $R_{15}$ are respectively a hydrocarbon group.

11. The toner according to claim 1, wherein groups $R_1$ to $R_{15}$ are respectively an alkyl group or an alkenyl group.

12. The toner according to claim 1, wherein groups $R_1$ to $R_{15}$ are respectively a straight alkyl group having from 13 to 29 carbons.

13. The toner according to claim 1, wherein groups $R_1$ to $R_{15}$ are respectively a straight alkyl group having from 15 to 25 carbons.

14. The toner according to claim 1, wherein the wax contains the ester compound represented by Formula (A), in which $R_1$, $R_2$, and $R_3$ are independently a straight alkyl group, at a content ranging from 60 to 100% by weight.

15. The toner according to claim 1, wherein the wax contains the ester compound represented by Formula (A) in which $R_1$, $R_2$, and $R_3$ are independently a straight alkyl group having from 13 to 29 carbons, at a content ranging from 70 to 100% by weight.

16. The toner according to claim 1, wherein the wax contains the ester compound represented by Formula (A) in which $R_1$, $R_2$, and $R_3$ are independently a straight alkyl group having from 15 to 25 carbons, at a content ranging from 80 to 100% by weight.

17. The toner according to claim 1, wherein the wax contains the ester compound represented by Formula (A) in which $R_1$, $R_2$, and $R_3$ are independently a straight alkyl group having from 15 to 25 carbons, at a content ranging from 90 to 100% by weight.

18. The toner according to claim 1, wherein the wax has a hydroxyl value ranging from 0 to 10 mgKOH/g.

19. The toner according to claim 1, wherein the wax has a hydroxyl value ranging from 0.1 to 5.0 mgKOH/g.

20. The toner according to claim 1, wherein the wax has an acid value ranging from 0 to 10 mgKOH/g.

21. The toner according to claim 1, wherein the wax has an acid value ranging from 0.1 to 5.0 mgKOH/g.

22. The toner according to claim 1, wherein the wax has a hydroxyl value ranging from 0 to 10 mgKOH/g, and an acid value ranging from 0 to 10 mgKOH/g.

23. The toner according to claim 1, wherein the wax has a hydroxyl value ranging from 0.1 to 5.0 mgKOH/g, and an acid value ranging from 0.1 to 5.0 mgKOH/g.

24. The toner according to claim 1, wherein the wax is a solid at a temperature of 25° C., and an endothermic main peak temperature ranges from 50 to 100° C. in the endothermic curve of differential thermal analysis.

25. The toner according to claim 1, wherein the wax is contained in the toner in an amount ranging from 1 to 30 parts by weight based on 100 parts by weight of the binder resin.

26. The toner according to claim 1, wherein the wax is contained in the toner in an amount ranging from 2 to 25 parts by weight based on 100 parts by weight of the binder resin.

27. The toner according to claim 1, wherein the wax constitutes a core portion of the toner particle.

28. The toner according to claim 1, wherein the wax constitutes a core portion of the toner particle, and is contained in a shape of a sphere or a spindle.

29. The toner according to claim 1, wherein the toner has a shape factor SF-1 ranging from 100 to 160, and a shape factor SF-2 ranging from 100 to 140.

30. The toner according to claim 1, wherein the toner has a shape factor SF-1 ranging from 100 to 140, and a shape factor SF-2 ranging from 100 to 120.

31. The toner according to claim 1, wherein the ratio of SF-2/SF-1 of the toner is not more than 1.0.

32. The toner according to claim 1, wherein the toner has a weight-average particle diameter ranging from 3 to 10 $\mu$m, and a variation coefficient in number distribution of less than 35.

33. The toner according to claim 1, wherein the toner has a weight-average particle diameter ranging from 4 to 9.9 $\mu$m, and a variation coefficient in number distribution of less than 35.

34. The toner according to claim 33, wherein the toner has a variation coefficient ranging from 5 to 34.

35. The toner according to claim 33, wherein the toner has a variation coefficient ranging from 5 to 30.

36. The toner according to claim 1, wherein the binder resin is a styrene-acrylate copolymer.

37. The toner according to claim 1, wherein the binder resin is a styrene-methacrylate copolymer.

38. The toner according to claim 1, wherein the binder resin is a polyester resin.

39. The toner according to claim 1, wherein the binder resin is an epoxy resin.

40. The toner according to claim 1, wherein the toner has an external additive on the surface of the particle of the toner.

41. The toner according to claim 40, wherein the toner contains the external additive at a content ranging from 0.1 to 5 parts by weight based on 100 parts by weight of the toner particles.

42. The toner according to claim 41, wherein the external additive is composed of fine inorganic particles.

43. The toner according to claim 42, wherein the fine inorganic particles have been treated with a silicone oil.

44. The toner according to claim 1, wherein the toner particles are prepared by dispersing a polymerizable monomer composition containing at least a polymerizable monomer, a colorant, a wax, and a polymerization initiator in a shape of particles in an aqueous medium, and polymerizing the polymerizable monomer in an aqueous medium.

45. The toner according to claim 44, wherein the polymerizable monomer composition contains additionally a polar resin.

46. The toner according to claim 44, wherein the polymerizable monomer contains at least a styrene monomer.

47. The toner according to claim 44, wherein the polymerizable monomer contains at least a styrene monomer and a polyester resin.

48. An image forming method, comprising charging electrically an electrostatic image holder by a charging means having a voltage applied thereto, forming an electrostatic image by light exposure on the charged electrostatic image holder, developing the electrostatic image with a toner in the developing means to form a toner image on the electrostatic image holder, transferring the toner image from the electrostatic image holder through an intermediate transfer member or directly onto a transfer medium, and fixing the toner image by hot-pressing fixing means; wherein the toner comprises toner particles containing at least a binder resin, a colorant, and a wax, wherein the wax contains an ester compound represented by Formula (A), (B), (C), or (D), or a mixture thereof at a content ranging from 50 to 100% by weight based on the weight of the wax:

(A)

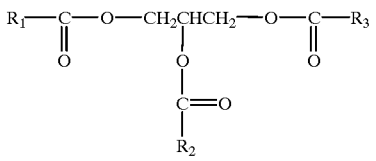

(where $R_1$, $R_2$, and $R_3$ are independently an organic group having from 9 to 39 carbons);

(B)

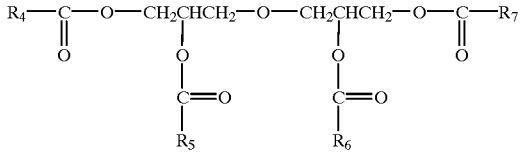

(where $R_4$, $R_5$, $R_6$, and $R_7$ are independently an organic group having from 9 to 39 carbons);

(C)

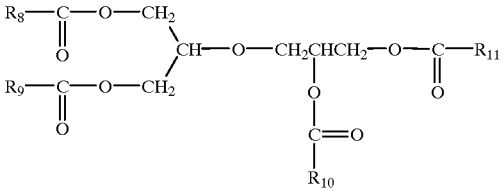

(where $R_8$, $R_9$, $R_{10}$ and $R_{11}$ are independently an organic group having from 9 to 39 carbons);

(D)

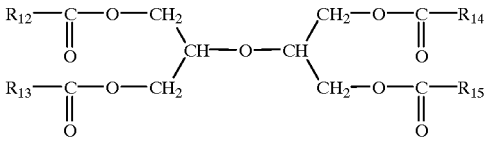

(where $R_{12}$, $R_{13}$, $R_{14}$ and $R_{15}$ are independently an organic group having from 9 to 39 carbons).

49. The image forming method according to claim 48, wherein the electrostatic image is developed with a two-component developing agent comprising at least a toner and a magnetic carrier.

50. The image forming method according to claim 48, wherein the electrostatic image is developed with a one-component developing agent comprising at least a toner.

51. The image forming method according to claim 48, wherein the developing means has a toner holder for holding and delivering the toner, and the toner holder is rotated at a peripheral velocity of from 1.05 to 3.0 times that of the electrostatic image holder at a development region where the toner holder comes closest to the electrostatic image holder.

52. The image forming method according to claim 48, wherein the toner holder has a surface roughness Ra ($\mu$m) of not more than 1.5, and the toner has a weight-average particle diameter ranging from 3 to 10 $\mu$m.

53. The image forming method according to claim 48, wherein the developing means has a toner holder for holding the toner, and a toner layer-controlling member for forming a toner layer on the toner holder, and the toner layer-controlling member has an elastic blade.

54. The image forming method according to claim 53, wherein the thickness of the toner layer formed on the toner holder is smaller than the gap between the toner holding member and the electrostatic image holder.

55. The image forming method according to claim 53, wherein the toner layer on the toner holding member is brought into contact with the electrostatic image holder at the development region.

56. The image forming method according to claim 55, wherein the toner layer on the toner holding member is pressed against the electrostatic image holder at the development region.

57. The image forming method according to claim 48, wherein the electrostatic image holder is charged electrically by contact with a charging member having a bias voltage applied thereto.

58. The image forming method according to claim 57, wherein the charging member is a charging roller.

59. The image forming method according to claim 48, wherein the electrostatic image formed by light exposure is a digital latent image.

60. The image forming method according to claim 48, wherein the developing means has a developing agent holder for holding and delivering a two-component developing agent composed at least of a toner and a magnetic carrier, and an alternate electric field is applied to the developing agent holder.

61. The image forming method according to claim 48, wherein the toner image on the electrostatic image holder is transferred once onto the intermediate transfer member, and then is transferred onto a transfer medium by a transfer roller having a bias applied or by a transfer belt provided with a roller having a bias applied.

62. The image forming method according to claim 48, wherein between the transfer step and the downstream charging step no cleaning step exist.

63. The image forming method according to claim 48, wherein the toner image is fixed by hot-pressing onto a transfer medium by a hot-pressing fixation device without an offset-preventing liquid application or without employing a fixing device cleaner.

64. The image forming method according to claim 48, wherein the toner image is transferred onto the transfer medium by hot pressing by a heater at a fixed position and a pressing member pressed against the heater with interposition of a film.

65. The image forming method according to claim 48, wherein an untransferred toner remaining on the electrostatic image holder after the image transfer is recovered by cleaning, and the recovered toner is fed to the developing means for storage and repeated use.

66. The image forming method according to claim 48, wherein the electrostatic image is developed successively by a toner selected from the group of a yellow toner, a magenta toner, a cyan toner, and a black toner; the respective toner images are laminated on the intermediate transfer member; the toner images of the respective colors are transferred from the intermediate transfer member to the transfer medium; and the toner images of the respective colors on the transfer medium are hot-pressed for fixation to form a full-color or multi-color image.

67. The image forming method according to claim 48, wherein the wax contains the ester compound represented by Formula (A) at a content ranging from 60 to 100% by weight.

68. The image forming method according to claim 48, wherein the wax contains the ester compound represented by Formula (A) at a content ranging from 70 to 100% by weight.

69. The image forming method according to claim 48, wherein the wax contains the ester compound represented by Formula (A) at a content ranging from 80 to 100% by weight.

70. The image forming method according to claim 48, wherein the wax contains the ester compound represented by Formula (A) at a content ranging from 90 to 100% by weight.

71. The image forming method according to claim 48, wherein the wax contains the ester compound represented by Formula (B) at a content ranging from 60 to 100% by weight.

72. The image forming method according to claim 48, wherein the wax contains the ester compound represented by Formula (B) at a content ranging from 70 to 100% by weight.

73. The image forming method according to claim 48, wherein the wax contains the ester compound represented by Formula (B) at a content ranging from 80 to 100% by weight.

74. The image forming method according to claim 48, wherein the wax contains the ester compound represented by Formula (B) at a content ranging from 90 to 100% by weight.

75. The image forming method according to claim 48, wherein groups $R_1$ to $R_{15}$ are respectively a hydrocarbon group.

76. The image forming method according to claim 48, wherein groups $R_1$ to $R_{15}$ are respectively an alkyl group or an alkenyl group.

77. The image forming method according to claim 48, wherein groups $R_1$ to $R_{15}$ are respectively a straight alkyl group having from 13 to 29 carbons.

78. The image forming method according to claim 48, wherein groups $R_1$ to $R_{15}$ are respectively a straight alkyl group having from 15 to 25 carbons.

79. The image forming method according to claim 48, wherein the wax contains the ester compound represented by Formula (A), in which $R_1$, $R_2$, and $R_3$ are independently a straight alkyl group, at a content ranging from 60 to 100% by weight.

80. The image forming method according to claim 48, wherein the wax contains the ester compound represented by Formula (A) in which $R_1$, $R_2$, and $R_3$ are independently a straight alkyl group having from 13 to 29 carbons, at a content ranging from 70 to 100% by weight.

81. The image forming method according to claim 48, wherein the wax contains the ester compound represented by Formula (A) in which $R_1$, $R_2$, and $R_3$ are independently a straight alkyl group having from 15 to 25 carbons, at a content ranging from 80 to 100% by weight.

82. The image forming method according to claim 48, wherein the wax contains the ester compound represented by Formula (A) in which $R_1$, $R_2$, and $R_3$ are independently a straight alkyl group having from 15 to 25 carbons, at a content ranging from 90 to 100% by weight.

83. The image forming method according to claim 48, wherein the wax has a hydroxyl value ranging from 0 to 10 mgKOH/g.

84. The image forming method according to claim 48, wherein the wax has a hydroxyl value ranging from 0.1 to 5.0 mgKOH/g.

85. The image forming method according to claim 48, wherein the wax has an acid value ranging from 0 to 10 mgKOH/g.

86. The image forming method according to claim 48, wherein the wax has an acid value ranging from 0.1 to 5.0 mgKOH/g.

87. The image forming method according to claim 48, wherein the wax has a hydroxyl value ranging from 0 to 10 mgKOH/g, and an acid value ranging from 0 to 10 mgKOH/g.

88. The image forming method according to claim 48, wherein the wax has a hydroxyl value ranging from 0.1 to 5.0 mgKOH/g, and an acid value ranging from 0.1 to 5.0 mgKOH/g.

89. The image forming method according to claim 48, wherein the wax is a solid at a temperature of 25° C., and an endothermic main peak temperature ranges from 50 to 100° C. in the endothermic curve of differential thermal analysis.

90. The image forming method according to claim 48, wherein the wax is contained in the toner in an amount ranging from 1 to 30 parts by weight based on 100 parts by weight of the binder resin.

91. The image forming method according to claim 48, wherein the wax is contained in the toner in an amount ranging from 2 to 25 parts by weight based on 100 parts by weight of the binder resin.

92. The image forming method according to claim 48, wherein the wax constitutes a core portion of the toner particle.

93. The image forming method according to claim 48, wherein the wax constitutes a core portion of the toner particle, and is contained in a shape of a sphere or a spindle.

94. The image forming method according to claim 48, wherein the toner has a shape factor SF-1 ranging from 100 to 160, and a shape factor SF-2 ranging from 100 to 140.

95. The image forming method according to claim 48, wherein the toner has a shape factor SF-1 ranging from 100 to 140, and a shape factor SF-2 ranging from 100 to 120.

96. The image forming method according to claim 48, wherein the ratio of SF-2/SF-1 of the toner is not more than 1.0.

97. The image forming method according to claim 48, wherein the toner has a weight-average particle diameter ranging from 3 to 10 $\mu$m, and a variation coefficient in number distribution of not more than 35.

98. The image forming method according to claim 48, wherein the toner has a weight-average particle diameter ranging from 4 to 9.9 $\mu$m, and a variation coefficient in number distribution of not more than 35.

99. The image forming method according to claim 98, wherein the toner has a variation coefficient ranging from 5 to 34.

100. The image forming method according to claim 98, wherein the toner has a variation coefficient ranging from 5 to 30.

101. The image forming method according to claim 48, wherein the binder resin is a styrene-acrylate copolymer.

102. The image forming method according to claim 48, wherein the binder resin is a styrene-methacrylate copolymer.

103. The image forming method according to claim 48, wherein the binder resin is a polyester resin.

104. The image forming method according to claim 48, wherein the binder resin is an epoxy resin.

105. The image forming method according to claim 48, wherein the toner has an external additive on the surface of the particle of the toner.

106. The image forming method according to claim 105, wherein the toner contains the external additive at a content ranging from 0.1 to 5 parts by weight based on 100 parts by weight of the toner particles.

107. The image forming method according to claim 106, wherein the external additive is composed of fine inorganic particles.

108. The image forming method according to claim 107, wherein the fine inorganic particles have been treated with a silicone oil.

109. The image forming method according to claim 48, wherein the toner particles are prepared by dispersing a polymerizable monomer composition containing at least a polymerizable monomer, a colorant, a wax, and a polymerization initiator in a shape of particles in an aqueous medium, and polymerizing the polymerizable monomer in an aqueous medium.

110. The image forming method according to claim 109, wherein the polymerizable monomer composition contains additionally a polar resin.

111. The image forming method according to claim 109, wherein the polymerizable monomer contains at least a styrene monomer.

112. The image forming method according to claim 109, wherein the polymerizable monomer contains at least a styrene monomer and a polyester resin.

* * * * *

UNITED STATES PATENT AND TRADEMARK OFFICE

CERTIFICATE OF CORRECTION

PATENT NO. : 5,998,080
DATED : December 7, 1999
INVENTOR(S) : Manabu Ohno et al.

It is certified that error appears in the above-identified patent and that said Letters Patent is hereby corrected as shown below:

Title page [56] References Cited:
U.S.PATENT DOCUMENTS

| | |
|---|---|
| "23910" should read | --42-23910-- |
| 24748 | 43-24748 |
| 3304 | 52-3304 |
| 3305 | 52-3305 |
| 52574 | 57-52574 |
| 215659 | 58-215659 |
| 217366 | 60-217366 |
| 252361 | 60-252361 |
| 14166 | 62-14166 |
| 109359 | 1-109359 |
| 185660 | 1-185660 |
| 238672 | 1-238672 |
| 79860 | 2-79860 |
| 50559 | 3-50559 |
| 184350 | 4-184350 |

Title page [57] ABSTRACT:
Line 3, "by" should read --by a--.

Column 1:
Line 50, "drum" should read --drums--; and
Line 63, "a" should be deleted.

UNITED STATES PATENT AND TRADEMARK OFFICE

CERTIFICATE OF CORRECTION

PATENT NO. : 5,998,080
DATED : December 7, 1999
INVENTOR(S) : Manabu Ohno et al.

It is certified that error appears in the above-identified patent and that said Letters Patent is hereby corrected as shown below:

Column 2:
Line 38, "in" should read --to--.

Column 3:
Line 9, "a" should be deleted;
Line 13, "tends" should read --tend--;
Line 49, "Is" should read --is--; and
Line 53, "resistance, and is suitable." should read --resistance.--.

Column 7:
Line 22, "R14" should read --$R_{14}$--; and
Line 55, "Compound" should read --compounds--.

Column 8:
Line 12, "ponent" should read --ponents--; and
Line 57, "flash" should read --flask--.

Column 9:
Line 60, "tone" should read --toner--.

Column 10:
Line 57, "appropriated" should read --appropriate--.

UNITED STATES PATENT AND TRADEMARK OFFICE

CERTIFICATE OF CORRECTION

PATENT NO. : 5,998,080
DATED : December 7, 1999
INVENTOR(S) : Manabu Ohno et al.

It is certified that error appears in the above-identified patent and that said Letters Patent is hereby corrected as shown below:

Column 11:
Line 11, "transfer" should read --transfers--;
Line 18, "Further more," should read --Furthermore,--; and
Line 40, "amount" should read --amounts--.

Column 13:
Line 44, "the" should read --The--; and
Line 55, "agent" should read --agents--.

Column 14:
Line 34, "by" produced" should be deleted; and
Line 43, "The" should read --With the--.

Column 15:
Line 59, "vigorous" should read --vigorously--.

Column 17:
Line 35, "brush" should read --brush and thus--.

Column 18:
Line 4, "cannot" should read --cannot be--; and
Line 64, "compose" should read --composed--.

UNITED STATES PATENT AND TRADEMARK OFFICE

CERTIFICATE OF CORRECTION

PATENT NO. : 5,998,080
DATED : December 7, 1999
INVENTOR(S) : Manabu Ohno et al.

It is certified that error appears in the above-identified patent and that said Letters Patent is hereby corrected as shown below:

Column 19:
Line 46, "ceramics," should read --ceramic,--.

Column 20:
Line 3, "tone" should read --toner--; and
Line 10, "a" should read --α--.

Column 21:
Line 2, "electrconductive" should read --electroconductive--; and
Line 66, "may" should read --may be--.

Column 22:
Line 7, "more" should read --more than--; and
Line 33, "is" should read --are--.

Column 24:
Line 67, "ceramics," should read --ceramic,--.

Column 26:
Line 1, "An" should read --A--.

Column 39:
TABLE 1-4, "i.2" should read --1.2--.

UNITED STATES PATENT AND TRADEMARK OFFICE

CERTIFICATE OF CORRECTION

PATENT NO. : 5,998,080
DATED : December 7, 1999
INVENTOR(S) : Manabu Ohno et al.

It is certified that error appears in the above-identified patent and that said Letters Patent is hereby corrected as shown below:

Column 42:
Line 63, "was fed in" should read --were fed into--;
Line 66, "ho" should read --hours--.

Column 43:
Line 1, "urs." should be deleted;
Line 5, "a sieve of 400 meshes" should read --a 400 mesh sieve--.

Column 45:
TABLE 3, "27 A A B" should read --27 A A B B-- and "Example 10 3" should read --Example 10 J--.

Column 50:
Line 25, "fix" should read --fixing--.

Column 51:
TABLE 4, "C 150 180 30" should read --D C 180 30--.

Column 53:
Line 42, "Example" should read --Example--.

Column 54:
Line 22, "silicon" should read --silicone--; and
TABLE 6, "evaluations" should read --evaluations--.

UNITED STATES PATENT AND TRADEMARK OFFICE

CERTIFICATE OF CORRECTION

PATENT NO. : 5,998,080
DATED : December 7, 1999
INVENTOR(S) : Manabu Ohno et al.

It is certified that error appears in the above-identified patent and that said Letters Patent is hereby corrected as shown below:

Column 55:
Line 26, "an" should read --a--.

Column 57:
Line 33, "Eighty" should read --Eighty---; and
Line 52, "Ebara milder" should read --an Ebara mill--.

Column 58:
Line 9, "powders" should read --powder--; and
Line 44, "powders" should read --powder--.

Column 60:
Line 51, "foaming" should read --foam--.

Column 61:
Line 22, "so" should read --a so---.;
Line 23, "a" should be deleted and "appeared"
should read --appearing--; and
Line 64, "again and was" should read --and is--.

UNITED STATES PATENT AND TRADEMARK OFFICE

CERTIFICATE OF CORRECTION

PATENT NO. : 5,998,080
DATED : December 7, 1999
INVENTOR(S) : Manabu Ohno et al.

It is certified that error appears in the above-identified patent and that said Letters Patent is hereby corrected as shown below:

Column 68:
Line 32, "transferred once" should read --first transferred--; and
Line 38, "exist" should read --exits--.

Signed and Sealed this

Third Day of July, 2001

Nicholas P. Godici

*Attest:*

*Attesting Officer*

NICHOLAS P. GODICI
*Acting Director of the United States Patent and Trademark Office*